US008562786B2

(12) United States Patent
Murray et al.

(10) Patent No.: US 8,562,786 B2
(45) Date of Patent: Oct. 22, 2013

(54) METHOD OF MAKING A FABRIC-CREPED ABSORBENT CELLULOSIC SHEET

(75) Inventors: Frank C. Murray, Marietta, GA (US); Greg A. Wendt, Neenah, WI (US); Steven L. Edwards, Fremont, WI (US); Stephen J. McCullough, Mount Calvary, WI (US); Guy H. Super, Menasha, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 13/460,891

(22) Filed: May 1, 2012

(65) Prior Publication Data

US 2012/0216972 A1 Aug. 30, 2012

Related U.S. Application Data

(60) Continuation of application No. 13/041,706, filed on Mar. 7, 2011, which is a continuation of application No. 12/657,645, filed on Jan. 25, 2010, now Pat. No. 7,927,456, which is a continuation of application No. 11/901,673, filed on Sep. 18, 2007, now Pat. No. 7,662,255, which is a division of application No. 11/108,458, filed on Apr. 18, 2005, now Pat. No. 7,442,278, and a continuation-in-part of application No. 10/679,682, filed on Oct. 6, 2003, now Pat. No. 7,399,378.

(60) Provisional application No. 60/563,519, filed on Apr. 19, 2004, provisional application No. 60/416,666, filed on Oct. 7, 2002.

(51) Int. Cl.

| | |
|---|---|
| ***B31F 1/16*** | (2006.01) |
| ***B31F 1/12*** | (2006.01) |
| ***D21H 25/04*** | (2006.01) |

(52) U.S. Cl.

USPC ..... 162/111; 162/117; 162/147; 162/197; 162/204; 156/183; 264/282

(58) Field of Classification Search

USPC ..... 162/109, 111–113, 115–117, 123–133, 162/193, 197, 204–207, 147, 149; 156/183; 264/282–283; 226/7, 91, 97.3; 34/114, 34/117, 122, 359, 444

See application file for complete search history.

(56) References Cited

U.S. PATENT DOCUMENTS 2,410,189 A * 10/1946 Straubel et al. ..... 425/337
3,342,936 A 9/1967 Ascoli et al.

(Continued)

FOREIGN PATENT DOCUMENTS

CA 1002359 12/1976
CA 2053505 4/1992

(Continued)

OTHER PUBLICATIONS

Espy, Herbert H., "Chapter 2: Alkaline-Curing Polymeric Amine-Epichlorohydrin Resins," in Wet Strength Resins and Their Application, L. Chan, Editor, 1994.

(Continued)

*Primary Examiner* — Jose A Fortuna

(74) *Attorney, Agent, or Firm* — Laura L. Bozek

(57) ABSTRACT

A method of making a fabric-creped absorbent cellulosic sheet. A papermaking furnish is compactively dewatered to form a nascent web. The nascent web is applied to a translating transfer surface and is fabric-creped from the transfer surface at a consistency of from about 30 to about 60 percent utilizing a creping fabric. The creping fabric travels at a fabric speed that is slower than the speed of the transfer surface. The nascent web is creped from the transfer surface and redistributed on the creping fabric to form a creped web with a drawable reticulum having a plurality of interconnected regions of different local basis weights. The creped web is dried to form a dried web, and the dried web is drawn. The drawing step includes drawing the dried web between a first draw roll and a second draw roll.

66 Claims, 35 Drawing Sheets

(56) References Cited

U.S. PATENT DOCUMENTS 3,414,459 A * 12/1968 Wells ..... 428/180
3,432,936 A 3/1969 Cole et al.
3,545,705 A 12/1970 Hodgson
3,549,742 A 12/1970 Benz
3,556,932 A 1/1971 Coscia et al.
3,556,933 A 1/1971 Williams et al.
3,560,333 A * 2/1971 Douglas et al. ..... 162/206
3,692,622 A 9/1972 Dunning
3,700,623 A 10/1972 Keim
3,772,076 A 11/1973 Keim
3,775,231 A * 11/1973 Thomas ..... 428/110
3,858,623 A 1/1975 Lefkowitz
3,949,128 A * 4/1976 Ostermeier ..... 428/152
3,974,025 A 8/1976 Ayers
3,994,771 A 11/1976 Morgan, Jr. et al.
4,041,989 A 8/1977 Johansson et al.
4,071,050 A 1/1978 Codomiu
4,102,737 A 7/1978 Morton
4,112,982 A 9/1978 Bugge et al.
4,149,571 A 4/1979 Burroughs
4,157,276 A 6/1979 Wandel et al.
4,161,195 A 7/1979 Khan
4,182,381 A 1/1980 Gisbourne
4,184,519 A 1/1980 McDonald et al.
4,225,382 A 9/1980 Kearney et al.
4,238,284 A * 12/1980 Huostila et al. ..... 162/207
4,239,065 A 12/1980 Trokhan
4,314,589 A 2/1982 Buchanan et al.
4,356,059 A 10/1982 Hostetler
4,359,069 A 11/1982 Hahn
4,376,455 A 3/1983 Hahn
4,379,735 A 4/1983 MacBean
4,420,372 A 12/1983 Hostetler
4,440,597 A 4/1984 Wells et al.
4,445,638 A 5/1984 Connell et al.
4,448,638 A 5/1984 Klowak
4,453,573 A 6/1984 Thompson
4,482,429 A 11/1984 Klowak
4,490,925 A 1/1985 Smith
4,529,480 A 7/1985 Trokhan
4,533,437 A 8/1985 Curran et al.
4,543,156 A 9/1985 Cheshire et al.
4,551,199 A 11/1985 Weldon
4,552,709 A 11/1985 Koger, II et al.
4,556,450 A 12/1985 Chuang et al.
4,564,052 A 1/1986 Borel
4,592,395 A 6/1986 Borel
4,603,716 A 8/1986 Rhodes
4,605,585 A 8/1986 Johansson
4,605,702 A 8/1986 Guerro et al.
4,611,639 A 9/1986 Bugge
4,614,679 A 9/1986 Farrington, Jr. et al.
4,637,859 A 1/1987 Trokhan
4,640,741 A 2/1987 Tsuneo
4,675,394 A 6/1987 Solarek et al.
4,689,119 A 8/1987 Weldon
4,709,732 A 12/1987 Kinnunen
4,720,383 A 1/1988 Drach et al.
4,759,391 A 7/1988 Waldvogel et al.
4,759,976 A 7/1988 Dutt
4,795,530 A 1/1989 Soerens et al.
4,804,769 A 2/1989 Solarek et al.
4,834,838 A 5/1989 Klowak
4,849,054 A 7/1989 Klowak
4,866,151 A 9/1989 Tsai et al.
4,942,077 A 7/1990 Wendt et al.
4,967,085 A 10/1990 Bryan et al.
4,973,512 A 11/1990 Stanley et al.
4,981,557 A 1/1991 Bjorkquist
4,983,748 A 1/1991 Tsai et al.
4,998,568 A 3/1991 Vohringer
5,008,344 A 4/1991 Bjorkquist
5,016,678 A 5/1991 Borel et al.
5,023,132 A 6/1991 Stanley et al.
5,054,525 A 10/1991 Vohringer
5,066,532 A 11/1991 Gaisser
5,085,736 A 2/1992 Bjorkquist
5,087,324 A 2/1992 Awofeso et al.
5,098,519 A 3/1992 Ramasubramanian et al.
5,103,874 A 4/1992 Lee
5,114,777 A 5/1992 Gaisser
5,129,988 A 7/1992 Farrington, Jr.
5,138,002 A 8/1992 Bjorkquist
5,167,261 A 12/1992 Lee
5,182,164 A 1/1993 Eklund et al.
5,199,261 A 4/1993 Baker
5,199,467 A 4/1993 Lee
5,211,815 A 5/1993 Ramasubramanian et al.
5,217,576 A 6/1993 Van Phan
5,219,004 A 6/1993 Chiu
5,223,096 A 6/1993 Phan et al.
5,225,269 A 7/1993 Bohlin
5,240,562 A 8/1993 Phan et al.
5,245,025 A 9/1993 Trokhan et al.
5,262,007 A 11/1993 Phan et al.
5,264,082 A 11/1993 Phan et al.
5,277,761 A 1/1994 Van Phan et al.
5,312,522 A 5/1994 Van Phan et al.
5,314,584 A 5/1994 Grinnell et al.
5,328,565 A 7/1994 Rasch et al.
5,336,373 A 8/1994 Scattolino et al.
5,348,620 A 9/1994 Hermans et al.
5,366,785 A 11/1994 Sawdai
5,368,696 A 11/1994 Cunnane, III et al.
5,372,876 A 12/1994 Johnson et al.
5,379,808 A 1/1995 Chiu
5,411,636 A 5/1995 Hermans et al.
5,415,737 A 5/1995 Phan et al.
5,449,026 A 9/1995 Lee
5,492,598 A 2/1996 Hermans et al.
5,494,554 A 2/1996 Edwards et al.
5,501,768 A 3/1996 Hermans et al.
5,503,715 A 4/1996 Trokhan et al.
5,505,818 A 4/1996 Hermans et al.
5,508,818 A 4/1996 Hamma
5,510,001 A 4/1996 Hermans et al.
5,510,002 A 4/1996 Hermans et al.
5,549,790 A 8/1996 Van Phan
5,556,509 A 9/1996 Trokhan et al.
5,593,545 A 1/1997 Rugowski et al.
5,601,871 A 2/1997 Krzysik et al.
5,607,551 A 3/1997 Farrington, Jr. et al.
5,609,725 A 3/1997 Van Phan
5,614,293 A 3/1997 Krzysik et al.
5,618,612 A 4/1997 Gstrein
H0001672 H 8/1997 Hermans et al.
5,656,132 A 8/1997 Farrington, Jr. et al.
5,657,797 A 8/1997 Townley et al.
5,667,636 A 9/1997 Engel et al.
5,672,248 A 9/1997 Wendt et al.
5,672,284 A 9/1997 Devanathan et al.
5,674,590 A 10/1997 Anderson et al.
5,690,149 A 11/1997 Lee
5,695,607 A 12/1997 Oriaran et al.
5,725,734 A 3/1998 Herman et al.
5,746,887 A 5/1998 Wendt et al.
5,772,845 A 6/1998 Farrington, Jr. et al.
5,814,190 A 9/1998 Van Phan
5,830,321 A 11/1998 Lindsay et al.
5,840,403 A 11/1998 Trokhan et al.
5,851,353 A 12/1998 Fiscus et al.
5,888,347 A 3/1999 Engel et al.
5,932,068 A 8/1999 Farrington, Jr. et al.
5,935,381 A 8/1999 Trokhan et al.
5,935,681 A 8/1999 Paulett
6,017,417 A 1/2000 Wendt et al.
6,080,279 A 6/2000 Hada et al.
6,083,346 A 7/2000 Hermans et al.
6,093,284 A 7/2000 Hada et al.
6,096,169 A 8/2000 Hermans et al.
6,117,525 A 9/2000 Trokhan et al.
6,136,146 A 10/2000 Phan et al.
6,139,686 A 10/2000 Trokhan et al.
6,143,135 A 11/2000 Hada et al.

| | | | | |
|---|---|---|---|---|
| 6,146,499 | A | 11/2000 | Lin et al. | |
| 6,149,767 | A | 11/2000 | Hermans et al. | |
| 6,149,769 | A | 11/2000 | Mohammadi et al. | |
| 6,162,327 | A | 12/2000 | Batra et al. | |
| 6,171,442 | B1 | 1/2001 | Farrington, Jr. et al. | |
| 6,187,137 | B1 | 2/2001 | Druecke et al. | |
| 6,197,154 | B1 | 3/2001 | Chen et al. | |
| 6,210,528 | B1 | 4/2001 | Wolkowicz | |
| 6,228,220 | B1 | 5/2001 | Hada et al. | |
| 6,261,679 | B1 | 7/2001 | Chen et al. | |
| 6,280,573 | B1 | 8/2001 | Lindsay et al. | |
| 6,287,426 | B1 | 9/2001 | Edwards et al. | |
| 6,306,257 | B1 | 10/2001 | Hada et al. | |
| 6,306,258 | B1 | 10/2001 | Lange et al. | |
| 6,318,727 | B1 | 11/2001 | Hada | |
| 6,331,230 | B1 | 12/2001 | Hermans et al. | |
| 6,350,349 | B1 | 2/2002 | Hermans et al. | |
| 6,398,916 | B1 | 6/2002 | Klerelid | |
| 6,420,013 | B1 | 7/2002 | Vinson et al. | |
| 6,432,267 | B1 | 8/2002 | Watson | |
| 6,432,270 | B1 | 8/2002 | Liu et al. | |
| 6,436,234 | B1 | 8/2002 | Chen et al. | |
| 6,447,640 | B1 | 9/2002 | Watson et al. | |
| 6,447,641 | B1 | 9/2002 | Wolkowicz et al. | |
| 6,454,904 | B1 | 9/2002 | Hermans et al. | |
| 6,461,474 | B1 | 10/2002 | Lindsay et al. | |
| 6,464,829 | B1 | 10/2002 | Chen et al. | |
| 6,478,927 | B1 | 11/2002 | Chen et al. | |
| 6,497,789 | B1 | 12/2002 | Hermans et al. | |
| 6,534,151 | B2 | 3/2003 | Merker | |
| 6,547,924 | B2 | 4/2003 | Klerelid et al. | |
| 6,551,461 | B2 | 4/2003 | Leitner et al. | |
| 6,565,707 | B2 | 5/2003 | Behnke et al. | |
| 6,579,418 | B2 | 6/2003 | Lindsay et al. | |
| 6,585,855 | B2 | 7/2003 | Drew et al. | |
| 6,607,638 | B2 | 8/2003 | Drew et al. | |
| 6,610,173 | B1 | 8/2003 | Lindsay et al. | |
| 6,701,637 | B2 | 3/2004 | Lindsay et al. | |
| 6,752,907 | B2 | 6/2004 | Edwards et al. | |
| 6,797,115 | B2 | 9/2004 | Klerelid et al. | |
| 6,827,819 | B2 | 12/2004 | Dwiggins et al. | |
| 6,958,103 | B2 | 10/2005 | Anderson et al. | |
| 6,998,022 | B2 | 2/2006 | Hultcrantz | |
| 7,022,201 | B2 | 4/2006 | Anderson et al. | |
| 7,070,678 | B2 | 7/2006 | Allen et al. | |
| 7,160,418 | B2 | 1/2007 | Edwards et al. | |
| 7,399,378 | B2 | 7/2008 | Edwards et al. | |
| 7,416,637 | B2 | 8/2008 | Murray et al. | |
| 7,442,278 | B2 | 10/2008 | Murray et al. | |
| 7,494,563 | B2 | 2/2009 | Edwards et al. | |
| 7,503,998 | B2 | 3/2009 | Murray et al. | |
| 7,585,388 | B2 | 9/2009 | Yeh et al. | |
| 7,585,389 | B2 | 9/2009 | Yeh et al. | |
| 7,585,392 | B2 | 9/2009 | Kokko et al. | |
| 7,588,660 | B2 | 9/2009 | Edwards et al. | |
| 7,591,925 | B2 | 9/2009 | Scherb et al. | |
| 7,608,164 | B2 | 10/2009 | Chou et al. | |
| 7,651,589 | B2 | 1/2010 | Murray et al. | |
| 7,662,255 | B2 | 2/2010 | Murray et al. | |
| 7,662,257 | B2 | 2/2010 | Edwards et al. | |
| 7,670,457 | B2 | 3/2010 | Murray et al. | |
| 7,691,228 | B2 | 4/2010 | Edwards et al. | |
| 7,718,036 | B2 | 5/2010 | Sumnicht et al. | |
| 7,789,995 | B2 | 9/2010 | Super et al. | |
| 7,820,008 | B2 | 10/2010 | Edwards et al. | |
| 7,828,931 | B2 | 11/2010 | Edwards et al. | |
| 7,850,823 | B2 | 12/2010 | Chou et al. | |
| 7,918,964 | B2 | 4/2011 | Edwards et al. | |
| 7,927,456 | B2 | 4/2011 | Murray et al. | |
| 7,951,264 | B2 | 5/2011 | Sumnicht | |
| 7,985,321 | B2 | 7/2011 | Sumnicht et al. | |
| 8,080,130 | B2 * | 12/2011 | Harper et al. | 162/123 |
| 8,142,612 | B2 | 3/2012 | Murray et al. | |
| 8,152,957 | B2 | 4/2012 | Edwards et al. | |
| 8,152,958 | B2 | 4/2012 | Super et al. | |
| 8,226,797 | B2 * | 7/2012 | Murray et al. | 162/111 |
| 8,328,985 | B2 | 12/2012 | Edwards et al. | |
| 8,394,236 | B2 | 3/2013 | Edwards et al. | |
| 8,398,818 | B2 | 3/2013 | Edwards et al. | |
| 8,398,820 | B2 | 3/2013 | Edwards et al. | |
| 2002/0062936 | A1 | 5/2002 | Klerelid et al. | |
| 2002/0088577 | A1 | 7/2002 | Watson et al. | |
| 2002/0134520 | A1 | 9/2002 | Behnke et al. | |
| 2002/0148584 | A1 | 10/2002 | Edwards et al. | |
| 2003/0000664 | A1 | 1/2003 | Drew et al. | |
| 2003/0098134 | A1 | 5/2003 | Scherb et al. | |
| 2003/0102098 | A1 | 6/2003 | Allen et al. | |
| 2003/0111195 | A1 | 6/2003 | Hu | |
| 2003/0121626 | A1 | 7/2003 | Hultzcrantz | |
| 2004/0226673 | A1 | 11/2004 | Edwards et al. | |
| 2004/0238135 | A1 | 12/2004 | Edwards et al. | |
| 2005/0217814 | A1 | 10/2005 | Super et al. | |
| 2005/0241786 | A1 | 11/2005 | Edwards et al. | |
| 2005/0241787 | A1 | 11/2005 | Murray et al. | |
| 2005/0279471 | A1 | 12/2005 | Murray et al. | |
| 2006/0000567 | A1 | 1/2006 | Murray et al. | |
| 2006/0237154 | A1 | 10/2006 | Edwards et al. | |
| 2006/0289133 | A1 | 12/2006 | Yeh et al. | |
| 2006/0289134 | A1 | 12/2006 | Yeh et al. | |
| 2007/0062656 | A1 | 3/2007 | Murray et al. | |
| 2007/0107863 | A1 | 5/2007 | Edwards et al. | |
| 2007/0137807 | A1 | 6/2007 | Schulz et al. | |
| 2007/0204966 | A1 | 9/2007 | Chou et al. | |
| 2008/0008860 | A1 | 1/2008 | Murray et al. | |
| 2008/0029235 | A1 | 2/2008 | Edwards et al. | |
| 2008/0047675 | A1 | 2/2008 | Murray et al. | |
| 2008/0083519 | A1 | 4/2008 | Kokko et al. | |
| 2008/0173419 | A1 | 7/2008 | Sumnicht | |
| 2009/0020139 | A1 | 1/2009 | Sumnicht et al. | |
| 2009/0020248 | A1 | 1/2009 | Sumnicht et al. | |
| 2009/0038768 | A1 | 2/2009 | Murray et al. | |
| 2009/0120598 | A1 | 5/2009 | Edwards et al. | |
| 2009/0126884 | A1 | 5/2009 | Murray et al. | |
| 2009/0159223 | A1 | 6/2009 | Edwards et al. | |
| 2009/0194244 | A1 | 8/2009 | Harper et al. | |
| 2009/0301675 | A1 | 12/2009 | Edwards et al. | |
| 2010/0126682 | A1 | 5/2010 | Murray et al. | |
| 2010/0186913 | A1 | 7/2010 | Super et al. | |
| 2010/0282423 | A1 | 11/2010 | Super et al. | |
| 2011/0155337 | A1 * | 6/2011 | Murray et al. | 162/111 |
| 2011/0265965 | A1 | 11/2011 | Sumnicht et al. | |
| 2012/0145341 | A1 * | 6/2012 | Super et al. | 162/111 |
| 2012/0145342 | A1 | 6/2012 | Edwards et al. | |
| 2012/0145343 | A1 * | 6/2012 | Edwards et al. | 162/111 |
| 2012/0152474 | A1 | 6/2012 | Murray et al. | |
| 2012/0152475 | A1 | 6/2012 | Edwards et al. | |
| 2012/0160434 | A1 | 6/2012 | Murray et al. | |
| 2012/0160435 | A1 | 6/2012 | Edwards et al. | |
| 2012/0164407 | A1 | 6/2012 | Edwards et al. | |
| 2012/0180965 | A1 * | 7/2012 | Super et al. | 162/111 |
| 2012/0180966 | A1 | 7/2012 | Super et al. | |
| 2012/0180967 | A1 | 7/2012 | Edwards et al. | |
| 2012/0199300 | A1 | 8/2012 | Edwards et al. | |
| 2012/0211186 | A1 * | 8/2012 | Murray et al. | 162/111 |
| 2012/0211187 | A1 * | 8/2012 | Murray et al. | 162/111 |
| 2012/0216972 | A1 * | 8/2012 | Murray et al. | 162/111 |
| 2012/0241113 | A1 * | 9/2012 | Super et al. | 162/111 |
| 2012/0247698 | A1 * | 10/2012 | Murray et al. | 162/111 |

FOREIGN PATENT DOCUMENTS

| | | | |
|---|---|---|---|
| EP | 0399522 | A2 | 11/1990 |
| GB | 2319537 | A | 5/1998 |
| JP | 8003890 | A | 1/1996 |
| RU | 2143508 | C1 | 12/1999 |
| RU | 2226231 | C1 | 3/2004 |
| WO | 96/06223 | A1 | 2/1996 |
| WO | 97/36046 | A1 | 10/1997 |
| WO | 00/14330 | A1 | 3/2000 |
| WO | 00/36212 | A2 | 6/2000 |
| WO | 2004/033793 | A2 | 4/2004 |
| WO | 2005/103375 | A1 | 11/2005 |
| WO | 2005/106117 | A1 | 11/2005 |
| WO | 2006/113025 | A2 | 10/2006 |
| WO | 2007/001837 | A2 | 1/2007 |
| WO | 2007/139726 | A1 | 12/2007 |

(56) References Cited

FOREIGN PATENT DOCUMENTS

OTHER PUBLICATIONS

Westfelt, Lars, "Chemistry of Paper Wet-Strength. I. A Survey of Mechanisms of Wet Strength Development," in Cellulose Chemistry and Technology, V. 13, pp. 813-825, 1979.

Evans, W. P., "Cationic fabric softeners," Chemistry and Industry, Jul. 5, 1969, pp. 893-903.

Egan, R. R., "Cationic Surface Active Agents as Fabric Softeners," J. Am. Oil Chemist's Soc., V. 55 (1978), pp. 118-121.

Trivedi, B. C., et al., "Quaternization of Imidazoline: Unequivocal Structure Proof," J. Am. Oil Chemist's Soc., Jun. 1981, pp. 754-756.

Parker, J. D., "Chapter 2 Practical Applications," in The Sheet Forming Process, STAP No. 9, 1972, pp. 63-93.

* cited by examiner

FABRIC CREPED

FABRIC CREPED AND DRAWN

CAN DRIED FABRIC CREPED

Salt
Salt
Salt

CAN DRIED FABRIC CREPE PRODUCT

CAN DRIED AND YANKEE DRIED DATA

FABRIC COMPARISONS

METHOD OF MAKING A FABRIC-CREPED ABSORBENT CELLULOSIC SHEET

CLAIM FOR PRIORITY AND TECHNICAL FIELD

This application is a continuation of U.S. patent application Ser. No. 13/041,706, filed on Mar. 7, 2011, now U.S Pat. No.8,226,797, which is a continuation of U.S. patent application Ser. No. 12/657,645, entitled "Absorbent Sheet", filed on Jan. 25, 2010, U.S. Patent Application Publication No. 2010/0126682, now U.S. Pat. No. 7,927,456. U.S. patent application Ser. No. 12/657,645 is a continuation of U.S. patent application Ser. No. 11/901,673, entitled "Absorbent Sheet", filed on Sep. 18, 2007, now U.S. Pat. No. 7,662,255. U.S. patent application Ser. No. 11/901,673 is a divisional of U.S. patent application Ser. No. 11/108,458, entitled "Fabric Crepe and In Fabric Drying Process for Producing Absorbent Sheet", filed on Apr. 18, 2005, now U.S. Pat. No. 7,442,278, which claims priority to U.S. Provisional Patent Application No. 60/563,519, filed on Apr. 19, 2004. The priorities of the foregoing applications are claimed. U.S. patent application Ser. No. 11/108,458 was also a continuation-in-part of U.S. patent application Ser. No. 10/679,682 entitled "Fabric Crepe Process for Making Absorbent Sheet", filed on Oct. 6, 2003, now U.S. Pat. No. 7,399,378, the priority of which is also claimed. Further, this application claims the benefit of the filing date of U.S. Provisional Patent Application No. 60/416,666, filed Oct. 7, 2002. The disclosures of the foregoing applications are incorporated herein by reference in their entireties. This application is directed, in part, to a process wherein a web is compactively dewatered, creped into a creping fabric and dried in situ in that fabric. In particular, this invention provides a method of making a fabric-creped absorbent cellulosic sheet. The method includes (a) compactively dewatering a papermaking furnish to form a nascent web having a random distribution of papermaking fiber, (b) applying the nascent web having the random fiber distribution to a translating transfer surface that is moving at a transfer surface speed, (c) fabric-creping the nascent web from the transfer surface at a consistency of from about 30 to about 60 percent utilizing a creping fabric, the fabric-creping step occurring under pressure in a fabric creping nip defined between the transfer surface and the creping fabric, wherein the fabric is traveling at a fabric speed that is slower than the speed of the transfer surface, such that the nascent web is creped from the transfer surface and redistributed on the creping fabric to form a creped web with a drawable reticulum having a plurality of interconnected regions of different local basis weights including at least (i) a plurality of fiber-enriched regions of a high local basis weight, interconnected by way of (ii) a plurality of lower local basis weight linking regions, (d) drying the creped web to form a dried web, and (e) drawing the dried web, wherein the drawing step comprises drawing the dried web between a first draw roll and a second draw roll.

BACKGROUND

Methods of making paper tissue, towel, and the like, are well known, including using various features such as Yankee drying, through-air drying, fabric creping, dry creping, wet creping, and so forth. Conventional wet pressing (CWP) processes have certain advantages over conventional through-air drying processes including: (1) lower energy costs associated with the mechanical removal of water than transpiration drying with hot air and (2) higher production speeds that are more readily achieved with processes that utilize wet pressing to form a web. On the other hand, through-air drying processing has been adopted for new capital investment, particularly, for the production of soft, bulky, premium quality tissue and towel products.

Fabric-creping has been employed in connection with papermaking processes that include mechanical or compactive dewatering of a paper web as a means to influence product properties. See U.S. Pat. Nos. 4,689,119, and 4,551,199 of Weldon; Nos. 4,849,054 and 4,834,838 of Klowak; and No. 6,287,426 of Edwards et al. While, in many respects, these processes have more potential than conventional papermaking processes in terms of energy consumption and the ability to use recycle fiber, operation of fabric-creping processes has been hampered by the difficulty of effectively transferring a web of high or intermediate consistency to a dryer. Note also, U.S. Pat. No. 6,350,349 to Hermans et al., which discloses wet transfer of a web from a rotating transfer surface to a fabric. Further United States patents more generally relating to fabric-creping include the following: U.S. Pat. Nos. 4,834,838; 4,482,429; 4,448,638, as well as No. 4,440,597 to Wells et al.

In connection with papermaking processes, fabric molding has also been employed as a means to provide texture and bulk. In this respect, there is seen, in U.S. Pat. No. 6,610,173 to Lindsay et al., a method for imprinting a paper web during a wet pressing event that results in asymmetrical protrusions corresponding to the deflection conduits of a deflection member. The '173 patent reports that a differential velocity transfer during a pressing event serves to improve the molding and imprinting of a web with a deflection member. The tissue webs produced are reported as having particular sets of physical and geometrical properties, such as a pattern densified network and a repeating pattern of protrusions having asymmetrical structures. With respect to wet-molding of a web using textured fabrics, see, also, the following United States patents: U.S. Pat. Nos. 6,017,417 and 5,672,248 both to Wendt et al.; Nos. 5,508,818 and 5,510,002 to Hermans et al. and No. 4,637,859 to Trokhan. With respect to the use of fabrics used to impart texture to a mostly dry sheet, see U.S. Pat. No. 6,585,855 to Drew et al., as well as United States Patent Application Publication No. 2003/0000664, now U.S. Pat. No. 6,607,638.

Through-air dried, creped products are disclosed in the following patents: U.S. Pat. No. 3,994,771 to Morgan, Jr. et al.; U.S. Pat. No. 4,102,737 to Morton; and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric, and creping the product from the Yankee dryer. A relatively permeable web is typically required, making it difficult to employ recycle furnish at levels that may be desired. Transfer to the Yankee dryer typically takes place at web consistencies of from about 60% to about 70%.

As noted in the above, through-air dried products tend to exhibit enhanced bulk and softness. Thermal dewatering with hot air, however, tends to be energy intensive. Wet-press operations wherein the webs are mechanically dewatered are preferable from an energy perspective and are more readily applied to furnishes containing recycle fiber, which tends to form webs with less permeability than virgin fiber. Many improvements relate to increasing the bulk and absorbency of compactively dewatered products that are typically dewatered, in part, with a papermaking felt.

U.S. Pat. No. 5,851,353 to Fiscus et al. teaches a method for can drying wet webs for tissue products wherein a partially dewatered wet web is restrained between a pair of molding fabrics. The restrained wet web is processed over a plurality of can dryers, for example, from a consistency of about 40 percent to a consistency of at least about 70 percent. The sheet molding fabrics protect the web from direct contact with the can dryers and impart an impression on the web. See also U.S. Pat. No. 5,336,373 to Scattolino et al.

Despite advances in the art, existing wet press processes have not produced highly absorbent webs with preferred physical properties, especially, elevated cross machine direction (CD) stretch at a relatively low machine direction to cross machine direction (MD/CD) tensile ratios as are sought after for use in premium tissue and towel products.

In accordance with the present invention, the absorbency, bulk and stretch of a wet-pressed web can be vastly improved by wet fabric creping a web and rearranging the fiber on a creping fabric, while preserving the high speed, thermal efficiency, and furnish tolerance to recycle fiber of conventional wet press processes. The inventive process has the further advantage that existing equipment and facilities can readily be modified to practice the inventive process, using, for example, can dryers that are particularly amenable to recycle energy sources and/or lower grade, less expensive fuels that may be available.

SUMMARY OF THE INVENTION

Fabric-creped products of the present invention typically include fiber-enriched regions of a relatively elevated basis weight linked together with regions of lower basis weight. Especially preferred products have a drawable reticulum that is capable of expanding, that is, increasing in void volume and bulk when drawn to a greater length. This highly unusual and surprising property is further appreciated by considering the photomicrographs of FIGS. 1 through 6 and the physical property data of FIGS. 7 through 12, as well as the other data discussed in the Detailed Description section hereafter.

A photomicrograph of the fiber-enriched region of an undrawn, fabric-creped web is shown in FIG. 1, which is taken in section along the MD (left to right in the photo). It is seen that the web has microfolds transverse to the machine direction, i.e., the ridges or creases extend in the CD (into the photograph). FIG. 2 is a photomicrograph of a web similar to that shown in FIG. 1, wherein the web has been drawn by 45%. Here, it is seen that the microfolds have been expanded, dispersing fiber from the fiber-enriched regions along the machine direction.

Without intending to be bound by any theory, it is believed that this feature of the invention, rearrangement or unfolding of the material in the fiber-enriched regions, gives rise to the unique macroscopic properties exhibited by the material.

There is thus provided in accordance with the present invention, a method of making a fabric-creped absorbent cellulosic sheet. The method includes (a) compactively dewatering a papermaking furnish to form a nascent web having a random distribution of papermaking fiber, (b) applying the nascent web having the random fiber distribution to a translating transfer surface that is moving at a transfer surface speed, (c) fabric-creping the nascent web from the transfer surface at a consistency of from about 30 to about 60 percent utilizing a creping fabric, the fabric-creping step occurring under pressure in a fabric creping nip defined between the transfer surface and the creping fabric, wherein the fabric is traveling at a fabric speed that is slower than the speed of the transfer surface, such that the nascent web is creped from the transfer surface and redistributed on the creping fabric to form a creped web with a drawable reticulum having a plurality of interconnected regions of different local basis weights including at least (i) a plurality of fiber-enriched regions of a high local basis weight, interconnected by way of (ii) a plurality of lower local basis weight linking regions, (d) drying the creped web to form a dried web, and (e) drawing the dried web, wherein the drawing step comprises drawing the dried web between a first draw roll and a second draw roll.

The web may be drawn at least about 10%, 15%, 30% or 45% after fabric-creping. Typically, the web is drawn up to about 75% after fabric-creping.

The inventive process may be operated at a fabric crepe of from about 10% to about 300% and a crepe recovery of from about 10% to about 100%.

Crepe recovery may be at least about 20%, at least about 30%, at least about 40%, at least about 50%, at least about 60%, at least about 80% or at least about 100%. Likewise, fabric crepe may be at least about 40%, at least about 60% or at least about 80% or more.

The method preferably includes drawing the web until it achieves a void volume of at least about 6 gm/gm. Drawing the web until it achieves a void volume of at least about 7 gm/gm, 8 gm/gm, 9 gm/gm, 10 gm/gm or more might be desirable in some embodiments. Preferred methods include drawing the dried web to increase its void volume by at least about 5%, at least about 10%, at least about 25%, at least about 50% or more.

Typically, the inventive method of making a fabric-creped absorbent cellulosic sheet includes drawing the web to preferentially attenuate the fiber-enriched regions of the web, which generally include fibers with an orientation that is biased in the CD. The fiber enriched region most preferably have a plurality of microfolds with fold lines extending transverse to the machine direction, such that drawing the web in the machine direction expands the microfolds. Surprisingly, drawing the web increases its bulk and reduces the sidedness of the web. The step of drawing the web is especially effective to reduce the TMI friction value of the fabric side of the web.

Another aspect of the invention includes a method of making a fabric-creped absorbent cellulosic sheet that includes compactively dewatering a papermaking furnish to form a nascent web having an apparently random distribution of papermaking fiber, applying the dewatered web having the apparently random fiber distribution to a translating transfer surface that is moving at a first speed, fabric-creping the web from the transfer surface at a consistency of from about 30 to about 60 percent, the creping step occurring under pressure in a fabric creping nip defined between the transfer surface and the creping fabric, wherein the fabric is traveling at a second speed that is slower than the speed of the transfer surface. The fabric pattern, nip parameters, velocity delta and web consistency are selected such that the web is creped from the transfer surface and redistributed on the creping fabric to form a web with a drawable reticulum having a plurality of interconnected regions of different local basis weights including at least (i) a plurality of fiber-enriched regions of a high local basis weight, interconnected by way of (ii) a plurality of local lower basis weight linking regions. The process further includes drying the web and drawing the web, wherein the drawable reticulum of the web is characterized in that it comprises a cohesive fiber matrix that exhibits increased bulk upon drawing. The method preferably includes drawing the dried web to increase the bulk of the web by at least about 5% or 10%.

Another method of making a fabric-creped absorbent cellulosic sheet according to the invention includes compactively dewatering a papermaking furnish to form a nascent web having an apparently random distribution of papermaking fiber, applying the dewatered web having the apparently random fiber distribution to a translating transfer surface that is moving at a first speed, and fabric-creping the web from the transfer surface at a consistency of from about 30 to about 60 percent, the creping step occurring under pressure in a fabric creping nip defined between the transfer surface and the creping fabric, wherein the fabric is traveling at a second speed that is slower than the speed of the transfer surface. The fabric pattern, nip parameters, velocity delta and web consistency are selected such that the web is creped from the transfer surface and redistributed on the creping fabric to form a web with a drawable reticulum having a plurality of interconnected regions of different local basis weights including at least (i) a plurality of fiber-enriched regions of a high local basis weight, interconnected by way of (ii) a plurality of lower local basis weight linking regions. The process further includes drying the web, and drawing the web, wherein the step of drawing the dried web is effective to decrease the sidedness of the web. Drawing the web may decrease the sidedness of the web by at least about 10%, at least about 20% or at least about 40% or more.

Still yet another aspect of the invention is a method of making a fabric creped absorbent cellulosic sheet that includes the steps of compactively dewatering a papermaking furnish to form a nascent web having an apparently random distribution of papermaking fiber, applying the dewatered web having the apparently random fiber distribution to a translating transfer surface that is moving at a first speed, and fabric-creping the web from the transfer surface at a consistency of from about 30 to about 60 percent, the creping step occurring under pressure in a fabric creping nip defined between the transfer surface and the creping fabric, wherein the fabric is traveling at a second speed that is slower than the speed of the transfer surface. The fabric pattern, nip parameters, velocity delta and web consistency are selected such that the web is creped from the transfer surface and redistributed on the creping fabric to form a web with a drawable reticulum having a plurality of interconnected regions of different local basis weights including at least (i) a plurality of fiber-enriched regions of a high local basis weight, interconnected by way of (ii) a plurality of lower local basis weight linking regions. The process further includes drying the web, and drawing the web, wherein the step of drawing the web is effective to preferentially attenuate the fiber-enriched regions of the web.

In still yet another aspect, the present invention provides a method of making a fabric-creped absorbent cellulosic sheet that includes compactively dewatering a papermaking furnish to form a nascent web having an apparently random distribution of papermaking fiber, applying the dewatered web having the apparently random fiber distribution to a translating transfer surface that is moving at a first speed, and fabric-creping the web from the transfer surface at a consistency of from about 30 to about 60 percent, the creping step occurring under pressure in a fabric creping nip defined between the transfer surface and the creping fabric, wherein the fabric is traveling at a second speed that is slower than the speed of the transfer surface. The fabric pattern, nip parameters, velocity delta and web consistency are selected such that the web is creped from the transfer surface and redistributed on the creping fabric to form a web with a drawable reticulum having a plurality of interconnected regions of different local basis weights including at least (i) a plurality of fiber-enriched regions of high local basis weight, interconnected by way of (ii) a plurality of lower local basis weight linking regions. The process further includes drying the web, and drawing the web, wherein the web has a stretch at break of at least 20% prior to drawing. Preferably, the web so produced has a stretch at break of at least 30% or 45% prior to drawing. In some preferred embodiments, the web has a stretch at break of at least 60% prior to drawing.

A yet further method of making a cellulosic web in accordance with the present invention includes forming a nascent web from a papermaking furnish, the nascent web having a generally random distribution of papermaking fiber, transferring the web having the generally random distribution of papermaking fiber to a translating transfer surface that is moving at a first speed, drying the web to a consistency of from about 30 to about 60 percent, including compactively dewatering the web prior to or concurrently with transfer to the transfer surface, and fabric-creping the web from the transfer surface at a consistency of from about 30 to about 60 percent utilizing a creping fabric with a patterned creping surface, the fabric creping step occurring under pressure in a fabric creping nip defined between the transfer surface and the creping fabric, wherein the fabric is traveling at a second speed that is slower than the speed of the transfer surface. The fabric pattern, nip parameters, velocity delta and web consistency are selected such that the web is creped from the transfer surface and redistributed on the creping fabric such that the web has a plurality of fiber-enriched regions arranged in a pattern corresponding to the patterned creping surface of the fabric. The process further includes retaining the wet web in the creping fabric, drying the wet web while it is held in the creping fabric to a consistency of at least about 90 percent, and drawing the dried web, the step of drawing the dried web being effective to increase the void volume thereof. In some cases, the web is dried with a plurality of can dryers while it is held in the creping fabric, while in other cases, the web is dried with an impingement-air dryer while it is held in the creping fabric.

In a preferred embodiment, the web is drawn on-line, perhaps, most preferably, in incremental amounts in a plurality of steps, wherein the web is only partially drawn out in each step. The web may be drawn between a first roll operated at a machine direction velocity greater than the creping fabric velocity and a second roll operated at a machine direction velocity greater than the first roll or between a pair of nip rollers, for example, or a nip and a roll operating at different speeds, if so desired. Likewise, the dried web may be calendered on-line.

Another method of the invention of making a fabric-creped absorbent cellulosic sheet comprises compactively dewatering a papermaking furnish to form a nascent web having an apparently random distribution of papermaking fiber, applying the dewatered web having the apparently random fiber distribution to a translating transfer surface that is moving at a first speed, and fabric-creping the web from the transfer surface at a consistency of from about 30 to about 60 percent, the creping step occurring under pressure in a fabric creping nip defined between the transfer surface and the creping fabric, wherein the fabric creping nip defined between the transfer surface and the creping fabric, wherein the fabric is traveling at a second speed that is slower than the speed of the transfer surface. The fabric pattern, nip parameters, velocity delta and web consistency are selected such that the web is creped from the transfer surface and redistributed on the creping fabric to form a web with a drawable reticulum having a plurality of interconnected regions of different local basis weights including at least (i) a plurality of fiber-enriched regions of a high local basis weight, interconnected by way of (ii) a plurality of lower local basis weight linking regions. The process further includes drying the web, and drawing the web, wherein the web is can-dried in a two-tier can drying section such that both the fabric side of the web and the opposite side of the web contact the surface of at least one dryer can. Two-tier can drying sections are illustrated schematically in FIGS. 31 and 33.

A cellulosic absorbent sheet of the invention may be made by way of preparing a cellulosic web from an aqueous papermaking furnish, the web being provided with a plurality of fiber-enriched regions with a drawable reticulum having a relatively high local basis weight interconnected by way of a plurality of lower basis weight linking regions, the reticulum being further characterized in that it comprises a cohesive fiber matrix capable of an increase in void volume upon drawing, drying the web while substantially preserving the drawable fiber reticulum and, thereafter, drawing the web. In connection with this method, the web may be dried to a consistency of at least about 90% or 92% prior to drawing. Drawing the web increases bulk and void volume. Drawing, however, decreases sidedness. The results are both highly desirable and unexpected. Superior results are achieved with furnish comprising secondary fiber.

A particularly unusual feature of the invention is that drawing the web decreases the caliper of the web less than its basis weight. Generally, the ratio of percent decrease in caliper/percent decrease in basis weight of the web is less than one upon drawing the web, typically, the ratio of percent decrease in caliper/percent decrease in basis weight of the web is less than about 0.85 upon drawing the web, and, preferably, the ratio of percent decrease in caliper/percent decrease in basis weight of the web is less than about 0.7 upon drawing the web. In an especially preferred embodiment, the ratio of percent decrease in caliper/percent decrease in basis weight of the web is less than about 0.6 upon drawing the web.

Further aspects of the inventive process are preparing a cellulosic web with a drawable reticulum provided with a plurality of microfolds with fold lines transverse to the machine direction, drying the web by way of contacting the web with a dryer surface wherein the drawable reticulum of the web is substantially preserved and wherein the dried web is characterized in that the microfolds may be expanded by drawing the web, whereby the void volume of the web is increased. The web may be provided to a single-tier or two-tier can-drying section at a consistency of less than about 70% and dried to a consistency of greater than about 90% in the single-tier drying section.

Methods of making cellulosic absorbent sheet of the invention include preparing a cellulosic web from an aqueous papermaking furnish, the web being provided with an expanded reticulum having relatively high local basis weight fiber enriched regions interconnected by way of a plurality of lower basis weight linking regions, drying the web while substantially preserving the expandable fiber reticulum, and expanding the dried web to increase its void volume. The fiber enriched regions typically have fiber bias in the CD and the linking regions typically have fiber bias along a direction between fiber enriched regions. The dried web may be expanded to increase its void volume by at least about 1 g/g, at least about 2 g/g, or at least about 3 g/g.

Products of the invention include an absorbent cellulosic web comprising a plurality of fiber-enriched regions of a relatively high local basis weight interconnected by a plurality of lower local basis weight regions, characterized in that drawing the web increases the void volume thereof. In many cases, the product is capable of an increase in void volume of up to about 25%, 35%, 50% or more upon drawing. In one preferred embodiment, drawing the web by 30% increases the void volume by at least about 5% and, in another, dry-drawing the web by 45% increases the void volume by at least about 20%.

Another product of the invention is an absorbent cellulosic web comprising a plurality of fiber-enriched regions of a relatively high local basis weight interconnected by a plurality of lower local basis weight regions, characterized in that drawing the web increases the bulk thereof. Typically, drawing the web by 30% increases the bulk thereof by at least about 5% and drawing the web by 45% increases the bulk thereof by at least about 10%.

Yet other products are absorbent cellulosic webs comprising a plurality of fiber-enriched regions of a relatively high local basis weight interconnected by a plurality of lower local basis weight regions, characterized in that drawing the web is effective to decrease the sidedness thereof and, preferentially, to attenuate the fiber enriched regions. The absorbent cellulosic web products may incorporate secondary fiber, sometimes, at least 50% or over 50% by weight secondary fiber.

As noted above, the products have the unusual and surprising feature that the caliper of the web decreases more slowly than the basis weight upon drawing the web, such as wherein the ratio of percent decrease in caliper/percent decrease in basis weight of the web is less than about 0.85 upon drawing the web. Preferably, the ratio of percent decrease in caliper/percent decrease in basis weight of the web is less than about 0.7 upon drawing the web. In some especially preferred products, the ratio of percent decrease in caliper/percent decrease in basis weight of the web is less than about 0.6 upon drawing the web. Generally, the web products of the invention have a basis weight of from about 5 to about 30 lbs per 3000 square foot ream.

Another unique aspect of products of the invention is that they include recovered creped material as a portion of the product matrix. Typically, the web has a recovered crepe of at least about 10%. A recovered crepe of at least about 25%, at least about 50%, or at least about 100% is desirable in some products.

The invention provides an absorbent cellulosic web with an expandable reticulum of fiber enriched, relatively high basis weight regions interconnected by way of lower basis weight linking regions, characterized in that the void volume of the web may be increased by expanding the fiber enriched regions. In preferred embodiments, the fiber enriched regions have a fiber bias in the CD and the linking regions have a fiber bias along a direction between fiber enriched regions and the fiber enriched regions are provided with a plurality of microfolds with fold lines transverse to the machine direction (MD). The absorbent cellulosic web may be expanded to increase its void volume from the as-dried condition (or with respect to a like web that is unexpanded) by at least about 1 g/g, at least about 2 g/g, at least about 3 g/g or more.

Still yet other features and advantages of the invention will become apparent from the following description and appended Figures.

BRIEF DESCRIPTION OF THE DRAWINGS

The invention is described in detail below with reference to the drawings, wherein like numerals designate similar parts.

DETAILED DESCRIPTION

Figure 1:
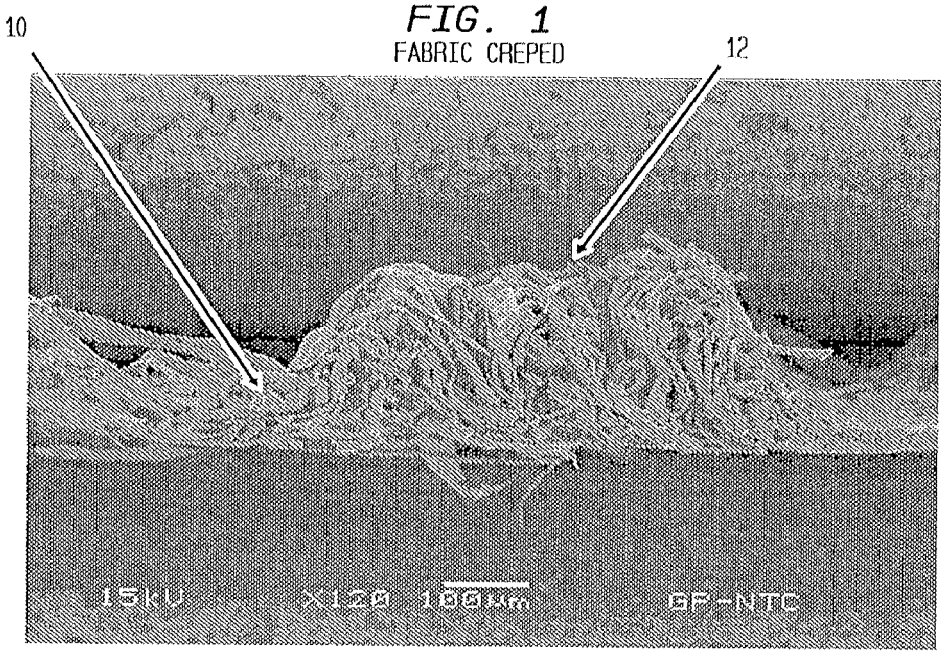
FIG. 1 is a photomicrograph (120×) in section along the machine direction of a fiber-enriched region of a fabric-creped sheet that has not been drawn subsequent to fabric creping.

The invention is described in detail below with reference to several embodiments and numerous examples. Such a discussion is for purposes of illustration only. Modifications to particular examples within the spirit and scope of the present invention, set forth in the appended claims, will be readily apparent to one of skill in the art.

Terminology used herein is given its ordinary meaning consistent with the exemplary definitions set forth immediately below.

Throughout this specification and claims, when we refer to a nascent web having an apparently random distribution of fiber orientation (or use like terminology), we are referring to the distribution of fiber orientation that results when known forming techniques are used for depositing a furnish on the forming fabric. When examined microscopically, the fibers give the appearance of being randomly oriented even though, depending on the jet to wire speed, there may be a significant bias toward machine direction orientation making the machine direction (MD) tensile strength of the web exceed the cross-machine direction (CD) tensile strength.

Unless otherwise specified, "basis weight", BWT, bwt, and so forth, refers to the weight of a 3000 square foot ream of product. Consistency refers to percent solids of a nascent web, for example, calculated on a bone dry basis. "Air dry" means including residual moisture, by convention, up to about 10 percent moisture for pulp and up to about 6% for paper. A nascent web having 50 percent water and 50 percent bone dry pulp has a consistency of 50 percent.

The term "cellulosic", "cellulosic sheet", and the like, is meant to include any product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood kraft fibers; hardwood fibers, such as eucalyptus, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached if desired by chemical means including the use of chlorine, chlorine dioxide, oxygen, alkaline peroxide, and so forth. The products of the present invention may comprise a blend of conventional fibers (whether derived from virgin pulp or recycle sources) and high coarseness lignin-rich tubular fibers, such as bleached chemical thermomechanical pulp (BCTMP). "Furnishes" and like terminology refers to aqueous compositions including papermaking fibers, optionally, wet strength resins, debonders, and the like, for making paper products.

"Can drying" refers to drying a web by contacting a web with a dryer drum while not adhering the web to the dryer surface, typically, while the web is also in contact with a fabric. In a single-tier system, only one side of the web contacts the drums, while in a conventional two-tier system, both sides of the web contact dryer surfaces as will be appreciated from FIGS. 32 and 33, discussed hereafter.

As used herein, the term "compactively dewatering" the web or furnish refers to mechanical dewatering by wet pressing on a dewatering felt, for example, in some embodiments, by use of mechanical pressure applied continuously over the web surface as in a nip between a press roll and a press shoe wherein the web is in contact with a papermaking felt. The terminology "compactively dewatering" is used to distinguish processes wherein the initial dewatering of the web is carried out largely by thermal means as is the case, for example, in U.S. Pat. No. 4,529,480 to Trokhan and U.S. Pat. No. 5,607,551 to Farrington et al., noted above. Compactively dewatering a web thus refers, for example, to removing water from a nascent web having a consistency of less than 30 percent or so by application of pressure thereto and/or increasing the consistency of the web by about 15 percent or more by application of pressure thereto.

Creping fabric and like terminology refers to a fabric or belt that bears a pattern suitable for practicing the process of the present invention and, preferably, is permeable enough such that the web may be dried while it is held in the creping fabric. In cases where the web is transferred to another fabric or surface (other than the creping fabric) for drying, the creping fabric may have a lower permeability.

"Fabric side" and like terminology refers to the side of the web that is in contact with the creping and drying fabric. "Dryer side" or "can side" is the side of the web opposite to the fabric side of the web.

Fpm refers to feet per minute while consistency refers to the weight percent fiber of the web.

MD means machine direction and CD means cross-machine direction.

Nip parameters include, without limitation, nip pressure, nip length, backing roll hardness, fabric approach angle, fabric takeaway angle, uniformity, and velocity delta between surfaces of the nip.

Nip length means the length over which the nip surfaces are in contact.

The drawable reticulum is "substantially preserved" when the web is capable of exhibiting a void volume increase upon drawing.

"On line" and like terminology refers to a process step performed without removing the web from the papermachine in which the web is produced. A web is drawn or calendered on line when it is drawn or calendered without being severed prior to wind-up.

A translating transfer surface refers to the surface from which the web is creped into the creping fabric. The translating transfer surface may be the surface of a rotating drum as described hereafter, or may be the surface of a continuous smooth moving belt or another moving fabric that may have a surface texture, and so forth. The translating transfer surface needs to support the web and facilitate the high solids creping as will be appreciated from the discussion that follows.

Calipers and/or bulk reported herein may be measured using 1, 4 or 8 sheet calipers as specified. The sheets are stacked and the caliper measurement taken about the central portion of the stack. Preferably, the test samples are conditioned in an atmosphere of 23°±1.0° C. (73.4°±1.8° F.) at 50% relative humidity for at least about two hours and then measured with a Thwing-Albert Model 89-II-JR or Progage Electronic Thickness Tester with 2-in (50.8-mm) diameter anvils, 539±10 grams dead weight load, and 0.231 in./sec descent rate. For finished product testing, each sheet of product to be tested must have the same number of plies as that of the product that is sold. For testing, in general, eight sheets are selected and stacked together. For napkin testing, napkins are unfolded prior to stacking. For basesheet testing off of winders, each sheet to be tested must have the same number of plies as produced off the winder. For basesheet testing off of the papermachine reel, single plies must be used. Sheets are stacked together aligned in the MD. On custom embossed or printed product, avoid measurements in these areas if at all possible. Bulk may also be expressed in units of volume/weight by dividing caliper by basis weight.

Absorbency of the inventive products is measured with a simple absorbency tester. The simple absorbency tester is a particularly useful apparatus for measuring the hydrophilicity and absorbency properties of a sample of tissue, napkins, or towel. In this test a sample of tissue, napkins, or towel 2.0 inches in diameter is mounted between a top flat plastic cover and a bottom grooved sample plate. The tissue, napkin, or towel sample disc is held in place by a ⅛ inch wide circumference flange area. The sample is not compressed by the holder. De-ionized water at 73° F. is introduced to the sample at the center of the bottom sample plate through a 1 mm. diameter conduit. This water is at a hydrostatic head of minus 5 mm. Flow is initiated by a pulse introduced at the start of the measurement by the instrument mechanism. Water is thus imbibed by the tissue, napkin, or towel sample from this central entrance point radially outward by capillary action. When the rate of water imbibation decreases below 0.005 gm water per 5 seconds, the test is terminated. The amount of water removed from the reservoir and absorbed by the sample is weighed and reported as grams of water per square meter of sample or grams of water per gram of sheet. In practice, an M/K Systems Inc. Gravimetric Absorbency Testing System is used. This is a commercial system obtainable from M/K Systems Inc., 12 Garden Street, Danvers, Mass., 01923. WAC or water absorbent capacity, also referred to as SAT, is actually determined by the instrument itself. WAC is defined as the point where the weight versus time graph has a "zero" slope, i.e., the sample has stopped absorbing. The termination criteria for a test are expressed in maximum change in water weight absorbed over a fixed time period. This is basically an estimate of zero slope on the weight versus time graph. The program uses a change of 0.005 g over a 5 second time interval as termination criteria; unless "Slow SAT" is specified, in which case, the cut off criteria is 1 mg in 20 seconds.

Dry tensile strengths (MD and CD), stretch, ratios thereof, modulus, break modulus, stress and strain are measured with a standard Instron test device or other suitable elongation tensile tester, which may be configured in various ways, typically, using 3 or 1 inch wide strips of tissue or towel, conditioned in an atmosphere of 23°±1° C. (73.4°±1° F.) at 50% relative humidity for two hours. The tensile test is run at a crosshead speed of 2 in/min. Modulus is expressed in lbs/inch per inch of elongation, unless otherwise indicated.

Tensile ratios are simply ratios of the values determined by way of the foregoing methods. Unless otherwise specified, a tensile property is a dry sheet property.

"Fabric crepe ratio" is an expression of the speed differential between the creping fabric and the forming wire, and is typically calculated as the ratio of the web speed immediately before fabric creping and the web speed immediately following fabric creping, the forming wire and transfer surface being typically, but not necessarily, operated at the same speed:

Fabric crepe ratio=transfer cylinder speed÷creping fabric speed.

Fabric crepe can also be expressed as a percentage calculated as:

Fabric crepe, percent,=[Fabric crepe ratio−1]×100%.

A web creped from a transfer cylinder with a surface speed of 750 fpm to a fabric with a velocity of 500 fpm has a fabric crepe ratio of 1.5 and a fabric crepe of 50%.

The draw ratio is calculated similarly, typically, as the ratio of winding speed to the creping fabric speed. Draw may be expressed as a percentage by subtracting one from the draw ratio and multiplying by 100%. The "pullout" or "draw" applied to a test specimen is calculated from the ratio of final length divided by its length prior to elongation. Unless otherwise specified, draw refers to elongation with respect to the length of the as-dried web. This quantity may also be expressed as a percentage. For example a 4" test specimen drawn to 5" has a draw ratio of 5/4 or 1.25 and a draw of 25%.

The total crepe ratio is calculated as the ratio of the forming wire speed to the reel speed and a % total crepe is:

Total Crepe %=[Total Crepe Ratio−1]×100%.

A process with a forming wire speed of 2000 fpm and a reel speed of 1000 fpm has a line or total crepe ratio of 2 and a total crepe of 100%.

The recovered crepe of a web is the amount of fabric crepe removed when the web is elongated or drawn. This quantity is calculated as follows and expressed as a percentage:

$$\text{Recovered Crepe } \% = \left[1 - \frac{\%\ TotalCrepe}{\%\ FabricCrepe}\right] \times 100.$$

A process with a total crepe of 25% and a fabric crepe of 50% has a recovered crepe of 50%.

Figure 31:
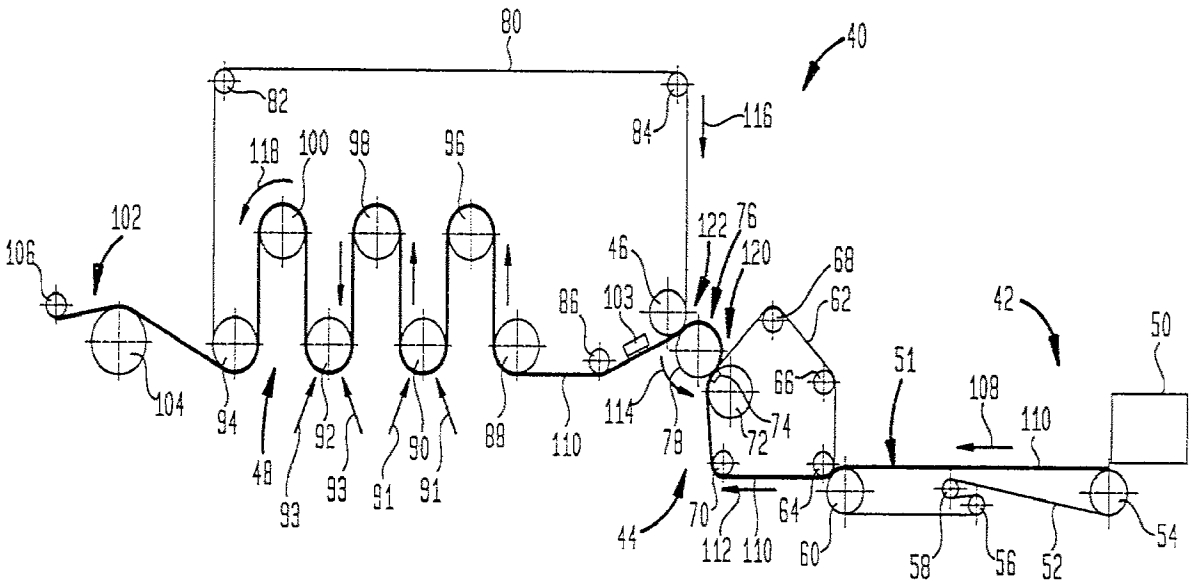
FIG. 31 is a schematic diagram of a papermachine for producing absorbent sheet in accordance with the present invention.

Recovered crepe is referred to as the crepe recovery when quantifying the amount of crepe and draw applied to a particular web. Sample calculations of the various quantities for a papermachine 40 of the type shown in FIG. 31 provided with a forming wire 52 a transfer cylinder 76, a creping fabric 80, as well as a take up reel 106, are given in Table 1 below. Recovered fabric crepe is a product attribute that relates to bulk and void volume, as is seen in the Figures and Examples below.

TABLE 1

Sample Calculations of Fabric Crepe, Draw and Recovered Crepe

| Wire fpm | Crepe Fabric fpm | Reel fpm | FCRatio | FabCrp % % | DrawRatio | Draw % % | TotalCrp Ratio | ToCrptPct % | RecCrp % |
|---|---|---|---|---|---|---|---|---|---|
| 1000 | 500 | 750 | 2.00 | 100% | 1.5 | 50% | 1.33 | 33% | 67% |
| 2000 | 1500 | 1600 | 1.33 | 33% | 1.067 | 6.7% | 1.25 | 25% | 25% |
| 2000 | 1500 | 2000 | 1.33 | 33% | 1.33 | 33% | 1.00 | 0% | 100% |
| 3000 | 1500 | 2625 | 2.00 | 100% | 1.75 | 75% | 1.14 | 14% | 86% |
| 3000 | 2000 | 2500 | 1.50 | 50% | 1.25 | 25% | 1.20 | 20% | 60% |

Friction values and sidedness are calculated by a modification to the TMI method discussed in U.S. Pat. No. 6,827,819 to Dwiggins et al. This modified method is described below. A percent change in friction value or sidedness upon drawing is based on the difference between the initial value without draw and the drawn value, divided by the initial value, and expressed as a percentage.

Sidedness and friction deviation measurements can be accomplished using a Lab Master Slip & Friction tester, with a special high-sensitivity load measuring option and custom top and sample support block, Model 32-90 available from:

Testing Machines Inc.
2910 Expressway Drive South
Islandia, N.Y. 11722
800-678-3221
www.testingmachines.com adapted to accept a Friction Sensor, available from:

Noriyuki Uezumi
Kato Tech Co., Ltd.
Kyoto Branch Office
Nihon-Seimei-Kyoto-Santetsu Bldg. 3F
Higashishiokoji-Agaru, Nishinotoin-Dori
Shimogyo-ku, Kyoto 600-8216
Japan
81-75-361-6360
katotech@mx1.alpha-web.ne.jp The software for the Lab Master Slip and Friction tester is modified to allow it: (1) to retrieve and to directly record instantaneous data on the force exerted on the friction sensor as it moves across the samples, (2) to compute an average for that data, (3) to calculate the deviation—absolute value of the difference between each of the instantaneous data points and the calculated mean, and (4) to calculate a mean deviation over the scan to be reported in grams.

Prior to testing, the test samples should be conditioned in an atmosphere of 23.0°±1° C. (73.4°±1.8° F.) and 50%±2% R.H. Testing should also be conducted at these conditions. The samples should be handled by edges and corners only and any touching of the area of the sample to be tested should be minimized as the samples are delicate, and physical properties may be easily changed by rough handling or transfer of oils from the hands of the tester.

The samples to be tested are prepared, using a paper cutter to get straight edges, as 3-inch wide (CD) by 5-inch long (MD) strips, any sheets with obvious imperfections being removed and replaced with acceptable sheets. These dimensions correspond to those of a standard tensile test, allowing the same specimen to be first elongated in the tensile tester, then tested for surface friction.

Each specimen is placed on the sample table of the tester and the edges of the specimen are aligned with the front edge of the sample table and the chucking device. A metal frame is placed on top of the specimen in the center of the sample table while ensuring that the specimen is flat beneath the frame by gently smoothing the outside edges of the sheet. The sensor is placed carefully on the specimen with the sensor arm in the middle of the sensor holder. Two MD-scans are run on each side of each specimen.

To compute the TMI Friction Value of a sample, two MD scans of the sensor head are run on each side of each sheet, where The Average Deviation value from the first MD scan of the fabric side of the sheet is recorded as $MD_{F1}$; the result obtained on the second scan on the fabric side of the sheet is recorded as $MD_{F2}$. $MD_{D1}$ and $MD_{D2}$ are the results of the scans run on the Dryer side (Can or Yankee side) of the sheet.

The TMI Friction Value for the fabric side is calculated as follows:

$$TMI_FV_F = \frac{MD_{F1} + MD_{F2}}{2}.$$

Likewise, the TMI Friction Value for the dryer side is calculated as:

$$TMI_FV_D = \frac{MD_{D1} + MD_{D2}}{2}.$$

An overall Sheet Friction Value can be calculated as the average of the fabric side and the dryer side, as follows:

$$TMI_FV_{AVG} = \frac{TMI_FV_F + TMI_FV_D}{2}.$$

Leading to Sidedness as an indication of how much the friction differs between the two sides of the sheet. The sidedness is defined as:

$$\text{Sidedness} = \frac{TMI_FV_U}{TMI_FV_L} * TMI_FV_{AVG}$$

here "U" and "L" subscripts refer to the upper and lower values of the friction deviation of the two sides (Fabric and Dryer)—that is, the larger Friction value is always placed in the numerator.

For fabric-creped products, the fabric side friction value will be higher than the dryer side friction value. Sidedness takes into account not only the relative difference between the two sides of the sheet, but the overall friction level. Accordingly, low sidedness values are normally preferred.

PLI or pli means pounds force per linear inch.

Pusey and Jones (P&J) hardness (indentation) is measured in accordance with ASTM D 531, and refers to the indentation number (standard specimen and conditions).

Velocity delta means a difference in linear speed.

The void volume and/or void volume ratio, as referred to hereafter, are determined by saturating a sheet with a nonpolar POROFIL® liquid and measuring the amount of liquid absorbed. The volume of liquid absorbed is equivalent to the void volume within the sheet structure. The percent weight increase (PWI) is expressed as grams of liquid absorbed per gram of fiber in the sheet structure times 100, as noted hereafter. More specifically, for each single-ply sheet sample to be tested, select 8 sheets and cut out a 1 inch by 1 inch square (1 inch in the machine direction and 1 inch in the cross-machine direction). For multi-ply product samples, each ply is measured as a separate entity. Multiple samples should be separated into individual single plies and 8 sheets from each ply position used for testing. To measure absorbency, weigh and record the dry weight of each test specimen to the nearest 0.0001 gram. Place the specimen in a dish containing POROFIL® liquid having a specific gravity of 1.875 grams per cubic centimeter, available from Coulter Electronics Ltd., Northwell Drive, Luton, Beds, England, Part No. 9902458. After 10 seconds, grasp the specimen at the very edge (1-2 Millimeters in) of one corner with tweezers and remove the specimen from the liquid. Hold the specimen with that corner uppermost and allow excess liquid to drip for 30 seconds. Lightly dab (less than ½ second contact) the lower corner of the specimen on #4 filter paper (Whatman Lt., Maidstone, England) in order to remove any excess of the last partial drop. Immediately weigh the specimen, within 10 seconds, recording the weight to the nearest 0.0001 gram. The PWI for each specimen, expressed as grams of POROFIL® liquid per gram of fiber, is calculated as follows:

$$PWI=[(W_2-W_1)/W_1]\times 100\%,$$

wherein

"W1" is the dry weight of the specimen, in grams; and

"W2" is the wet weight of the specimen, in grams.

The PWI for all eight individual specimens is determined as described above and the average of the eight specimens is the PWI for the sample.

The void volume ratio is calculated by dividing the PWI by 1.9 (density of fluid) to express the ratio as a percentage, whereas the void volume (gms/gm) is simply the weight increase ratio; that is, PWI divided by 100.

During fabric creping in a pressure nip, the fiber is redistributed on the fabric, making the process tolerant of less than ideal forming conditions, as are sometimes seen with a Fourdrinier former. The forming section of a Fourdrinier machine includes two major parts, the headbox and the Fourdrinier Table. The latter consists of the wire run over the various drainage-controlling devices. The actual forming occurs along the Fourdrinier Table. The hydrodynamic effects of drainage, oriented shear, and turbulence generated along the table are generally the controlling factors in the forming process. Of course, the headbox also has an important influence in the process, usually, on a scale that is much larger than the structural elements of the paper web. Thus, the headbox may cause such large-scale effects as variations in distribution of flow rates, velocities, and concentrations across the full width of the machine, vortex streaks generated ahead of and aligned in the machine direction by the accelerating flow in the approach to the slice, and time-varying surges or pulsations of flow to the headbox. The existence of MD-aligned vortices in headbox discharge is common. Fourdrinier formers are further described in *The Sheet Forming Process*, Parker, J. D., Ed., TAPPI Press (1972, reissued 1994), Atlanta, Ga.

According to the present invention, an absorbent paper web is made by dispersing papermaking fibers into aqueous furnish (slurry) and depositing the aqueous furnish onto the forming wire of a papermaking machine. Any suitable forming scheme might be used. For example, an extensive, but non-exhaustive, list in addition to Fourdrinier formers includes a crescent former, a C-wrap twin wire former, an S-wrap twin wire former, or a suction breast roll former. The forming fabric can be any suitable foraminous member including single layer fabrics, double layer fabrics, triple layer fabrics, photopolymer fabrics, and the like. Non-exhaustive background art in the forming fabric area includes U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025; 5,277,761; 5,328,565; and 5,379,808, all of which are incorporated herein by reference in their entirety. One forming fabric particularly useful with the present invention is Voith Fabrics Forming Fabric 2164 made by Voith Fabrics Corporation, Shreveport, La.

Foam-forming of the aqueous furnish on a forming wire or fabric may be employed as a means for controlling the permeability or void volume of the sheet upon fabric-creping. Foam-forming techniques are disclosed in U.S. Pat. No. 4,543,156 and Canadian Patent No. 2,053,505, the disclosures of which are incorporated herein by reference. The foamed fiber furnish is made up from an aqueous slurry of fibers mixed with a foamed liquid carrier just prior to its introduction to the headbox. The pulp slurry supplied to the system has a consistency in the range of from about 0.5 to about 7 weight percent of fibers, preferably, in the range of from about 2.5 to about 4.5 weight percent. The pulp slurry is added to a foamed liquid comprising water, air and a surfactant containing 50 to 80 percent of air by volume, forming a foamed fiber furnish having a consistency in the range of from about 0.1 to about 3 weight percent fiber by simple mixing from natural turbulence and mixing inherent in the process elements. The addition of the pulp as a low consistency slurry results in excess foamed liquid recovered from the forming wires. The excess foamed liquid is discharged from the system and may be used elsewhere or treated for recovery of surfactant therefrom.

The furnish may contain chemical additives to alter the physical properties of the paper produced. These chemistries are well understood by the skilled artisan and may be used in any known combination. Such additives may be surface modifiers, softeners, debonders, strength aids, latexes, opacifiers, optical brighteners, dyes, pigments, sizing agents, barrier chemicals, retention aids, insolubilizers, organic or inorganic crosslinkers, or combinations thereof, the chemicals optionally comprising polyols, starches, PPG esters, PEG esters, phospholipids, surfactants, polyamines, HMCP (Hydrophobically Modified Cationic Polymers), HMAP (Hydrophobically Modified Anionic Polymers), or the like.

The pulp can be mixed with strength adjusting agents, such as wet strength agents, dry strength agents and debonders/softeners, and so forth. Suitable wet strength agents are known to the skilled artisan. A comprehensive, but non-exhaustive, list of useful strength aids include urea-formaldehyde resins, melamine formaldehyde resins, glyoxylated polyacrylamide resins, polyamide-epichlorohydrin resins, and the like. Thermosetting polyacrylamides are produced by reacting acrylamide with diallyl dimethyl ammonium chloride (DADMAC) to produce a cationic polyacrylamide copolymer that is ultimately reacted with glyoxal to produce a cationic cross-linking wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference in their entirety. Resins of this type are commercially available under the trade name of PAREZ 631NC by Bayer Corporation. Different mole ratios of acrylamide/-DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin wet strength resins, an example of which is sold under the trade names Kymene 557LX and Kymene 557H by Hercules Incorporated of Wilmington, Del. and Amres® from Georgia-Pacific Resins, Inc. These resins and the processes for making the resins are described in U.S. Pat. No. 3,700,623 and U.S. Pat. No. 3,772,076, each of which is incorporated herein by reference in its entirety. An extensive description of polymeric-epihalohydrin resins is given in Chapter 2: *Alkaline-Curing Polymeric Amine-Epichlorohydrin* by Espy in *Wet Strength Resins and Their Application* (L. Chan, Editor, 1994), herein incorporated by reference in its entirety. A reasonably comprehensive list of wet strength resins is described by Westfelt in *Cellulose Chemistry and Technology*, Volume 13, p. 813, 1979, which is incorporated herein by reference.

Suitable temporary wet strength agents may likewise be included. A comprehensive, but non-exhaustive, list of useful temporary wet strength agents includes aliphatic and aromatic aldehydes including glyoxal, malonic dialdehyde, succinic dialdehyde, glutaraldehyde and dialdehyde starches, as well as substituted or reacted starches, disaccharides, polysaccharides, chitosan, or other reacted polymeric reaction products of monomers or polymers having aldehyde groups, and optionally, nitrogen groups. Representative nitrogen containing polymers, which can suitably be reacted with the aldehyde containing monomers or polymers, includes vinyl-amides, acrylamides and related nitrogen containing polymers. These polymers impart a positive charge to the aldehyde containing reaction product. In addition, other commercially available temporary wet strength agents, such as, PAREZ 745, manufactured by Bayer can be used, along with those disclosed, for example in U.S. Pat. No. 4,605,702.

The temporary wet strength resin may be any one of a variety of water-soluble organic polymers comprising aldehydic units and cationic units used to increase dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769 and 5,217,576. Modified starches sold under the trademarks CO-BOND® 1000 and CO-BOND® 1000 Plus, by National Starch and Chemical Company of Bridgewater, N.J., may be used. Prior to use, the cationic aldehydic water soluble polymer can be prepared by preheating an aqueous slurry of approximately 5% solids maintained at a temperature of approximately 240 degrees Fahrenheit and a pH of about 2.7 for approximately 3.5 minutes. Finally, the slurry can be quenched and diluted by adding water to produce a mixture of approximately 1.0% solids at less than about 130 degrees Fahrenheit.

Other temporary wet strength agents, also available from National Starch and Chemical Company are sold under the trademarks CO-BOND® 1600 and CO-BOND® 2300. These starches are supplied as aqueous colloidal dispersions and do not require preheating prior to use.

Temporary wet strength agents such as glyoxylated polyacrylamide can be used. Temporary wet strength agents such glyoxylated polyacrylamide resins are produced by reacting acrylamide with diallyl dimethyl ammonium chloride (DADMAC) to produce a cationic polyacrylamide copolymer, which is ultimately reacted with glyoxal to produce a cationic cross-linking temporary or semi-permanent wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference. Resins of this type are commercially available under the trade name of PAREZ 631NC, by Bayer Industries. Different mole ratios of acrylamide/DADMAC/glyoxal can be used to produce cross-linking resins, which are useful as wet strength agents. Furthermore, other dialdehydes can be substituted for glyoxal to produce wet strength characteristics.

Suitable dry strength agents include starch, guar gum, polyacrylamides, carboxymethyl cellulose, and the like. Of particular utility is carboxymethyl cellulose, an example of which is sold under the trade name Hercules CMC, by Hercules Incorporated of Wilmington, Del. According to one embodiment, the pulp may contain from about 0 to about 15 lb/ton of dry strength agent. According to another embodiment, the pulp may contain from about 1 to about 5 lbs/ton of dry strength agent.

Suitable debonders are likewise known to the skilled artisan. Debonders or softeners may also be incorporated into the pulp or sprayed upon the web after its formation. The present invention may also be used with softener materials including, but not limited to, the class of amido amine salts derived from partially acid neutralized amines. Such materials are disclosed in U.S. Pat. No. 4,720,383. Evans, *Chemistry and Industry,* 5 Jul. 1969, pp. 893-903; Egan, *J. Am. Oil Chemist's Soc., Vol.* 55 (1978), pp. 118-121; and Trivedi et al., *J. Am. Oil Chemist's Soc., June* 1981, pp. 754-756, incorporated by reference in their entirety, indicate that softeners are often available commercially only as complex mixtures rather than as single compounds. While the following discussion will focus on the predominant species, it should be understood that commercially available mixtures would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably, 6 to 7 and, most preferably, 6.5 to 7.

Quaternary ammonium compounds, such as dialkyl dimethyl quaternary ammonium salts are also suitable particularly when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

In some embodiments, a particularly preferred debonder composition includes a quaternary amine component, as well as a nonionic surfactant.

The nascent web is typically dewatered on a papermaking felt. Any suitable felt may be used. For example, felts can have double-layer base weaves, triple-layer base weaves, or laminated base weaves. Preferred felts are those having the laminated base weave design. A wet-press-felt which may be particularly useful with the present invention is Vector 3 made by Voith Fabric. Background art in the press felt area includes U.S. Pat. Nos. 5,657,797; 5,368,696; 4,973,512; 5,023,132; 5,225,269; 5,182,164; 5,372,876; and 5,618,612. A differential pressing felt as is disclosed in U.S. Pat. No. 4,533,437 to Curran et al. may likewise be utilized.

Suitable creping fabrics include single layer, multi-layer, or composite, preferably, open meshed structures. Fabrics may have at least one of the following characteristics: (1) on the side of the creping fabric that is in contact with the wet web (the "top" side), the number of machine direction (MD) strands per inch (mesh) is from 10 to 200 and the number of cross-machine direction (CD) strands per inch (count) is also from 10 to 200; (2) the strand diameter is typically smaller than 0.050 inch; (3) on the top side, the distance between the highest point of the MD knuckles and the highest point on the CD knuckles is from about 0.001 to about 0.02 or 0.03 inch; (4) in between these two levels can be knuckles formed either by MD or CD strands that give the topography a three-dimensional hill/valley appearance that is imparted to the sheet; (5) the fabric may be oriented in any suitable way so as to achieve the desired effect on processing and on properties in the product, the long warp knuckles may be on the top side to increase MD ridges in the product, or the long shute knuckles may be on the top side if more CD ridges are desired to influence creping characteristics as the web is transferred from the transfer cylinder to the creping fabric; and (6) the fabric may be made to show certain geometric patterns that are pleasing to the eye, which is typically repeated between every two to 50 warp yarns. Suitable commercially available coarse fabrics include a number of fabrics made by Voith Fabrics.

The creping fabric may thus be of the class described in U.S. Pat. No. 5,607,551 to Farrington et al, cols. 7-8 thereof, as well as the fabrics described in U.S. Pat. No. 4,239,065 to Trokhan and U.S. Pat. No. 3,974,025 to Ayers. Such fabrics may have about 20 to about 60 filaments per inch and are formed from monofilament polymeric fibers having diameters typically ranging from about 0.008 to about 0.025 inches. Both warp and weft monofilaments may, but need not necessarily be of the same diameter.

In some cases, the filaments are so woven and complementarily serpentinely configured in at least the Z-direction (the thickness of the fabric) to provide a first grouping or array of coplanar top-surface-plane crossovers of both sets of filaments, and a predetermined second grouping or array of sub-top-surface crossovers. The arrays are interspersed so that portions of the top-surface-plane crossovers define an array of wicker-basket-like cavities in the top surface of the fabric, which cavities are disposed in staggered relation in both the machine direction (MD) and the cross-machine direction (CD), and so that each cavity spans at least one sub-top-surface crossover. The cavities are discretely perimetrically enclosed in the plan view by a picket-like-lineament comprising portions of a plurality of the top-surface plane crossovers. The loop of fabric may comprise heat set monofilaments of thermoplastic material. The top surfaces of the coplanar top-surface-plane crossovers may be monoplanar flat surfaces. Specific embodiments of the invention include satin weaves as well as hybrid weaves of three or greater sheds, and mesh counts of from about 10×10 to about 120×120 filaments per inch (4×4 to about 47×47 per centimeter), although the preferred range of mesh counts is from about 18 by 16 to about 55 by 48 filaments per inch (9×8 to about 22×19 per centimeter).

Instead of an impression fabric, a dryer fabric may be used as the creping fabric if so desired. Suitable fabrics are described in U.S. Pat. Nos. 5,449,026 (woven style) and 5,690,149 (stacked MD tape yarn style) to Lee, as well as U.S. Pat. No. 4,490,925 to Smith (spiral style).

If a Fourdrinier former or other gap former is used, as is shown in FIG. 31, the nascent web may be conditioned with vacuum boxes and a steam shroud until it reaches a solids content suitable for transferring to a dewatering felt. The nascent web may be transferred with vacuum assistance to the felt. In a crescent former, the use of vacuum assist is unnecessary as the nascent web is formed between the forming fabric and the felt.

A preferred way of practicing the invention includes can-drying the web while it is in contact with the creping fabric, which also serves as the drying fabric. Can drying can be used alone or in combination with impingement air drying, the combination being especially convenient if a two tier drying section layout is available as hereafter described. Impingement air drying may also be used as the only means of drying the web as it is held in the fabric, if so desired, or either may be used in combination with can dryers. Suitable rotary impingement air drying equipment is described in U.S. Pat. No. 6,432,267 to Watson and U.S. Pat. No. 6,447,640 to Watson et al. Inasmuch as the process of the invention can readily be practiced on existing equipment with reasonable modifications, any existing flat dryers can be advantageously employed so as to conserve capital as well.

Alternatively, the web may be through-air dried after fabric creping as is well known in the art. Representative references include: U.S. Pat. No. 3,342,936 to Cole et al.; U.S. Pat. No. 3,994,771 to Morgan, Jr. et al.; U.S. Pat. No. 4,102,737 to Morton; and U.S. Pat. No. 4,529,480 to Trokhan.

Turning to the Figures, FIG. 1 shows a cross section (120×) along the MD of a fabric-creped, undrawn sheet 10 illustrating a fiber-enriched region 12. It will be appreciated that fibers of the fiber-enriched region 12 have an orientation biased in the CD, especially, at the right side of region 12, where the web contacts a knuckle of the creping fabric.

Figure 2:
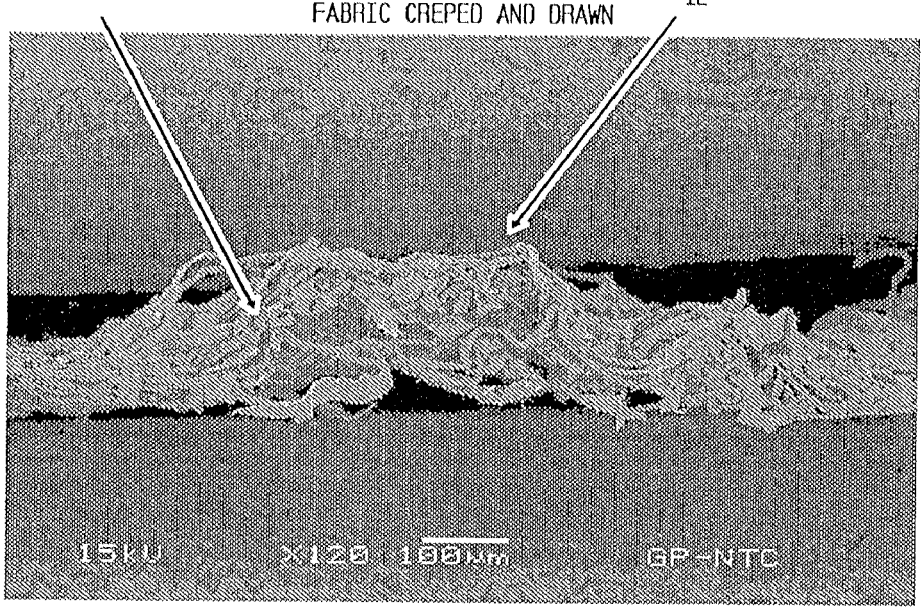
FIG. 2 is a photomicrograph (120×) in section along the machine direction of a fiber-enriched region of a fabric-creped sheet of the invention that has been drawn 45% subsequent to fabric creping.

FIG. 2 illustrates sheet 10 drawn 45% after fabric creping and drying. Here it is seen that regions 12 are attenuated or dispersed in the machine direction when the microfolds of regions 12 expand or unfold. The drawn web exhibits increased bulk and void volume with respect to an undrawn web. Structural and property changes are further appreciated by reference to FIGS. 3-12.

Figure 3:
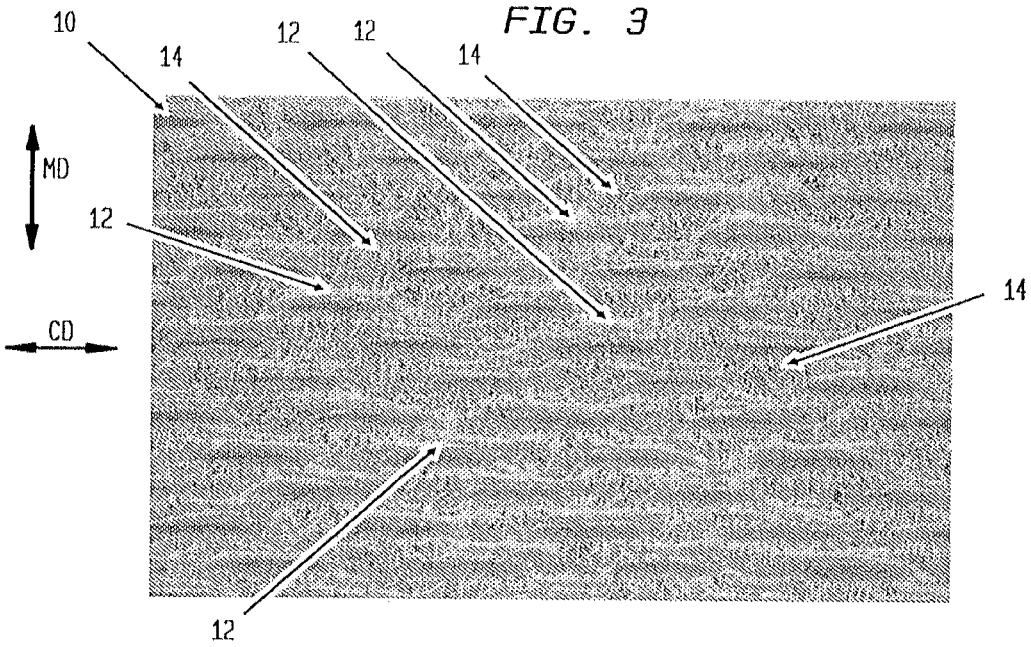
FIG. 3 is a photomicrograph (10×) of the fabric side of a fabric-creped web that was dried in the fabric.

FIG. 3 is a photomicrograph (10×) of the fabric side of a fabric-creped web of the invention, which was prepared without substantial subsequent draw of the web. It is seen in FIG. 3 that sheet 10 has a plurality of very pronounced high basis weight, fiber-enriched regions 12 having fiber with orientation biased in the cross-machine direction (CD) linked by relatively low basis weight regions 14. It is appreciated from the photographs that linking regions 14 have fiber orientation bias extending along a direction between fiber enriched regions 12. Moreover, it is seen that the fold lines or creases of the microfolds of fiber enriched regions 12 extend along the CD.

Figure 4:
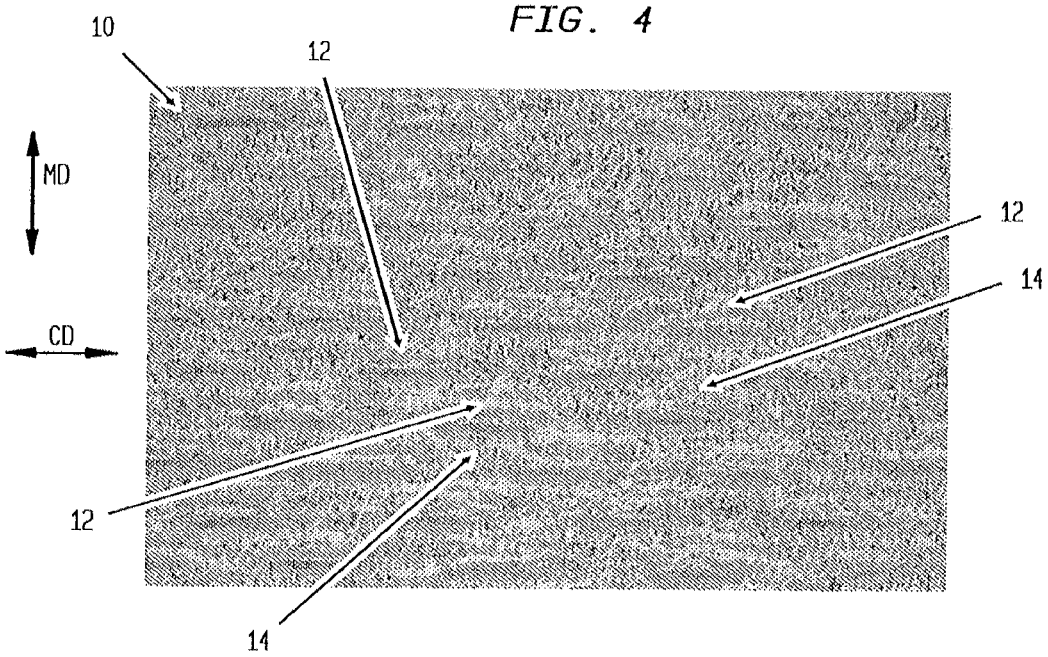
FIG. 4 is a photomicrograph (10×) of the fabric side of a fabric-creped web that was dried in-fabric then drawn 45%.

FIG. 4 is a photomicrograph (10×) of the fabric side of a fabric-creped web of the invention, which was fabric creped, dried and subsequently drawn 45%. It is seen in FIG. 4 that sheet 10 still has a plurality of relatively high basis weight regions 12 linked by lower basis regions 14. The fiber-enriched regions 12 are, however, much less pronounced after the web is drawn, as will be appreciated by comparing FIGS. 3 and 4.

Figure 5:
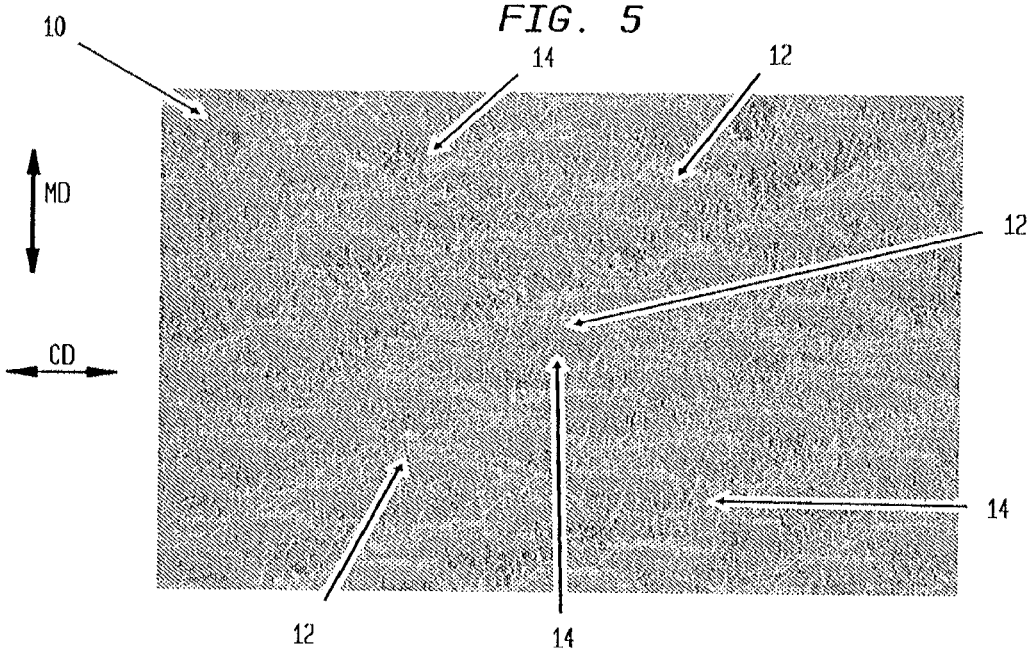
FIG. 5 is a photomicrograph (10×) of the dryer side of the web of FIG. 3.

FIG. 5 is a photomicrograph (10×) of the dryer side of the web of FIG. 3, that is, the side of the web opposite to the creping fabric. This web was fabric creped and dried without drawing. Here, there are seen fiber-enriched regions 12 of relatively high basis weights as well as lower basis weight regions 14 linking the fiber-enriched regions. These features are generally less pronounced on the dryer or "can" side of the web; except however, the attenuation or unfolding of the fiber-enriched regions is perhaps more readily observed on the dryer side of the web when the fabric-creped web 10 is drawn, as is seen in FIG. 6.

Figure 6:
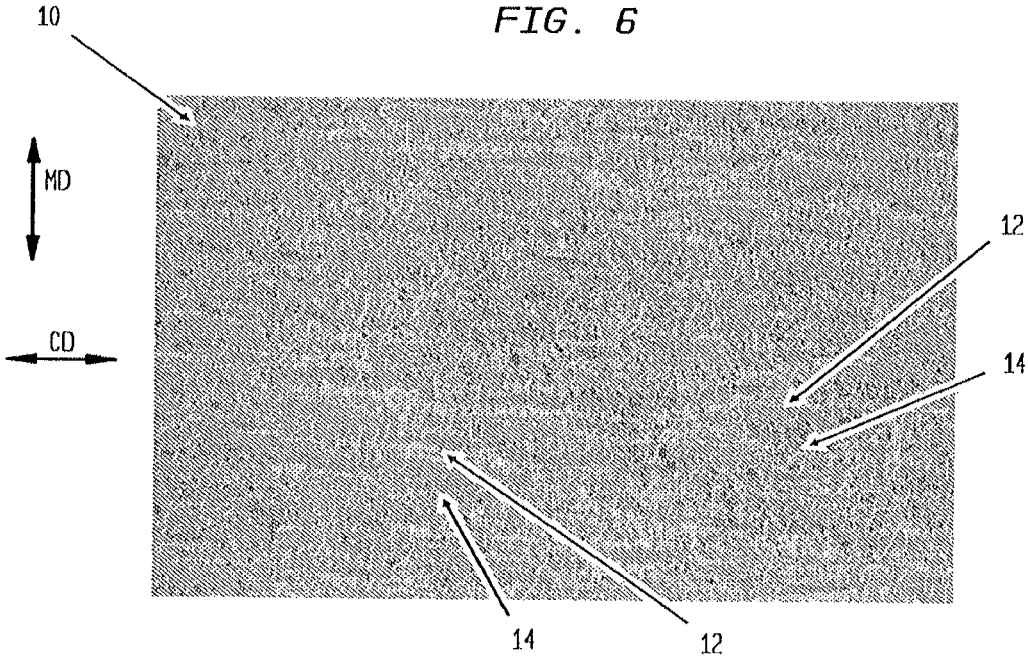
FIG. 6 is a photomicrograph (10×) of the dryer side of the web of FIG. 4.

FIG. 6 is a photomicrograph (10×) of the dryer side of a fabric-creped web 10 prepared in accordance with the invention, which was fabric creped, dried and subsequently drawn 45%. Here, it is seen that fiber-enriched high basis weight regions 12 "open" or unfold somewhat as they attenuate (as is also seen in FIGS. 1 and 2 at higher magnification). The lower basis weight regions 14 remain relatively intact as the web is drawn. In other words, the fiber-enriched regions are preferentially attenuated as the web is drawn. It is further seen in FIG. 6 that the relatively compressed fiber-enriched regions 12 have been expanded in the sheet.

Without intending to be bound by any theory, it is believed that fabric-creping the web as described herein produces a cohesive fiber reticulum having pronounced variation in local basis weight. The network can be substantially preserved while the web is dried, for example, such that dry-drawing the web will disperse or attenuate the fiber-enriched regions somewhat and increase the void volume of the web. This attribute of the invention is manifested in FIG. 6 by microfolds in the web at regions 12 opening upon drawing of the web to a greater length. In FIG. 5, corresponding regions 12 of the undrawn web remain closed.

FIGS. 7-12 likewise illustrate the features of the processes and products of the present invention.

Figure 7:
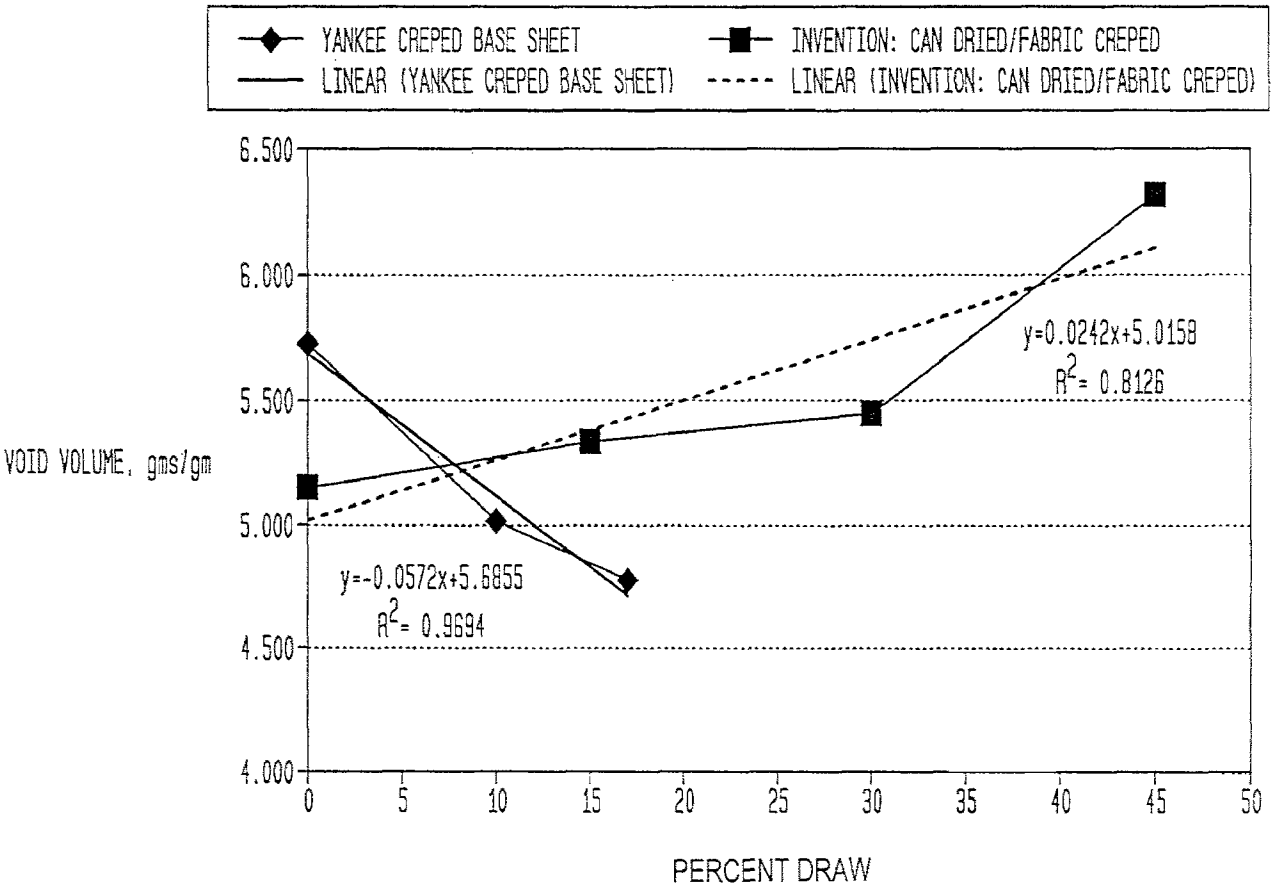
FIG. 7 is a plot of void volume versus draw for various absorbent products.

FIG. 7 is a plot of void volume versus percent draw for a fabric-creped can-dried (in-fabric dried) web and a like web that was fabric-creped, then applied with an adhesive to a Yankee dryer before being creped off. It is seen in FIG. 7 that the two webs exhibit very different behavior upon drawing. The web that was fabric-creped, applied to a Yankee with adhesive and creped with a creping blade from the Yankee exhibited a decrease of void volume upon drawing. On the other hand, the web that was fabric-creped and then retained in the fabric and can-dried exhibited a significant increase in void volume upon drawing.

Figure 8:
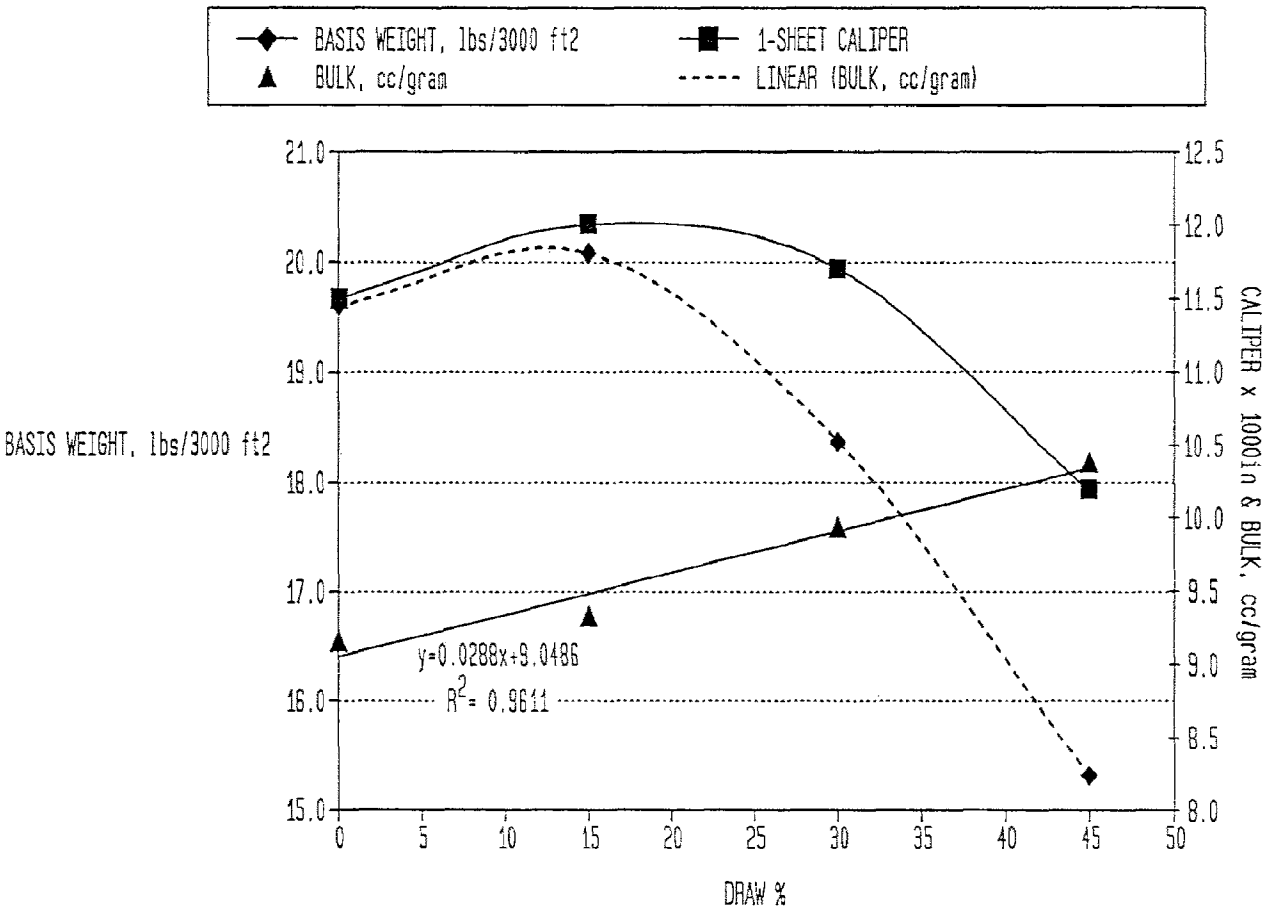
FIG. 8 is a plot of basis weight, caliper and bulk versus draw for a fabric-creped, can-dried web of the invention.

In FIG. 8, basis weight, caliper and bulk for a fabric-creped, can-dried web are plotted versus percent draw. Here, it is seen that basis weight decreases much more than caliper at higher draws, leading to an increase in bulk (caliper/basis weight). This data is consistent with FIG. 6, which shows attenuation of the fiber-enriched regions 12 as microfolds open.

Figure 9:
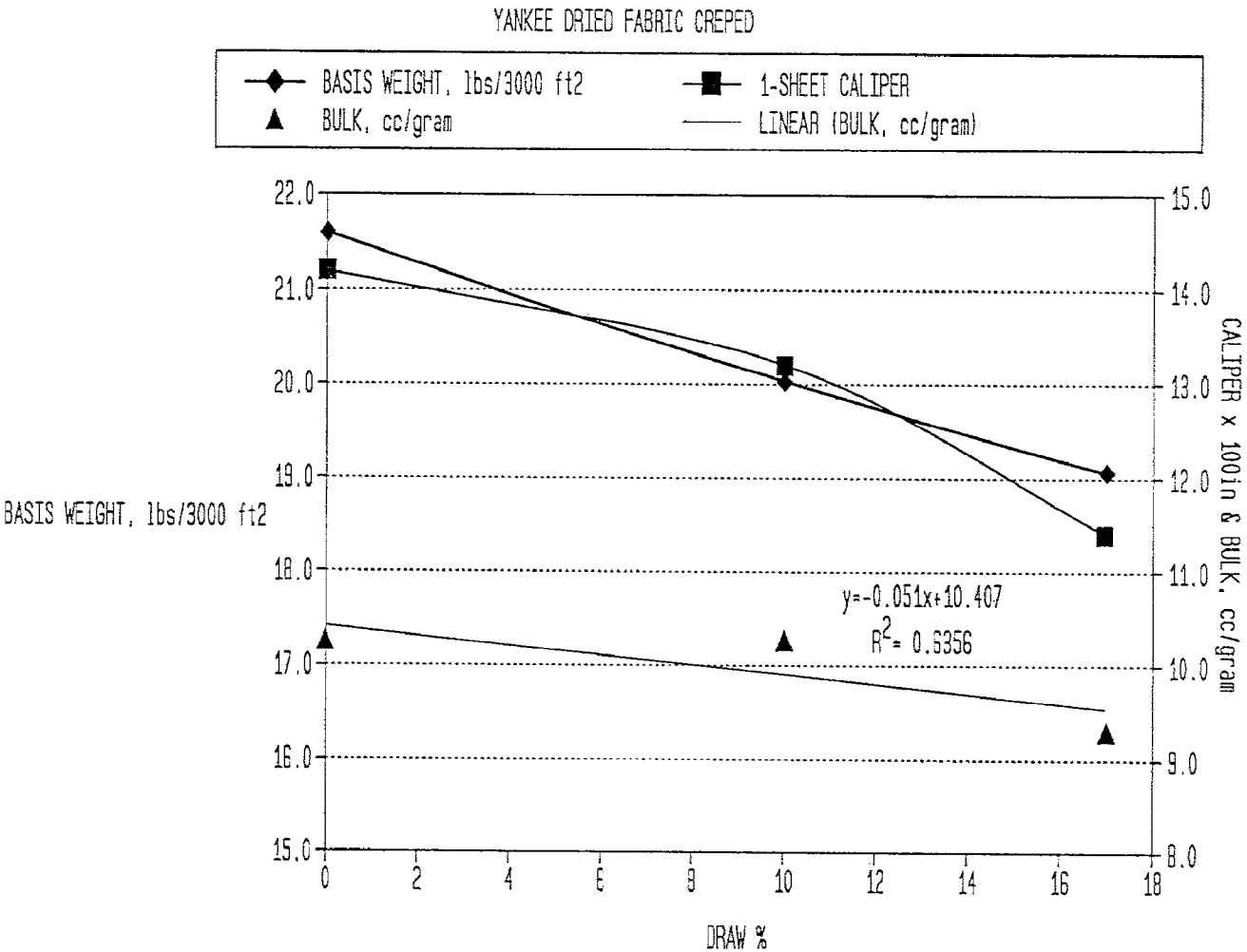
FIG. 9 is a plot of basis weight, caliper and bulk versus draw for a fabric-creped, Yankee-dried web.

FIG. 9 is a plot similar to that shown in FIG. 8 for a fabric-creped/Yankee dried and creped web, wherein it is seen that caliper and basis weight decrease at more or less the same rate upon drawing.

Figure 10:
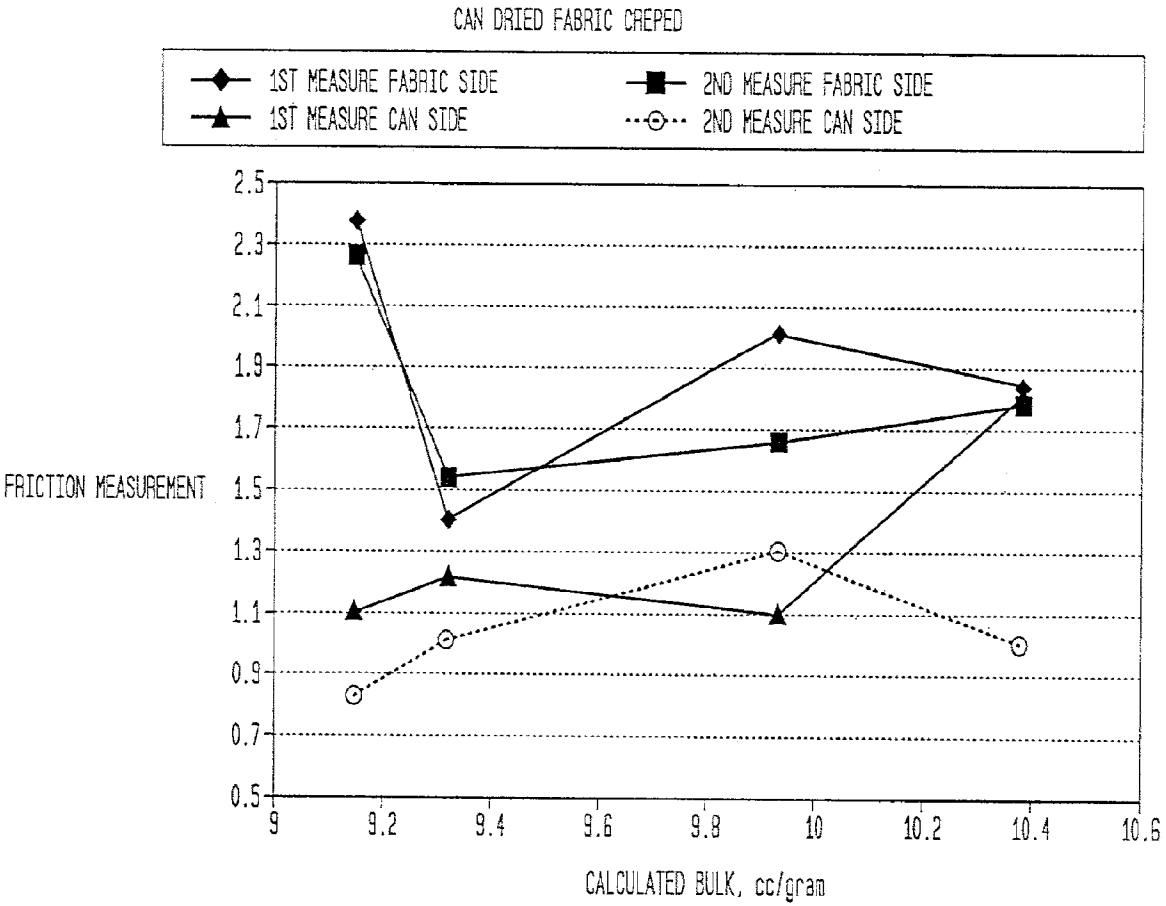
FIG. 10 is a plot of TMI Friction values versus bulk for fabric-creped, can-dried webs of the invention.
Figure 11:
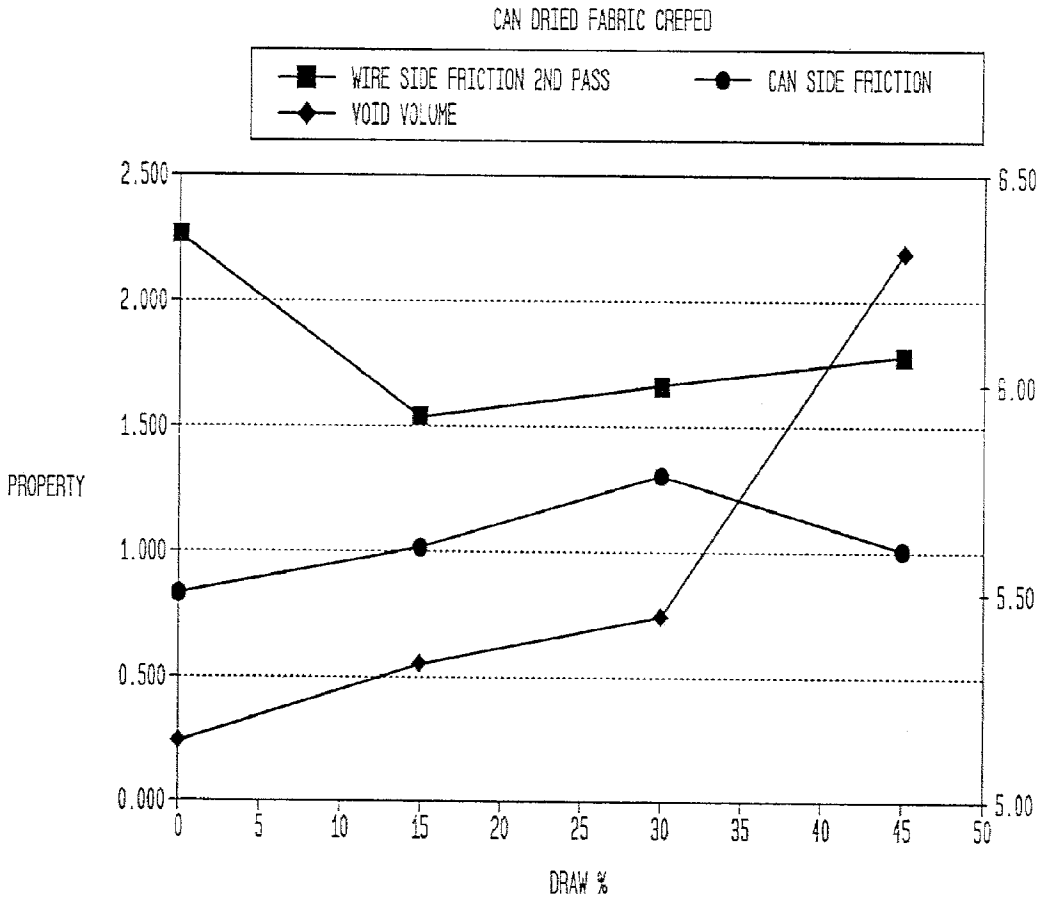
FIGS. 11 and 12 are plots of TMI Friction values and void volume versus percent draw for a fabric-creped, in-fabric dried web of the invention.
Figure 12:
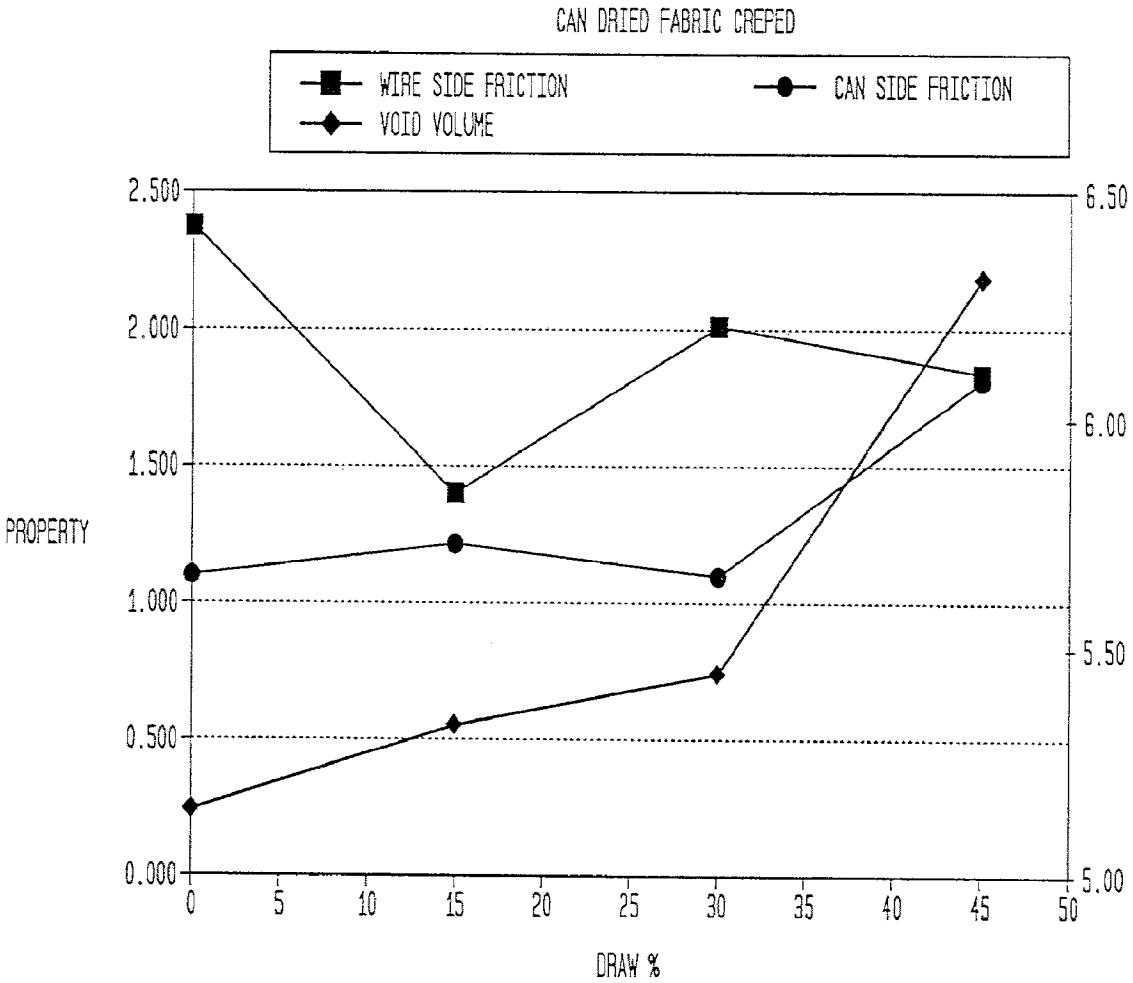

FIG. 10 is a plot of TMI Friction values versus bulk for various fabric-creped/can-dried samples, while FIGS. 11 and 12 show TMI Friction values and void volume versus percent draw. It will be appreciated from these Figures that sidedness of the web decreases upon drawing, largely due to the decrease in friction value of the fabric side of the web as it is drawn.

Figure 13:
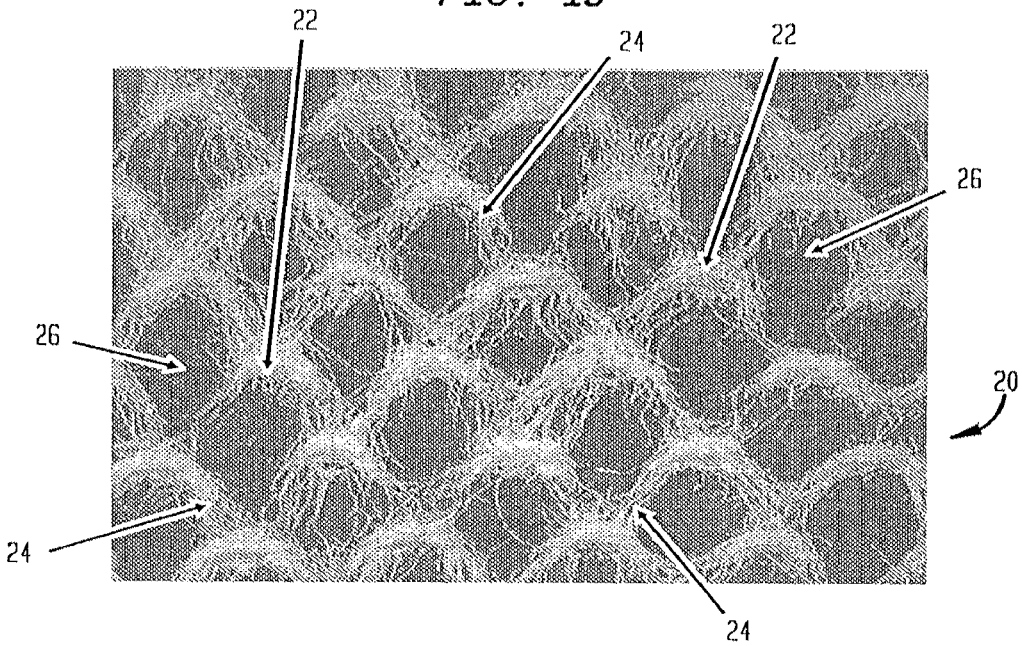
FIG. 13 is a photomicropgraph (8×) of an open mesh web including a plurality of high basis weight regions linked by lower basis weight regions extending therebetween.
Figure 14:
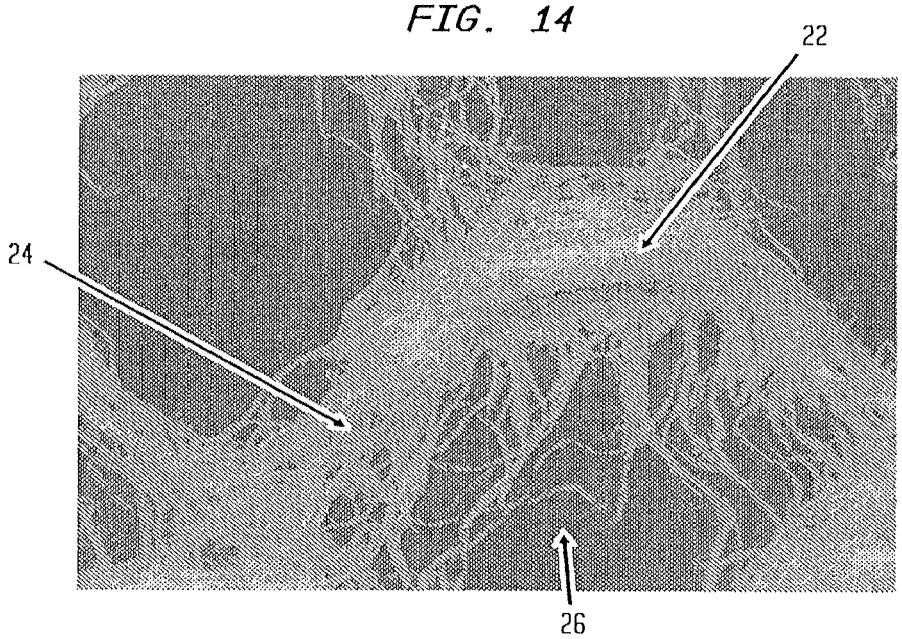
FIG. 14 is a photomicrograph showing an enlarged detail (32×) of the web of FIG. 13.

The invention processes and preferred products thereof are further appreciated by reference to FIGS. 13 through 30. FIG. 13 is a photomicrograph of a very low basis weight, open mesh web 20 having a plurality of relatively high basis weight pileated regions 22 interconnected by a plurality of lower basis weight linking regions 24. The cellulosic fibers of linking regions 24 have an orientation that is biased along the direction as to which they extend between pileated regions 22, as is perhaps best seen in the enlarged view of FIG. 14. The orientation and variation in local basis weight is surprising in view of the fact that the nascent web has an apparently random fiber orientation when formed and is transferred largely undisturbed to a transfer surface prior to being wet fabric-creped therefrom. The imparted ordered structure is distinctly seen at extremely low basis weights where web 20 has open portions 26 and is thus an open mesh structure.

Figure 15:
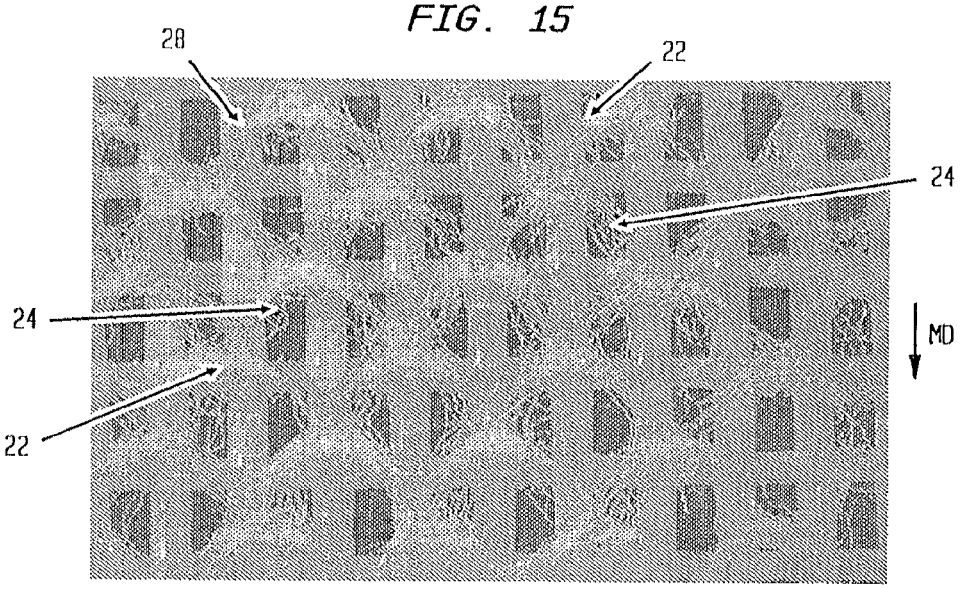
FIG. 15 is a photomicrograph (8×) showing the open mesh web of FIG. 13 placed on the creping fabric used to manufacture the web.

FIG. 15 shows a web together with the creping fabric 28, upon which the fibers were redistributed in a wet-creping nip after generally random formation to a consistency of 40-50 percent or so prior to creping from the transfer cylinder.

Figure 16:
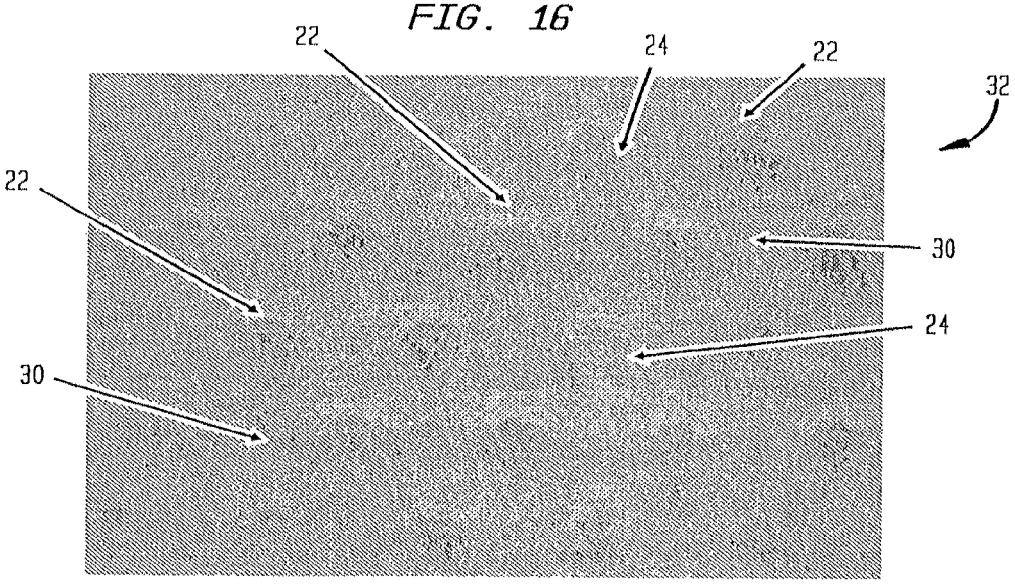
FIG. 16 is a photomicrograph showing a web having a basis weight of 19 lbs/ream produced with a 17% Fabric Crepe.
Figure 17:
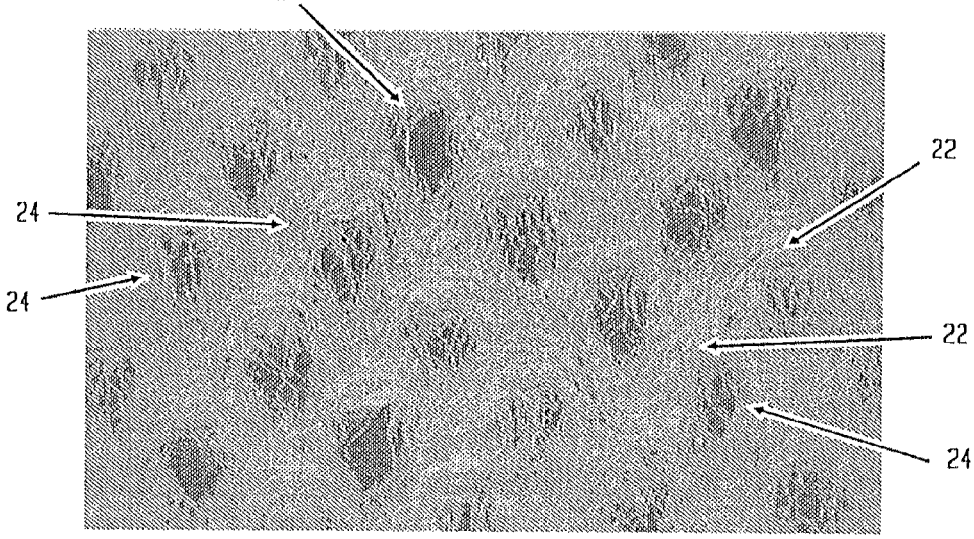
FIG. 17 is a photomicrograph showing a web having a basis weight of 19 lbs/ream produced with a 40% Fabric Crepe.
Figure 18:
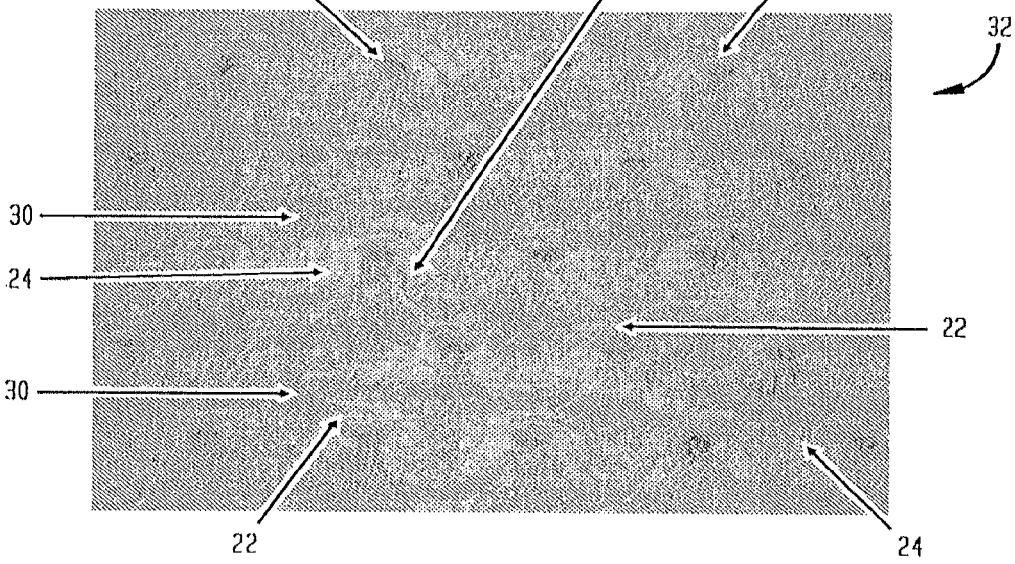
FIG. 18 is a photomicrograph showing a web having a basis weight of 27 lbs/ream produced with a 28% Fabric Crepe.
Figure 25:
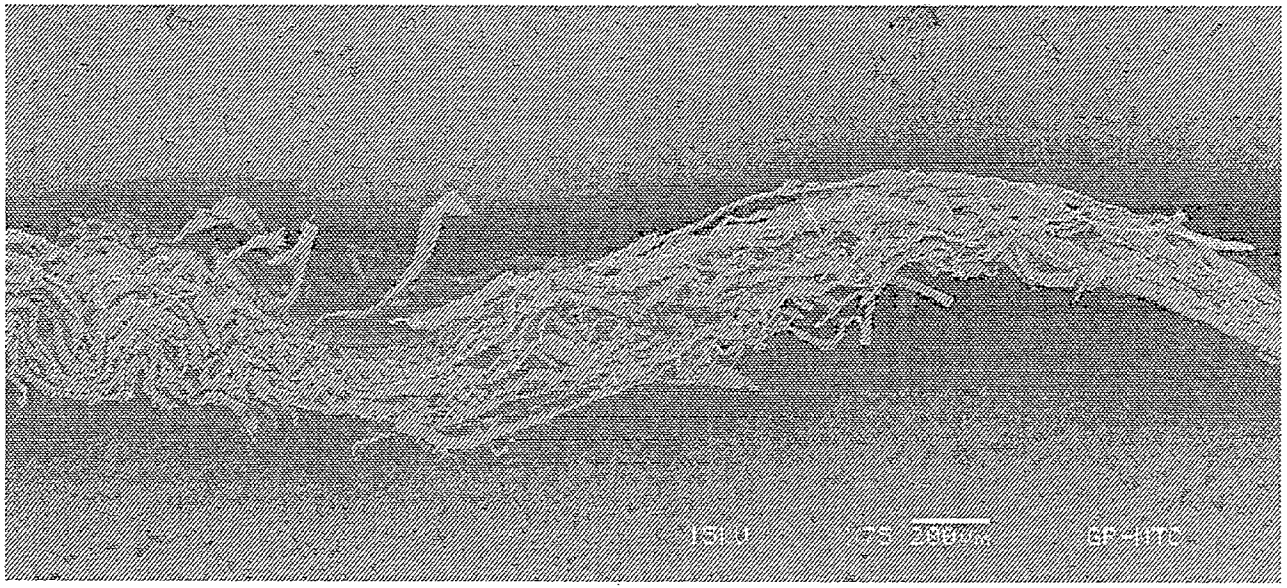
FIGS. 25 and 26 are SEMS of the sheet shown in FIG. 19 in section along the MD.
Figure 28:
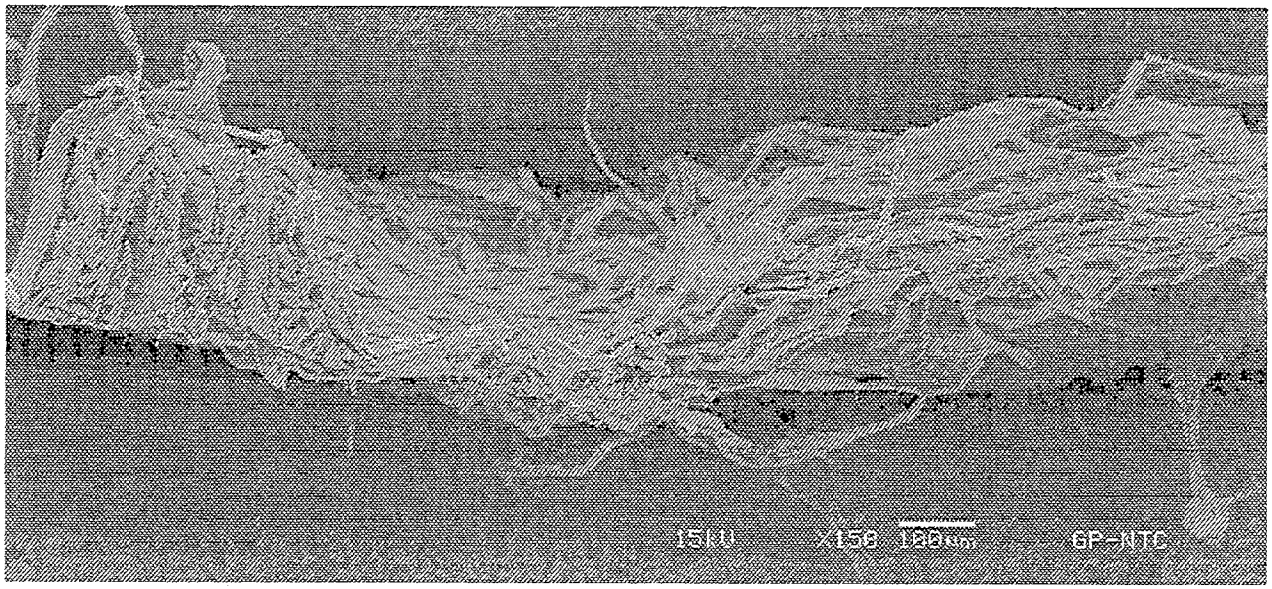

While the structure including the pileated and reoriented regions is easily observed in open meshed embodiments of very low basis weight, the ordered structure of the products of the invention is likewise seen when basis weight is increased, where integument regions of fiber 30 span the pileated and linking regions, as is seen in FIGS. 16 through 18, so that a sheet 32 is provided with substantially continuous surfaces, as is seen particularly in FIGS. 25 and 28, where the darker regions are lower in basis weight, while the almost solid white regions are relatively compressed fiber.

The impact of processing variables, and so forth, is also appreciated from FIGS. 16 through 18. FIGS. 16 and 17 both show 19 lb sheet; however, the pattern in terms of variation in basis weight is more prominent in FIG. 17 because the Fabric Crepe was much higher (40% vs. 17%). Likewise, FIG. 18 shows a higher basis weight web (27 lb) at 28% crepe where the pileated, linking and integument regions are all prominent.

Redistribution of fibers from a generally random arrangement into a patterned distribution including orientation bias as well as fiber-enriched regions corresponding to the creping fabric structure is still further appreciated by reference to FIGS. 19 through 30.

Figure 19:
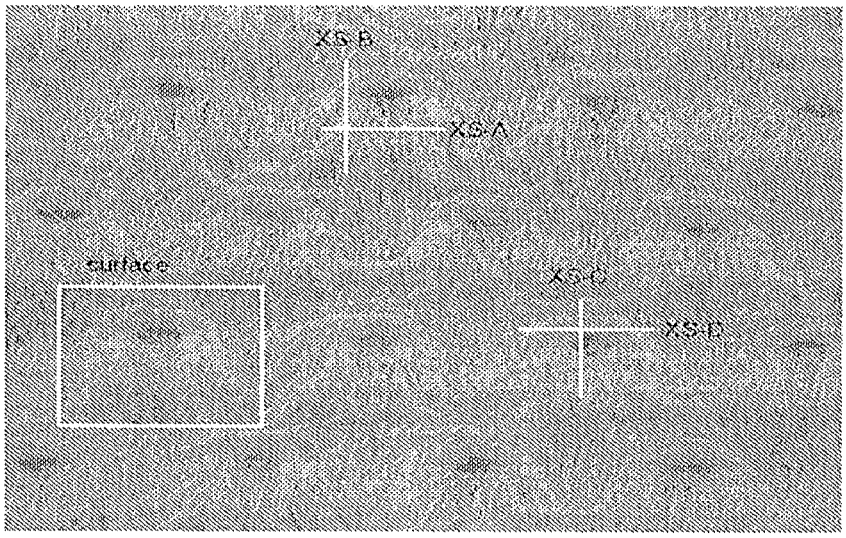
FIG. 19 is a surface image (10×) of an absorbent sheet, indicating areas where samples for surface and section scanning electron micrographs (SEMs) were taken.
Figure 20:
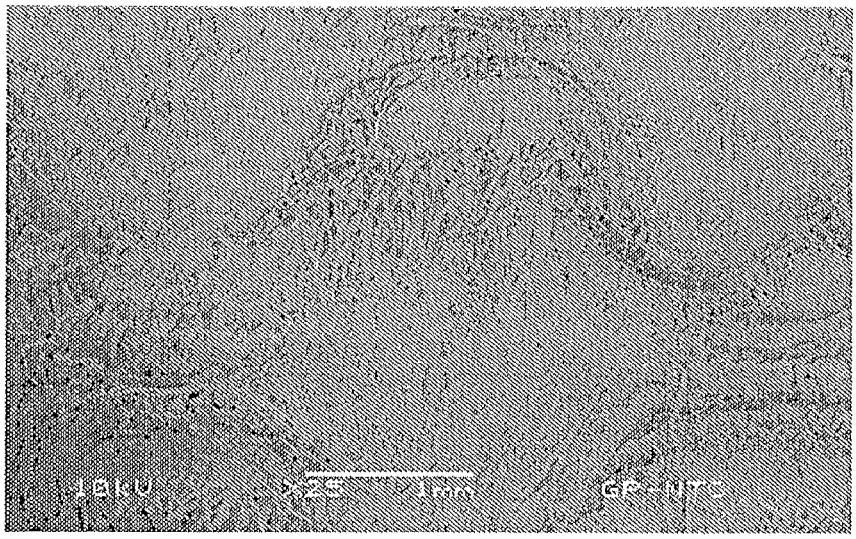
FIGS. 20-22 are surface SEMs of a sample material taken from the sheet seen in FIG. 19.
Figure 21:
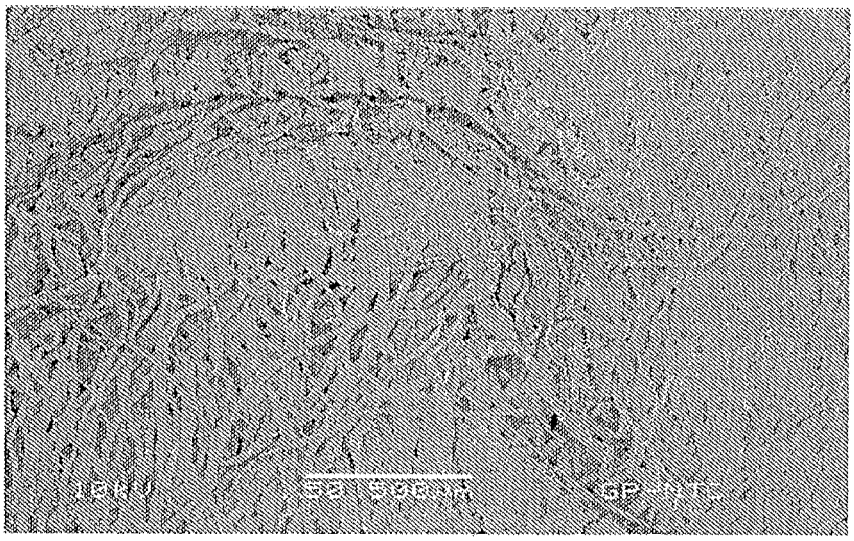
Figure 22:
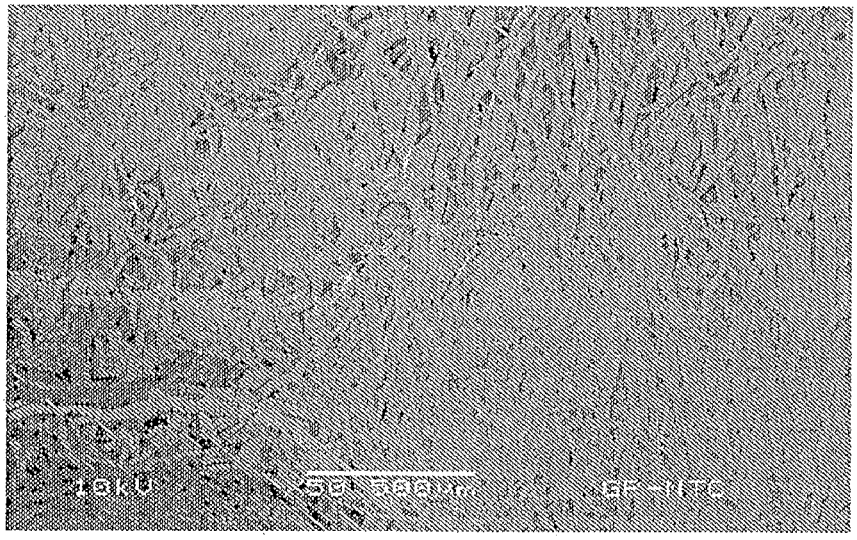

FIG. 19 is a photomicrograph (10×) showing a cellulosic web, from which a series of samples was prepared and scanning electron micrographs (SEMs) made to further show the fiber structure. On the left of FIG. 19 is shown a surface area from which the SEM (negative) surface images 20, 21 and 22 were prepared. It is seen in these SEMs that the fibers of the linking regions have orientations biased along their direction between pileated regions, as was noted earlier in connection with the photomicrographs. It is further seen in FIGS. 20, 21 and 22 that the integument regions formed have a fiber orientation along the machine direction. The feature is illustrated rather strikingly in FIGS. 23 and 24.

Figure 23:
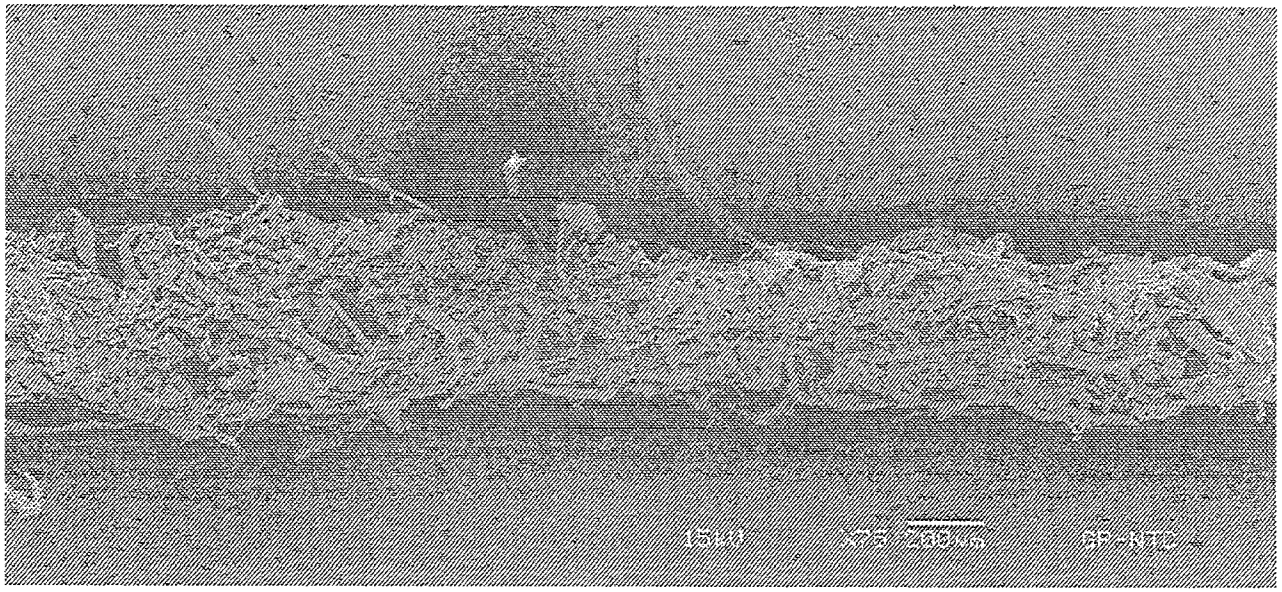
FIGS. 23 and 24 are SEMS of the sheet shown in FIG. 19 in section across the MD.
Figure 24:
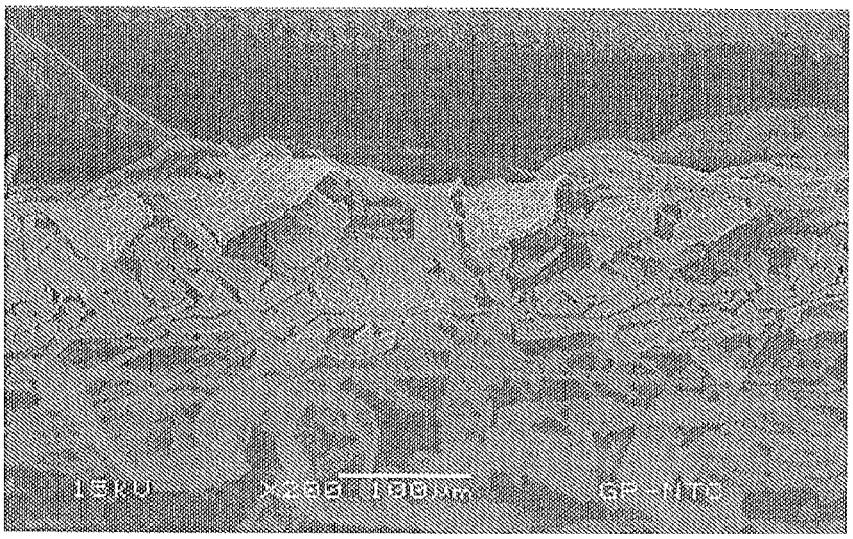

FIGS. 23 and 24 are (negative) views along line XS-A of FIG. 19, in section. It is seen especially at 200 magnification (FIG. 24) that the fibers are oriented toward the viewing plane, or machine direction, inasmuch as the majority of the fibers were cut when the sample was sectioned.

Figure 26:
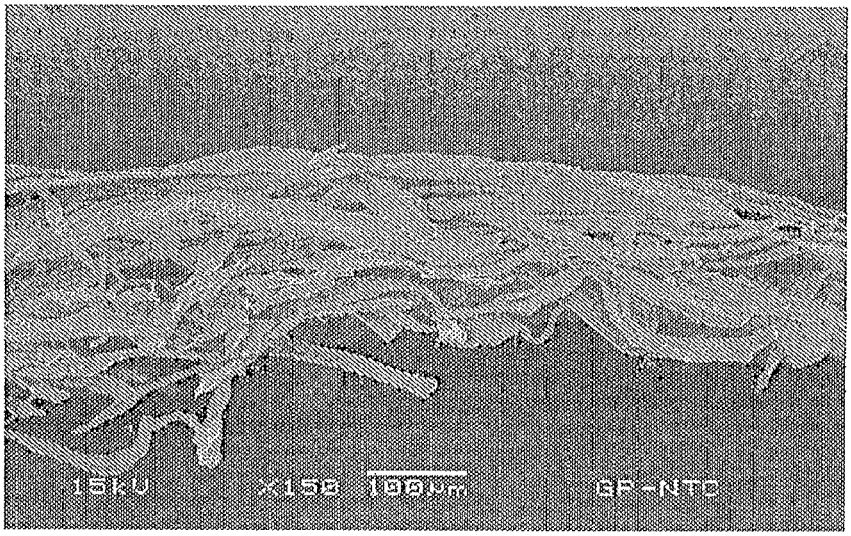

FIGS. 25 and 26, a (negative) section along line XS-B of the sample of FIG. 19, shows fewer cut fibers, especially at the middle portions of the photomicrographs, again showing an MD orientation bias in these areas. Note in FIG. 25, U-shaped folds are seen in the fiber-enriched area to the left.

Figure 27:
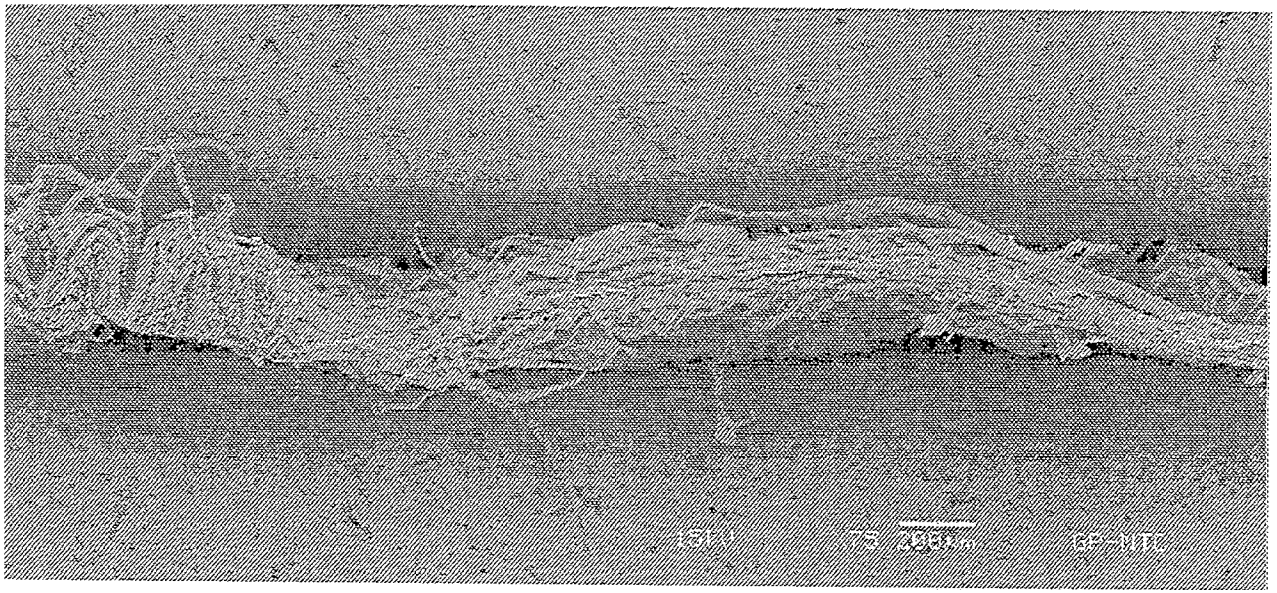
FIGS. 27 and 28 are SEMS of the sheet shown in FIG. 19 in section also along the MD.

FIGS. 27 and 28 are SEMs of a section (in negative) of the sample of FIG. 19 along line XS-C. It is seen in these Figures that the pileated regions (left side) are "stacked up" to a higher local basis weight. Moreover, it is seen in the SEM of FIG. 28 that a large number of fibers has been cut in the pileated region (left) showing reorientation of the fibers in this area in a direction transverse to the MD, in this case, along the CD. Also noteworthy is that the number of fiber ends observed diminishes as one moves from left to right, indicating orientation toward the MD as one moves away from the pileated regions.

Figure 29:
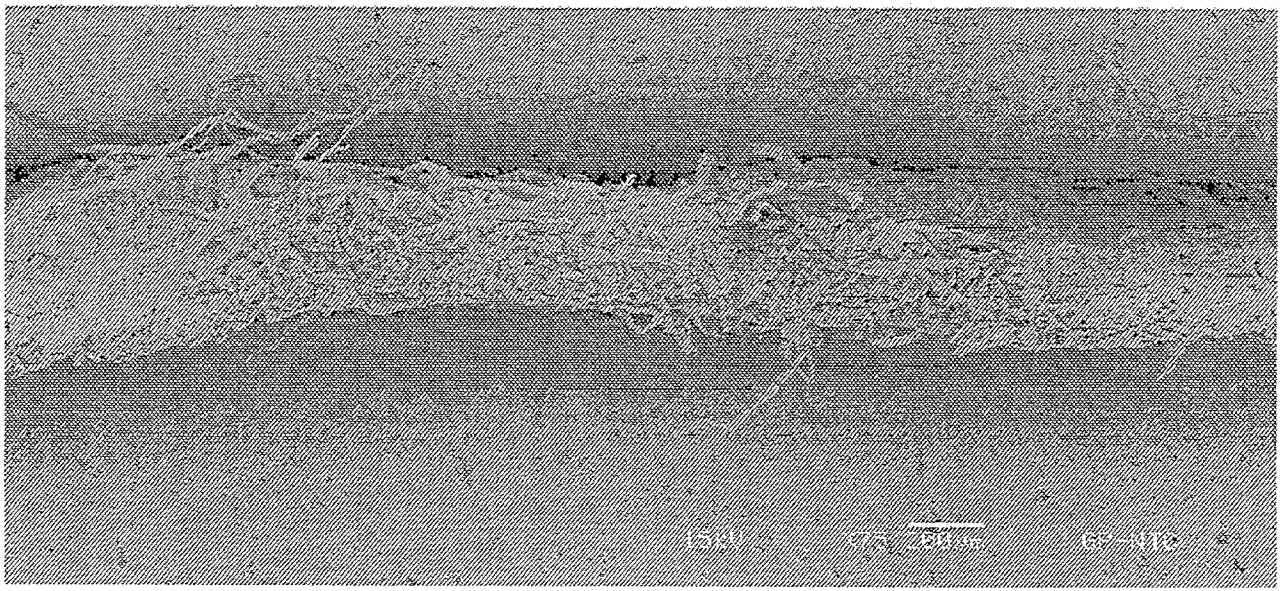
FIGS. 29 and 30 are SEMS of the sheet shown in FIG. 19 in section across the MD.
Figure 30:
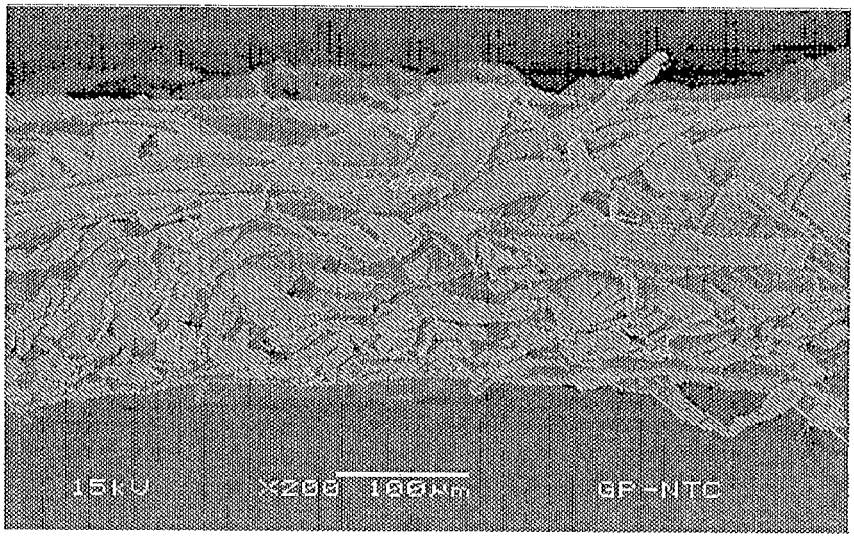

FIGS. 29 and 30 are SEMs (in negative) of a section taken along line XS-D of FIG. 19. Here, it is seen that fiber orientation bias changes as one moves across the CD. On the left, in a linking or colligating region, a large number of "ends" are seen indicating MD bias. In the middle, there are fewer ends as the edge of a pileated region is traversed, indicating more CD bias until another linking region is approached and cut fibers again become more plentiful, again indicating an increased MD bias.

The desired redistribution of fiber is achieved by an appropriate selection of consistency, fabric or fabric pattern, nip parameters, and velocity delta, the difference in speed between the transfer surface and creping fabric. Velocity deltas of at least 100 fpm, 200 fpm, 500 fpm, 1000 fpm, 1500 fpm or even in excess of 2000 fpm may be needed under some conditions to achieve the desired redistribution of fiber and combination of properties as will become apparent from the discussion that follows. In many cases, velocity deltas of from about 500 fpm to about 2000 fpm will suffice. Forming of the nascent web, for example, control of a headbox jet and forming wire or fabric speed is likewise important in order to achieve the desired properties of the product, especially, MD/CD tensile ratio. Likewise, drying may be carried out while preserving the drawable reticulum of the web, especially, if it is desired to increase bulk substantially by drawing the web. It is seen in the discussion that follows that the following salient parameters are selected or controlled in order to achieve a desired set of characteristics in the product: consistency at a particular point in the process (especially, at fabric crepe); fabric pattern; fabric creping nip parameters; fabric crepe ratio; velocity deltas, especially, transfer surface/creping fabric and headbox jet/forming wire; and post fabric-crepe handling of the web. The products of the invention are compared with conventional products in Table 2 below.

TABLE 2

Comparison of Typical Web Properties

| Property | Conventional Wet Press | Conventional Throughdried | High Speed Fabric Crepe |
|---|---|---|---|
| SAT g/g | 4 | 10 | 6-9 |
| *Caliper | 40 | 120+ | 50-115 |
| MD/CD Tensile | >1 | >1 | <1 |
| CD Stretch (%) | 3-4 | 7-15 | 5-15 |

*mils/8 sheet

Referring to FIG. 31, there is shown schematically a papermachine 40 that may be used to practice the present invention. Papermachine 40 includes a forming section 42, a press section 44, a creping roll 46, wherein the web is creped from a transfer roll 76, as well as a can dryer section 48. Forming section 42 includes: a head box 50, and a forming fabric or wire 52, which is supported on a plurality of rolls to provide a forming table 51. There is thus provided forming roll 54, support rolls 56, 58 as well as a roll 60.

Press section 44 includes a paper making felt 62 supported on rollers 64, 66, 68, 70 and shoe press roll 72. Shoe press roll 72 includes a shoe 74 for pressing the web against transfer drum or roll 76. Transfer roll or drum 76 may be heated if so desired. Roll 76 includes a transfer surface 78 upon which the web is deposited during manufacture. Crepe roll 46 supports, in part, an impression fabric 80, which is also supported on a plurality of rolls 82, 84 and 86.

Dryer section 48 also includes a plurality of can dryers 88, 90, 92, 94, 96, 98 and 100, as shown in the diagram, wherein cans 96, 98 and 100 are in a first tier and cans 88, 90, 92 and 94 are in a second tier. Cans 96, 98 and 100 directly contact the web, whereas cans in the other tier contact the fabric. In this two tier arrangement where the web is separated from cans 90 and 92 by the fabric, it is sometimes advantageous to provide impingement air dryers at 90 and 92, which may be drilled cans, such that air flow is indicated schematically at 91 and 93.

There is further provided a reel section 102, which includes a guide roll 104 and a take up reel 106 shown schematically in the diagram.

Papermachine 40 is operated such that the web travels in the machine direction indicated by arrows 108, 112, 114, 116 and 118, as is seen in FIG. 31. A paper making furnish at low consistency, generally, less than 0.5%, typically, about 0.2% or less, is deposited on fabric or wire 52 to form a web 110 on table 51, as is shown in the diagram. Web 110 is conveyed in the machine direction to press section 44 and transferred onto a press felt 62, as is seen in FIG. 31. In this connection, the web is typically dewatered to a consistency of between about 10 and 15 percent on wire 52 before being transferred to the felt. So also, roll 64 may be a vacuum roll to assist in transfer to the felt 62. On felt 62, web 110 is dewatered to a consistency typically of from about 20 to about 25 percent prior to entering a press nip indicated at 120. At nip 120, the web is pressed onto cylinder 76 by way of shoe press roll 72. In this connection, the shoe 74 exerts pressure, whereupon the web is transferred to surface 78 of roll 76 at a consistency of from about 40 to 50 percent on the transfer roll. Transfer roll 76 translates in the machine direction indicated by 114 at a first speed.

Fabric 80 travels in the direction indicated by arrow 116 and picks up web 110 in the creping nip indicated at 122. Fabric 80 is traveling at a second speed that is slower than the first speed of the transfer surface 78 of roll 76. Thus, the web is provided with a fabric crepe, typically, in an amount of from about 10 to about 300 percent in the machine direction.

The creping fabric defines a creping nip over the distance, in which creping fabric 80 is adapted to contact surface 78 of roll 76; that is, applies significant pressure to the web against the transfer cylinder. To this end, backing (or creping) roll 46 may be provided with a soft deformable surface that will increase the length of the creping nip and increase the fabric creping angle between the fabric and the sheet, and the point of contact or a shoe press roll could be used as roll 46 to increase effective contact with the web in high impact fabric creping nip 122 where web 110 is transferred to fabric 80, and advanced in the machine direction. By using different equipment at the creping nip, it is possible to adjust the fabric creping angle or the takeaway angle from the creping nip. A cover on roll 46 having a Pusey and Jones hardness of from about 25 to about 90 may be used. Thus, it is possible to influence the nature and the amount of redistribution of fiber, delamination/debonding that may occur at fabric creping nip 122 by adjusting these nip parameters. In some embodiments, it may by desirable to restructure the z-direction interfiber characteristics, while, in other cases, it may be desired to influence properties only in the plane of the web. The creping nip parameters can influence the distribution of fiber in the web in a variety of directions, including inducing changes in the z-direction, as well as the MD and CD. In any case, the transfer from the transfer cylinder to the creping fabric is high impact in that the fabric is traveling slower than the web and a significant velocity change occurs. Typically, the web is creped anywhere from 10-60 percent and even higher during transfer from the transfer cylinder to the fabric.

Creping nip 122 generally extends over a fabric creping nip distance of anywhere from about ⅛" to about 2", typically ½" to 2". For a creping fabric with 32 CD strands per inch, web 110 thus will encounter anywhere from about 4 to 64 weft filaments in the nip.

The nip pressure in nip 122, that is, the loading between creping roll 46 and transfer roll 76 is suitably 20-200, preferably, 40-70 pounds per linear inch (PLI).

Following the fabric crepe, web 110 is retained in fabric 80 and fed to dryer section 48. In dryer section 48, the web is dried to a consistency of from about 92 to 98 percent before being wound up on reel 106. Note that there is provided in the drying section a plurality of heated drying rolls 96, 98 and 100, which are in direct contact with the web on fabric 80. The drying cans or rolls 96, 98, and 100 are steam heated to an elevated temperature operative to dry the web. Rolls 88, 80, 92 and 94 are likewise heated, although these rolls contact the fabric directly and not the web directly. An optional vacuum molding box at 103 is provided if it is desired to apply a vacuum to the web as it is retained in fabric 80.

In especially preferred embodiments, reel 106 is operated at a higher speed than fabric 80 so that web 110 is drawn, that is, elongated, as it is transferred from fabric 80 to reel 106. A reel draw of anywhere from 10-100% is suitable in many cases. Alternatively, the web may be drawn off-line.

In some embodiments of the invention, it may be desirable to eliminate open draws in the process, such as the open draw between the creping and drying fabric and reel 106. This is readily accomplished by extending the creping fabric to the reel drum and transferring the web directly from the fabric to the reel as is disclosed generally in U.S. Pat. No. 5,593,545 to Rugowski et al.

The present invention offers the advantage that relatively low grade energy sources may be used to provide the thermal energy used to dry the web. That is to say, it is not necessary in accordance with the invention to provide through-air drying quality heated air or heated air suitable for a drying hood, inasmuch as the cans 96, 98 and 100 may be heated from any source, including waste recovery. Also, existing facility thermal recovery is used since equipment changes to implement the process are minimal. Generally, a significant advantage of the invention is that it may utilize existing manufacturing assets such as can dryers and Fourdrinier formers of flat papermachines in order to make premium basesheet for tissue and towel, thus lowering dramatically the required capital investment to make premium products. In many cases, papermachines can be rebuilt without having to move the wet-end or dry-end of the machine.

Figure 32:
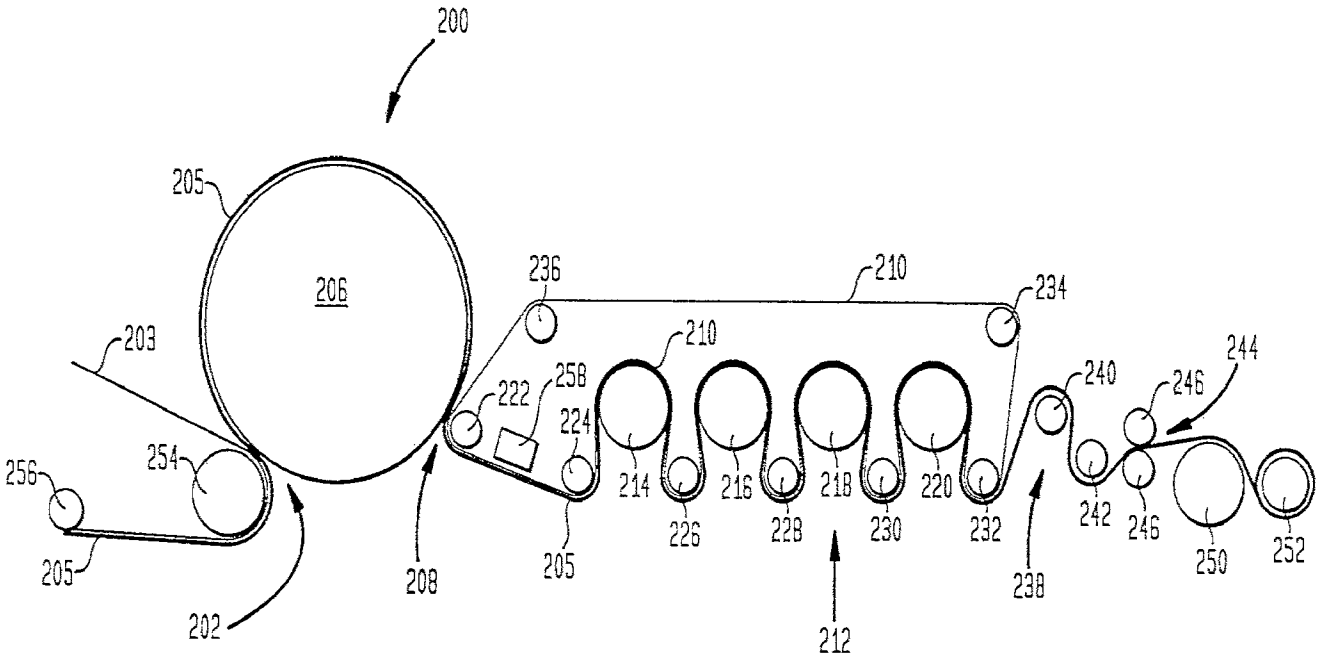
FIG. 32 is a schematic diagram showing a portion of another papermachine for making the products of the present invention.

FIG. 32 shows a portion of a papermachine 200 that includes a press section 202 provided with a press felt 203 and a transfer roll 206. Web 205 is transferred by wet pressing the web onto cylinder 206, as was described above in connection with FIG. 31.

Papermachine 200 also includes a fabric creping section 208 wherein web 205 is fabric-creped onto fabric 210.

There is further provided a single tier dryer section 212 provided with a plurality of can dryers 214, 216, 218, and 220. There is also provided to support fabric 210 a plurality of guide rolls such as rolls 222, 224, 226, 228, 230, 232, 234, and 236. After the dryer section, web 205 is transferred to a draw section 238, which includes a first draw roll 240 as well as a second draw roll 242.

Further downstream is a calender station 244, including calender rolls 246, a guide roll 250 and a wind up reel 252.

The sheet is formed, pressed and applied to backing roll 206, as in conventional paper making. In this respect, there is provided a press roll 254, as well as a plurality of guide rolls, such as roll 256, upon which felt 203 travels. Backing roll 206 may be heated by any number of means that serves to improve the efficiency of the pressing operation. The pressing step dewaters the sheet and attaches to roll 206 sufficiently to carry it around cylinder 206 to the point at which sheet 205 is creped onto fabric 210 through a differential speed nip at 208. Transfer at 208 molds the sheet into the fabric sufficiently that the sheet and fabric are kept together throughout final drying. To further enhance this molding, there is optionally provided a vacuum box 258. Typically, vacuum box 258 will add up to about 50% percent or more caliper depending upon the pressure differential to which the sheet/fabric combo is subjected. In this respect, a pressure differential of anywhere from about 5 up to about 30 inches of mercury may be employed.

Following the optional vacuum box treatment, the sheet is dried to the desired final dryness while maintained in the fabric in section 212 by dryer cans 214 through 220. It will be appreciated by those of skill in the art that section 212 is a "single tier" drying arrangement. The sheet is separated from fabric 210 and supplied to roll 240. Preferably, roll 240 is operated at a speed slightly faster than fabric 210. Another roll 242 is operated faster than roll 240 and substantially faster than fabric 210 in order to draw the sheet to the desired elongation. Web 205 may then be calendered at calendering station 244, if so desired. In many applications of the inventive process, in line calendering as shown in FIG. 32 is preferred.

In accordance with the invention, the sheet is drawn or pulled out prior to calendering, so that web 205 is provided with superior tactile properties, as well as improved absorbency. Tactile smoothing can also be accomplished by drying the sheet in the fabric to at least about 80% dry and then final drying in a traditional can drying section where both of the sides are brought into contact with a hot drying cylinder. This will bring down the tactile differences between the can or dryer side of the sheet and the fabric side of the sheet. One such apparatus is shown schematically in FIG. 33, discussed below.

Figure 33:
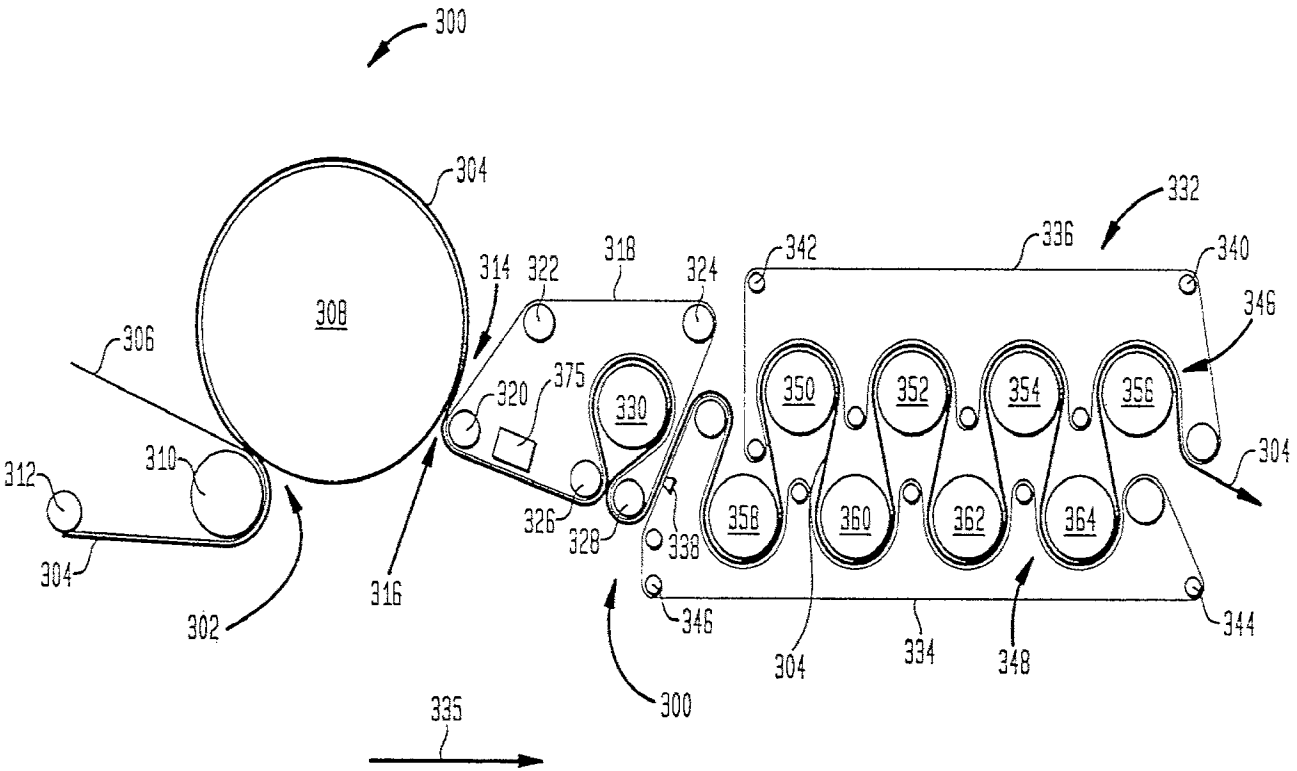
FIG. 33 is a schematic diagram of a portion of yet another papermachine for making the products of the present invention.

FIG. 33 shows a partial schematic of yet another papermaking machine 300 that includes a press section 302, wherein a web 304 is transferred from a papermaking felt 306 to a transfer cylinder 308. Press section 302 includes a press roll 310, as well as guide rolls such as roll 312 to support felt 306.

Adjacent to transfer cylinder 308 is provided a fabric creping station 314, including a fabric creping nip 316, wherein web 304 is transferred to a creping fabric 318. Creping fabric 318 is supported on a plurality of rolls, such as rolls 320, 322, 324, 326 and 328. Optionally included in the creping fabric section is one or more dryer cans, such as dryer can 330, to further dry the web as it moves in machine direction 335. Following fabric creping, the web is transferred to a two tier can drying section 332. Section 332 includes a first dryer fabric 334, as well as a second dryer fabric 336. Optionally provided is a vacuum shoe 338 to assist in transfer from the creping fabrics to the drying fabrics. Each of the drying fabrics is mounted about a plurality of guide rolls such as rolls 340, 342, 344, 346, and so forth.

The section also includes a first tier 346 of dryer cans as well as a second tier 348 of dryer cans. Tier 346 includes cans 350, 352, 354 and 356, while tier 348 includes dryer cans 358, 360, 362 and 364.

Web 304 is formed by conventional means and compactably dewatered at press section 302 as web 304 is applied to transfer cylinder 308 with an apparently random distribution of fiber orientation. The web is then creped from the surface of cylinder 308 in creping nip 316. In this respect, it will be appreciated that fabric 318 travels at a speed that is lower than the velocity of the surface of cylinder 308, in order to impart fabric crepe into the web and to rearrange the apparently random web applied to cylinder 308, such that the web has the fiber bias shown in the various photomicrographs. Optionally, a vacuum is applied at 375, if so desired.

After creping, the web is conveyed in the machine direction 335 by fabric 318 and, optionally, further dried by one or more cans, such as can 330, before the web is transferred to a dryer fabric.

Optionally, web 304 is transferred to a dryer fabric, such as fabric 334, with the assistance of a vacuum shoe 338. The web is dried on the surface of the dryer cans 350 to 364 by alternatively contacting a surface of the web with the dryer cans, as shown.

It will be appreciated from the diagram that the fabric side of the web contacts the surface of the dryer cans of tier 348, that is, cans 358, 360, 362 and 364. It will likewise be appreciated that the air side of the fabric creped web 304 contacts the surfaces of the dryer cans in tier 346, that is, cans 350, 352, 354 and 356. By way of this process, the sidedness of the web is reduced during drying. Tactile properties as well as absorbency are further enhanced by providing draw and/or calendering as was discussed above in connection with FIG. 31.

EXAMPLES 1-8 and EXAMPLES A-F

Utilizing an apparatus of the class shown in FIGS. 31-33, a series of absorbent sheets was prepared with different amounts of fabric crepe and overall crepe. In general, a 50/50 southern softwood kraft/southern hardwood kraft furnish was used with a 36 m (M weave with the CD knuckles to the sheet). Chemicals such as debonders and strength resins were not used. The fabric crepe ratio was about 1.6. The sheet was fabric creped at about 50% consistency using a line force of about 25 pli against the backing roll. Thereafter, the sheet was dried in the fabric by bringing it into contact with heated dryer cans, removed from the fabric and wound onto the reel of the papermachine. Data from these trials are designated as Examples 1-8 in Table 3, where post-fabric creping draw is also specified.

Further trials were made with an apparatus using compactive dewatering, fabric creping and Yankee drying (instead of can drying), wherein the web was adhered to the Yankee cylinder with a polyvinyl alcohol containing adhesive and removed by blade creping. Data from these trials appears in Table 3 as Examples A-F.

TABLE 3

Sheet Properties
Examples 1-8; A-F

| Sample | Description | VV | Fabric Fric 1 | Fabric Fric 2 | Opp. Fric 1 | Opp. Fric 2 | Fric Ratio1 | Fric Ratio2 | Percent Draw | Basis Weight | Caliper, 1 Sheet, 0.001 in | Calc'd Bulk, cc/gram |
|---|---|---|---|---|---|---|---|---|---|---|---|---|
| 1 | Control | 5.15 | 2.379 | 2.266 | | | 2.16 | 2.74 | 0 | 19.6 | 11.5 | 9.1 |
| 2 | 15% Draw | 5.33 | 1.402 | 1.542 | | | 1.15 | 1.53 | 15 | 20.1 | 12.0 | 9.3 |
| 3 | 30% Draw | 5.45 | 2.016 | 1.662 | | | 1.83 | 1.27 | 30 | 18.4 | 11.7 | 9.9 |
| 4 | 45% Draw | 6.32 | 1.843 | 1.784 | | | 1.02 | 1.78 | 45 | 15.3 | 10.2 | 10.4 |

TABLE 3-continued

Sheet Properties
Examples 1-8; A-F

| Sample | Description | VV | Fabric Fric 1 | Fabric Fric 2 | Opp. Fric 1 | Opp. Fric 2 | Fric Ratio1 | Fric Ratio2 | Percent Draw | Basis Weight | Caliper, 1 Sheet, 0.001 in | Calc'd Bulk, cc/gram |
|---|---|---|---|---|---|---|---|---|---|---|---|---|
| 5 | Control | | | | 1.100 | 0.828 | | | 0 | | | |
| 6 | 15% Draw | | | | 1.216 | 1.011 | | | 15 | | | |
| 7 | 30% Draw | | | | 1.099 | 1.304 | | | 30 | | | |
| 8 | 45% Draw | | | | 1.815 | 1.002 | | | 45 | | | |
| A | Control | 5.727 | 1.904 | 1.730 | | | 2.13 | 1.68 | 0 | 21.6 | 14.2 | 10.3 |
| B | 10% Draw | 5.013 | 2.093 | 2.003 | | | 1.56 | 1.48 | 10 | 20.0 | 13.2 | 10.3 |
| C | 17% Draw | 4.771 | 0.846 | 0.818 | | | 0.76 | 0.84 | 17 | 19.1 | 11.4 | 9.3 |
| D | Control | | | | 0.895 | 1.029 | | | 0 | | 14.2 | |
| E | 10% Draw | | | | 1.345 | 1.356 | | | 10 | | 12.7 | |
| F | 17% Draw | | | | 1.107 | 0.971 | | | 17 | | 11.5 | |

Photomicrographs of selected products appear as FIGS. 1-6 and results also appear in FIGS. 7-12 discussed above. It is seen that the in-fabric, can-dried product exhibits very unique characteristics when drawn after fabric creping. As summarized above, unique features include an increase in void volume and bulk upon drawing. Sidedness is also reduced when a fabric-creped, can-dried web is drawn.

Without intending to be bound by any theory, it is believed that if the cohesiveness of the fabric-creped, drawable reticulum of the web is preserved during drying, then drawing the web will unfold or otherwise attenuate the fiber-enriched regions of the web to increase absorbency. In Table 4, it is seen that conventional wet press (CWP) and through-air dried products (TAD) exhibit much less property change upon drawing than fabric creped/can dried absorbent sheet of the invention. These results are discussed further below together with additional examples.

Following generally the procedures noted above, additional runs were made with in-fabric (can) dried and Yankee-dried basesheet. The Yankee-dried material was adhered to a Yankee dryer with a polyvinyl alcohol adhesive and blade-creped. The Yankee dried material exhibits less property change upon drawing (until most of the stretch is pulled out), than did the can dried material. Test data is summarized in Tables 5 through 12 and FIGS. 34 through 43. Fabrics tested included 44G, 44M and 36M oriented in the MD or CD. Vacuum molding with a vacuum box such as box 258 (FIG. 32) included testing with a narrow ¼" and wider 1.5" slot up to about 25" Hg vacuum.

TABLE 4

| Example | Description | Caliper 1 Sheet mils/ 1 sht | Void Volume Dry Wt g | Void Volume Wet Wt g | Void Volume Wt Inc. % | Void Volume Ratio | Void Volume grams/gram | Basis Weight lbs/3000 ft2 |
|---|---|---|---|---|---|---|---|---|
| G | TAD @ 0 | 18.8 | 0.0152 | 0.1481 | 873.970 | 4.600 | 8.74 | 14.5 |
| H | TAD @ 10% Pullout | 18.5 | 0.0146 | 0.1455 | 900.005 | 4.737 | 9.00 | 13.8 |
| I | TAD @ 15% | 17.0 | 0.0138 | 0.1379 | 902.631 | 4.751 | 9.03 | 13.1 |
| J | TAD @ 20% | 16.2 | 0.0134 | 0.1346 | 904.478 | 4.760 | 9.04 | 12.8 |
| K | CWP @ 0 | 5.2 | 0.0156 | 0.0855 | 449.628 | 2.366 | 4.50 | 14.8 |
| L | CWP @ 10% Pullout | 5.1 | 0.0145 | 0.0866 | 497.013 | 2.616 | 4.97 | 13.8 |
| M | CWP @ 15% | 5.0 | 0.0141 | 0.0830 | 488.119 | 2.569 | 4.88 | 13.4 |
| | CWP @ 20% | 4.6 | 0.0139 | 0.0793 | 472.606 | 2.487 | 4.73 | 13.2 |

TABLE 5

Representative Examples 9-34

| Description | Recovered Stretch (%) | Caliper After Recovery 1 Sheet (mils/ 1 sht) | Initial Caliper 1 Sheet (mils/ 1 sht) | Void Vol. Dry Wt (g) | Void Vol. Wet Wt (g) | Void Vol. Wt Inc. (%) | Void Volume Ratio | Basis Weight | Void Volume | Original Caliper | Void Volume Change |
|---|---|---|---|---|---|---|---|---|---|---|---|
| Yankee Dried | 0 | 16.5 | 16.5 | 0.0274 | 0.228 | 732 | 3.8516 | 26.0247 | 7.3180 | 1.0000 | |
| | 0 | 16.3 | 16.3 | 0.0269 | 0.221 | 722 | 3.7988 | 25.5489 | 7.2178 | 1.0000 | |
| | 15 | 15.3 | 16.4 | 0.0264 | 0.217 | 725 | 3.8162 | 25.0731 | 7.2508 | 0.9329 | −0.0023 |
| | 15 | 15.4 | 16.4 | 0.0264 | 0.218 | 726 | 3.8220 | 25.1207 | 7.2619 | 0.9390 | −0.0008 |
| | 25 | 13.7 | 16.5 | 0.0237 | 0.200 | 747 | 3.9333 | 22.5040 | 7.4732 | 0.8303 | 0.0283 |
| | 25 | 13.6 | 16.3 | 0.0240 | 0.198 | 725 | 3.8150 | 22.7894 | 7.2485 | 0.8344 | −0.0027 |
| | 30 | 12.9 | 16.6 | 0.0227 | 0.191 | 742 | 3.9049 | 21.5524 | 7.4193 | 0.7771 | 0.0208 |
| | 30 | 13.0 | 16.6 | 0.0227 | 0.188 | 732 | 3.8515 | 21.5524 | 7.3178 | 0.7831 | 0.0069 |
| | 35 | 12.4 | 16.4 | 0.0221 | 0.190 | 760 | 3.9987 | 21.0291 | 7.5975 | 0.7561 | 0.0454 |

TABLE 5-continued

Representative Examples 9-34

| Description | Recovered Stretch (%) | Caliper After Recovery 1 Sheet (mils/ 1 sht) | Initial Caliper 1 Sheet (mils/ 1 sht) | Void Vol. Dry Wt (g) | Void Vol. Wet Wt (g) | Void Vol. Wt Inc. (%) | Void Volume Ratio | Basis Weight | Void Volume | Original Caliper | Void Volume Change |
|---|---|---|---|---|---|---|---|---|---|---|---|
| | 35 | 12.4 | 16.4 | 0.0224 | 0.189 | 742 | 3.9065 | 21.3145 | 7.4224 | 0.7561 | 0.0213 |
| | 40 | 11.6 | 16.4 | 0.0213 | 0.187 | 782 | 4.1164 | 20.2203 | 7.8212 | 0.7073 | 0.0761 |
| | 40 | 11.8 | 16.4 | 0.0213 | 0.190 | 793 | 4.1760 | 20.2203 | 7.9344 | 0.7195 | 0.0917 |
| Can Dried | 0 | 12.4 | 12.4 | 0.0226 | 0.132 | 482 | 2.5395 | 21.5048 | 4.8250 | 1.0000 | |
| | 0 | 12.4 | 12.4 | 0.0230 | 0.138 | 503 | 2.6478 | 21.8379 | 5.0308 | 1.0000 | |
| | 20 | 12.6 | 12.7 | 0.0202 | 0.135 | 568 | 2.9908 | 19.2211 | 5.6826 | 0.9921 | 0.1531 |
| | 20 | 11.9 | 12.4 | 0.0200 | 0.130 | 549 | 2.8884 | 19.0308 | 5.4880 | 0.9597 | 0.1137 |
| | 40 | 11.1 | 12.2 | 0.0176 | 0.129 | 635 | 3.3427 | 16.6996 | 6.3512 | 0.9098 | 0.2888 |
| | 40 | 11.1 | 12.1 | 0.0177 | 0.128 | 621 | 3.2679 | 16.8423 | 6.2091 | 0.9174 | 0.2600 |
| | 45 | 11.1 | 12.2 | 0.0175 | 0.129 | 635 | 3.3399 | 16.6520 | 6.3457 | 0.9098 | 0.2877 |
| | 45 | 11.0 | 12.1 | 0.0160 | 0.121 | 654 | 3.4406 | 15.2247 | 6.5371 | 0.9091 | 0.3265 |
| | 50 | 11.1 | 12.8 | 0.0168 | 0.124 | 641 | 3.3762 | 15.9383 | 6.4147 | 0.8672 | 0.3017 |
| | 50 | 10.5 | 12.2 | 0.0162 | 0.122 | 653 | 3.4364 | 15.3674 | 6.5291 | 0.8607 | 0.3249 |
| | 55 | 10.3 | 12.1 | 0.0166 | 0.125 | 653 | 3.4395 | 15.7480 | 6.5350 | 0.8512 | 0.3261 |
| | 55 | 10.0 | 12.4 | 0.0165 | 0.123 | 651 | 3.4277 | 15.6529 | 6.5126 | 0.8065 | 0.3216 |
| | 60 | 9.6 | 12.2 | 0.0141 | 0.117 | 731 | 3.8463 | 13.4167 | 7.3080 | 0.7869 | 0.4830 |
| | 60 | 9.6 | 12.5 | 0.0151 | 0.116 | 673 | 3.5404 | 14.3207 | 6.7267 | 0.7680 | 0.3650 |

| Stretch | 7 Point Modulus |
|---|---|
| 0.0% | |
| 0.1% | |
| 0.2% | |
| 0.2% | |
| 0.3% | |
| 0.3% | |
| 0.4% | |
| 0.4% | 2.901 |
| 0.5% | 0.800 |
| 0.6% | 6.463 |
| 0.6% | 8.599 |
| 0.7% | 7.007 |
| 0.7% | 9.578 |
| 0.8% | 10.241 |
| 0.8% | 9.671 |
| 0.9% | 8.230 |
| 0.9% | 8.739 |
| 1.0% | 11.834 |
| 1.1% | 11.704 |
| 1.1% | 7.344 |
| 1.2% | 4.605 |
| 1.2% | 5.874 |
| 1.3% | 9.812 |
| 1.3% | 7.364 |
| 1.4% | 7.395 |
| 1.4% | 3.595 |
| 1.5% | 9.846 |
| 1.6% | 9.273 |
| 1.6% | 9.320 |
| 1.7% | 9.044 |
| 1.7% | 8.392 |
| 1.8% | 6.904 |
| 1.8% | 9.106 |
| 1.9% | 4.188 |
| 1.9% | 9.058 |
| 2.0% | 5.812 |
| 2.1% | 6.829 |
| 2.1% | 8.861 |
| 2.2% | 8.726 |
| 2.2% | 7.547 |
| 2.3% | 8.551 |
| 2.3% | 5.323 |
| 2.4% | 8.749 |
| 2.4% | 8.335 |
| 2.5% | 3.565 |

-continued

| Stretch | 7 Point Modulus |
|---|---|
| 2.6% | 7.184 |
| 2.6% | 10.009 |
| 2.7% | 6.210 |
| 2.7% | 4.050 |
| 2.8% | 6.196 |
| 2.8% | 6.650 |
| 2.9% | 3.741 |
| 2.9% | 4.788 |
| 3.0% | 1.204 |
| 3.1% | 4.713 |
| 3.1% | 6.730 |
| 3.2% | 1.970 |
| 3.2% | 6.071 |
| 3.3% | 9.930 |
| 3.3% | 1.369 |
| 3.4% | 6.921 |
| 3.4% | 4.998 |
| 3.5% | 3.646 |
| 3.6% | 8.263 |
| 3.6% | 1.287 |
| 3.7% | 2.850 |
| 3.7% | 4.314 |
| 3.8% | 3.653 |
| 3.8% | 4.033 |
| 3.9% | 3.033 |
| 3.9% | 2.546 |
| 4.0% | 2.951 |
| 4.1% | −1.750 |
| 4.1% | 3.651 |
| 4.2% | 3.476 |
| 4.2% | 1.422 |
| 4.3% | 2.573 |
| 4.3% | 2.629 |
| 4.4% | 0.131 |
| 4.4% | 7.777 |
| 4.5% | 2.504 |
| 4.6% | 0.845 |
| 4.6% | 4.639 |
| 4.7% | 2.827 |
| 4.7% | 1.037 |
| 4.8% | 4.396 |
| 4.8% | −0.680 |
| 4.9% | 3.015 |
| 4.9% | 4.976 |
| 5.0% | 2.223 |

-continued

| Stretch | 7 Point Modulus |
|---|---|
| 5.1% | 2.288 |
| 5.1% | 1.501 |
| 5.2% | −0.534 |
| 5.2% | 3.253 |
| 5.3% | 1.184 |
| 5.3% | 0.749 |
| 5.4% | −0.231 |
| 5.4% | 0.069 |
| 5.5% | 2.161 |
| 5.6% | 6.864 |
| 5.6% | 1.515 |
| 5.7% | −0.281 |
| 5.7% | −2.001 |
| 5.8% | 2.136 |
| 5.8% | 4.216 |
| 5.9% | −0.066 |
| 5.9% | −0.596 |
| 6.0% | −0.031 |
| 6.1% | 1.187 |
| 6.1% | 1.689 |
| 6.2% | 1.424 |
| 6.2% | 1.363 |
| 6.3% | 3.877 |
| 6.3% | 0.712 |
| 6.4% | 1.810 |
| 6.4% | 2.368 |
| 6.5% | 1.531 |
| 6.6% | 1.984 |
| 6.6% | 0.014 |
| 6.7% | −4.405 |
| 6.7% | 1.606 |
| 6.8% | 2.634 |
| 6.8% | −0.467 |
| 6.9% | 1.865 |
| 6.9% | −3.493 |
| 7.0% | 1.088 |
| 7.1% | 7.333 |
| 7.1% | −0.900 |
| 7.2% | −2.607 |
| 7.2% | 3.199 |
| 7.3% | 1.892 |
| 7.3% | 1.306 |
| 7.4% | 1.063 |
| 7.4% | −0.836 |
| 7.5% | 1.785 |
| 7.6% | 4.308 |
| 7.6% | −0.647 |
| 7.7% | 2.090 |
| 7.7% | 2.956 |
| 7.8% | −0.666 |
| 7.8% | 1.187 |
| 7.9% | −0.059 |
| 7.9% | −2.503 |
| 8.0% | 0.420 |
| 8.1% | −0.130 |
| 8.1% | −1.059 |
| 8.2% | 4.016 |
| 8.2% | −0.561 |
| 8.3% | 0.784 |
| 8.3% | 4.101 |
| 8.4% | 3.313 |
| 8.4% | 1.557 |
| 8.5% | 1.425 |
| 8.6% | −1.135 |
| 8.6% | 3.694 |
| 8.7% | 0.668 |
| 8.7% | −1.626 |
| 8.8% | −0.210 |
| 8.8% | −0.014 |
| 8.9% | 2.920 |
| 8.9% | 3.213 |
| 9.0% | −0.456 |
| 9.1% | 3.403 |
| 9.1% | 2.034 |
| 9.2% | −1.436 |
| 9.2% | −2.670 |
| 9.3% | −0.091 |

-continued

| Stretch | 7 Point Modulus |
|---|---|
| 9.3% | −1.808 |
| 9.4% | 1.817 |
| 9.4% | −1.529 |
| 9.5% | −1.259 |
| 9.6% | 4.814 |
| 9.6% | 3.044 |
| 9.7% | 2.383 |
| 9.7% | 0.411 |
| 9.8% | −1.111 |
| 9.8% | 1.785 |
| 9.9% | 2.055 |
| 9.9% | −0.801 |
| 10.0% | 0.466 |
| 10.1% | −0.899 |
| 10.1% | 0.396 |
| 10.2% | 2.543 |
| 10.2% | 0.226 |
| 10.3% | 1.842 |
| 10.3% | −0.704 |
| 10.4% | 2.350 |
| 10.4% | 1.707 |
| 10.5% | 0.120 |
| 10.6% | 1.741 |
| 10.6% | 0.553 |
| 10.7% | −0.931 |
| 10.7% | −0.635 |
| 10.8% | 0.713 |
| 10.8% | 0.040 |
| 10.9% | 0.645 |
| 10.9% | 0.111 |
| 11.0% | 1.532 |
| 11.1% | 2.753 |
| 11.1% | 3.364 |
| 11.2% | −0.970 |
| 11.2% | −0.717 |
| 11.3% | 3.049 |
| 11.3% | −1.919 |
| 11.4% | 0.342 |
| 11.4% | 0.354 |
| 11.5% | −1.510 |
| 11.6% | 2.085 |
| 11.6% | 1.217 |
| 11.7% | −0.780 |
| 11.7% | 4.265 |
| 11.8% | −0.565 |
| 11.8% | 1.150 |
| 11.9% | 3.509 |
| 11.9% | 1.145 |
| 12.0% | 1.268 |
| 12.1% | 1.923 |
| 12.1% | −1.835 |
| 12.2% | 0.943 |
| 12.4% | 0.581 |
| 12.7% | 0.634 |
| 13.0% | 1.556 |
| 13.3% | 1.290 |
| 13.6% | 0.467 |
| 13.8% | 1.042 |
| 14.1% | 1.116 |
| 14.4% | 0.339 |
| 14.7% | 0.869 |
| 14.9% | −0.213 |
| 15.2% | 0.192 |
| 15.5% | 0.757 |
| 15.8% | 0.652 |
| 16.1% | 0.648 |
| 16.3% | 0.461 |
| 16.6% | 0.142 |
| 16.9% | 0.976 |
| 17.2% | 0.958 |
| 17.4% | 0.816 |
| 17.7% | 0.180 |
| 18.0% | 0.318 |
| 18.3% | 1.122 |
| 18.6% | 1.011 |
| 18.8% | 0.756 |
| 19.1% | 0.292 |

-continued

| Stretch | 7 Point Modulus |
|---|---|
| 19.4% | 0.257 |
| 19.7% | 1.411 |
| 19.9% | 1.295 |
| 20.2% | 0.467 |
| 20.5% | 0.858 |
| 20.8% | −0.177 |
| 21.1% | 1.148 |
| 21.3% | 1.047 |
| 21.6% | 0.758 |
| 21.9% | 0.056 |
| 22.2% | 1.050 |
| 22.4% | 0.450 |
| 22.7% | 1.128 |
| 23.0% | 0.589 |
| 23.3% | 0.679 |
| 23.6% | 0.618 |
| 23.8% | 1.539 |
| 24.1% | 0.867 |
| 24.4% | 1.251 |
| 24.7% | 1.613 |
| 24.9% | 0.798 |
| 25.2% | 0.959 |
| 25.5% | 0.896 |
| 25.8% | 0.533 |
| 26.1% | 1.354 |
| 26.3% | 0.530 |
| 26.6% | 0.905 |
| 26.9% | 1.304 |
| 27.2% | 1.596 |
| 27.4% | 1.333 |
| 27.7% | 1.307 |
| 28.0% | 0.425 |
| 28.3% | 1.695 |
| 28.6% | 0.966 |
| 28.8% | 0.425 |
| 29.1% | 0.100 |
| 29.4% | 0.774 |
| 29.7% | 1.388 |
| 29.9% | 1.413 |
| 30.2% | 0.636 |
| 30.5% | 1.316 |
| 30.8% | 1.738 |
| 31.1% | 1.870 |
| 31.3% | 1.460 |
| 31.6% | 1.317 |
| 31.9% | 1.209 |
| 32.2% | 1.623 |
| 32.4% | 1.304 |
| 32.7% | 1.434 |
| 33.0% | 1.265 |
| 33.3% | 1.649 |
| 33.6% | 1.194 |
| 33.8% | 1.354 |
| 34.1% | 0.968 |
| 34.4% | 0.932 |
| 34.7% | 1.107 |
| 34.9% | 1.554 |
| 35.2% | 0.880 |
| 35.5% | 1.389 |
| 35.8% | 1.876 |
| 36.1% | 1.733 |
| 36.3% | 2.109 |
| 36.6% | 1.920 |
| 36.9% | 1.854 |
| 37.2% | 1.480 |
| 37.4% | 1.780 |
| 37.7% | 1.441 |
| 38.0% | 2.547 |
| 38.3% | 1.780 |
| 38.6% | 1.762 |
| 38.8% | 2.129 |
| 39.1% | 2.132 |
| 39.4% | 1.968 |
| 39.7% | 2.307 |
| 39.9% | 1.983 |
| 40.2% | 1.929 |
| 40.5% | 2.692 |

-continued

| Stretch | 7 Point Modulus |
|---|---|
| 40.8% | 2.018 |
| 41.1% | 3.112 |
| 41.3% | 2.261 |
| 41.6% | 3.022 |
| 41.9% | 1.739 |
| 42.2% | 3.274 |
| 42.4% | 2.516 |
| 42.7% | 2.436 |
| 43.0% | 1.949 |
| 43.3% | 3.357 |
| 43.6% | 1.880 |
| 43.8% | 3.140 |
| 44.1% | 2.899 |
| 44.4% | 2.993 |
| 44.7% | 3.665 |
| 44.9% | 3.671 |
| 45.2% | 2.694 |
| 45.5% | 4.047 |
| 45.8% | 3.875 |
| 46.1% | 2.465 |
| 46.3% | 3.712 |
| 46.6% | 3.560 |
| 46.9% | 2.967 |
| 47.2% | 3.945 |
| 47.4% | 3.337 |
| 47.7% | 4.052 |
| 48.0% | 5.070 |
| 48.3% | 4.113 |
| 48.6% | 4.044 |
| 48.8% | 4.366 |
| 49.1% | 4.639 |
| 49.4% | 5.178 |
| 49.7% | 4.315 |
| 49.9% | 4.674 |
| 50.2% | 4.061 |
| 50.5% | 4.884 |
| 50.8% | 6.005 |
| 51.1% | 5.250 |
| 51.3% | 4.888 |
| 51.6% | 4.868 |
| 51.9% | 5.304 |
| 52.2% | 5.920 |
| 52.4% | 5.849 |
| 52.7% | 4.768 |
| 53.0% | 5.280 |
| 53.3% | 5.097 |
| 53.6% | 6.320 |
| 53.8% | 5.780 |
| 54.1% | 6.064 |
| 54.4% | 5.595 |
| 54.7% | 6.350 |
| 54.9% | 5.647 |
| 55.2% | 6.049 |
| 55.5% | 5.907 |
| 55.8% | 5.092 |
| 56.1% | 5.315 |
| 56.3% | 5.821 |
| 56.6% | 5.179 |
| 56.9% | 5.790 |
| 57.2% | 6.432 |
| 57.4% | 5.358 |
| 57.7% | 5.858 |
| 57.8% | 5.528 |
| 58.1% | −0.539 |
| 58.3% | −4.473 |
| 58.6% | −7.596 |
| 58.8% | −16.304 |
| 59.1% | −19.957 |
| 59.3% | −27.423 |
| 59.6% | −24.870 |
| 59.8% | −24.354 |
| 60.1% | −26.042 |
| 60.2% | −33.413 |
| 60.3% | −33.355 |
| 60.4% | −39.617 |
| 60.5% | −49.495 |
| 60.8% | −54.166 |

-continued

| Stretch | 7 Point Modulus |
|---|---|
| 0.0% | |
| 0.0% | |
| 0.1% | |
| 0.2% | |
| 0.2% | |
| 0.3% | |
| 0.3% | |
| 0.4% | |
| 0.4% | −1.070 |
| 0.5% | 1.632 |
| 0.6% | −0.636 |
| 0.6% | 2.379 |
| 0.7% | −0.488 |
| 0.7% | −0.594 |
| 0.8% | 4.041 |
| 0.8% | 2.522 |
| 0.9% | −1.569 |
| 0.9% | 0.684 |
| 1.0% | −1.694 |
| 1.1% | 1.769 |
| 1.1% | 1.536 |
| 1.2% | −1.383 |
| 1.2% | −1.222 |
| 1.3% | 0.462 |
| 1.3% | 3.474 |
| 1.4% | 4.228 |
| 1.4% | −1.074 |
| 1.5% | 0.133 |
| 1.6% | −0.563 |
| 1.6% | 1.659 |
| 1.7% | 0.430 |
| 1.7% | 0.204 |
| 1.8% | −2.271 |
| 1.8% | 0.536 |
| 1.9% | 0.850 |
| 1.9% | 1.918 |
| 2.0% | 3.341 |
| 2.1% | 3.455 |
| 2.1% | 1.837 |
| 2.2% | 1.079 |
| 2.2% | 1.027 |
| 2.3% | 1.637 |
| 2.3% | 1.999 |
| 2.4% | 0.340 |
| 2.4% | 0.744 |
| 2.5% | 1.202 |
| 2.6% | 2.405 |
| 2.6% | 1.714 |
| 2.7% | −0.616 |
| 2.7% | −0.934 |
| 2.8% | −1.307 |
| 2.8% | 0.976 |
| 2.9% | 1.584 |
| 2.9% | 2.162 |
| 3.0% | 1.594 |
| 3.1% | 2.895 |
| 3.1% | 1.606 |
| 3.2% | 4.526 |
| 3.2% | 1.075 |
| 3.3% | 1.206 |
| 3.3% | 0.414 |
| 3.4% | 0.611 |
| 3.4% | −0.006 |
| 3.5% | 3.757 |
| 3.6% | −0.541 |
| 3.6% | 0.524 |
| 3.7% | −0.531 |
| 3.7% | −0.563 |
| 3.8% | 2.439 |
| 3.8% | 2.976 |
| 3.9% | −1.508 |
| 3.9% | 0.142 |
| 4.0% | 2.031 |
| 4.1% | 2.765 |
| 4.1% | 1.384 |
| 4.2% | 2.172 |
| 4.2% | −0.561 |

-continued

| Stretch | 7 Point Modulus |
|---|---|
| 4.3% | 2.293 |
| 4.3% | 0.745 |
| 4.4% | 1.172 |
| 4.4% | −2.196 |
| 4.5% | 0.657 |
| 4.6% | −1.475 |
| 4.6% | 1.805 |
| 4.7% | −0.679 |
| 4.7% | 1.787 |
| 4.8% | 3.364 |
| 4.8% | 3.989 |
| 4.9% | 0.673 |
| 4.9% | 2.903 |
| 5.0% | −0.233 |
| 5.1% | 1.353 |
| 5.1% | 2.525 |
| 5.2% | −1.461 |
| 5.2% | 0.923 |
| 5.3% | 3.618 |
| 5.3% | 1.279 |
| 5.4% | 1.515 |
| 5.4% | 1.022 |
| 5.5% | −1.682 |
| 5.6% | 1.089 |
| 5.6% | −1.423 |
| 5.7% | −0.381 |
| 5.7% | 0.464 |
| 5.8% | 3.053 |
| 5.8% | 1.658 |
| 5.9% | 4.678 |
| 5.9% | 3.621 |
| 6.0% | 1.960 |
| 6.1% | 1.921 |
| 6.1% | 0.775 |
| 6.2% | 1.072 |
| 6.2% | 1.441 |
| 6.3% | −1.200 |
| 6.3% | 0.089 |
| 6.4% | 2.611 |
| 6.4% | 2.132 |
| 6.5% | 0.832 |
| 6.6% | 0.665 |
| 6.6% | 3.531 |
| 6.7% | 2.040 |
| 6.7% | 0.289 |
| 6.8% | 0.654 |
| 6.8% | 2.516 |
| 6.9% | 2.139 |
| 6.9% | 1.454 |
| 7.0% | −0.256 |
| 7.1% | 2.056 |
| 7.1% | 2.278 |
| 7.2% | 3.943 |
| 7.2% | 0.398 |
| 7.3% | 2.336 |
| 7.3% | −1.757 |
| 7.4% | 1.079 |
| 7.4% | 0.113 |
| 7.5% | −0.534 |
| 7.6% | −2.582 |
| 7.6% | 0.738 |
| 7.7% | −1.566 |
| 7.7% | 4.872 |
| 7.8% | 0.032 |
| 7.8% | 0.591 |
| 7.9% | 2.197 |
| 7.9% | 3.343 |
| 8.0% | −0.128 |
| 8.1% | 2.866 |
| 8.1% | 1.846 |
| 8.2% | 2.232 |
| 8.2% | 2.015 |
| 8.3% | 1.955 |
| 8.3% | 1.117 |
| 8.4% | 2.535 |
| 8.4% | 0.939 |
| 8.5% | 0.684 |

-continued

| Stretch | 7 Point Modulus |
|---|---|
| 8.6% | 1.770 |
| 8.6% | 1.808 |
| 8.7% | 0.904 |
| 8.7% | 0.990 |
| 8.8% | 1.683 |
| 8.8% | 1.088 |
| 8.9% | 0.840 |
| 8.9% | 1.290 |
| 9.0% | 1.118 |
| 9.1% | 1.210 |
| 9.1% | 1.270 |
| 9.2% | 0.469 |
| 9.2% | 0.958 |
| 9.3% | 1.209 |
| 9.3% | 0.845 |
| 9.4% | 0.841 |
| 9.4% | 1.195 |
| 9.5% | 1.445 |
| 9.6% | 1.655 |
| 9.8% | 1.449 |
| 10.1% | 1.206 |
| 10.4% | 1.309 |
| 10.7% | 1.269 |
| 10.9% | 1.102 |
| 11.2% | 1.258 |
| 11.5% | 0.870 |
| 11.8% | 1.237 |
| 12.1% | 0.804 |
| 12.3% | 1.020 |
| 12.6% | 0.753 |
| 12.9% | 1.285 |
| 13.2% | 0.813 |
| 13.4% | 1.073 |
| 13.7% | 0.870 |
| 14.0% | 1.327 |
| 14.3% | 1.693 |
| 14.6% | 0.992 |
| 14.8% | 1.296 |
| 15.1% | 1.329 |
| 15.4% | 1.372 |
| 15.7% | 1.292 |
| 15.9% | 1.045 |
| 16.2% | 0.377 |
| 16.5% | 1.694 |
| 16.8% | 0.310 |
| 17.1% | 0.637 |
| 17.3% | 0.929 |
| 17.6% | 1.506 |
| 17.9% | 1.005 |
| 18.2% | 1.360 |
| 18.4% | 0.723 |
| 18.7% | 1.746 |
| 19.0% | 1.706 |
| 19.3% | 1.339 |
| 19.6% | 0.488 |
| 19.8% | 1.269 |
| 20.1% | 0.884 |
| 20.4% | 1.600 |
| 20.7% | 0.979 |
| 20.9% | 0.969 |
| 21.2% | 0.970 |
| 21.5% | 1.395 |
| 21.8% | 1.352 |
| 22.1% | 1.175 |
| 22.3% | 0.860 |
| 22.6% | 0.895 |
| 22.9% | 1.456 |
| 23.2% | 1.254 |
| 23.4% | 1.140 |
| 23.7% | 0.913 |
| 24.0% | 1.293 |
| 24.3% | 0.674 |
| 24.6% | 1.326 |
| 24.8% | 1.071 |
| 25.1% | 1.386 |
| 25.4% | 1.253 |
| 25.7% | 1.467 |

-continued

| Stretch | 7 Point Modulus |
|---|---|
| 25.9% | 1.078 |
| 26.2% | 1.772 |
| 26.5% | 1.464 |
| 26.8% | 1.177 |
| 27.1% | 1.125 |
| 27.3% | 0.929 |
| 27.6% | 1.538 |
| 27.9% | 2.302 |
| 28.2% | 1.871 |
| 28.4% | 1.425 |
| 28.7% | 1.751 |
| 29.0% | 1.368 |
| 29.3% | 2.044 |
| 29.6% | 1.522 |
| 29.8% | 0.797 |
| 30.1% | 1.208 |
| 30.4% | 1.567 |
| 30.7% | 1.396 |
| 30.9% | 2.030 |
| 31.2% | 1.196 |
| 31.5% | 1.311 |
| 31.8% | 1.528 |
| 32.1% | 1.803 |
| 32.3% | 1.424 |
| 32.6% | 1.627 |
| 32.9% | 1.458 |
| 33.2% | 2.377 |
| 33.4% | 2.158 |
| 33.7% | 1.866 |
| 34.0% | 1.749 |
| 34.3% | 1.924 |
| 34.6% | 2.075 |
| 34.8% | 2.551 |
| 35.1% | 1.869 |
| 35.4% | 2.248 |
| 35.7% | 2.498 |
| 35.9% | 2.400 |
| 36.2% | 3.339 |
| 36.5% | 2.649 |
| 36.8% | 2.267 |
| 37.1% | 2.878 |
| 37.3% | 2.005 |
| 37.6% | 2.636 |
| 37.9% | 2.793 |
| 38.2% | 2.104 |
| 38.4% | 2.511 |
| 38.7% | 2.605 |
| 39.0% | 2.521 |
| 39.3% | 2.875 |
| 39.6% | 2.766 |
| 39.8% | 2.753 |
| 40.1% | 2.619 |
| 40.4% | 2.698 |
| 40.7% | 3.165 |
| 40.9% | 3.134 |
| 41.2% | 4.025 |
| 41.5% | 4.118 |
| 41.8% | 4.165 |
| 42.1% | 3.912 |
| 42.3% | 4.667 |
| 42.6% | 3.692 |
| 42.9% | 3.871 |
| 43.2% | 3.261 |
| 43.4% | 3.661 |
| 43.7% | 3.470 |
| 44.0% | 4.725 |
| 44.3% | 3.424 |
| 44.6% | 3.444 |
| 44.8% | 4.148 |
| 45.1% | 5.041 |
| 45.4% | 3.676 |
| 45.7% | 4.125 |
| 45.9% | 3.372 |
| 46.2% | 3.748 |
| 46.5% | 4.368 |
| 46.8% | 3.565 |
| 46.8% | 3.132 |

-continued

| Stretch | 7 Point Modulus |
|---|---|
| 47.1% | 2.726 |
| 47.4% | −4.019 |
| 47.4% | −10.656 |
| 47.5% | −21.712 |

-continued

| Stretch | 7 Point Modulus |
|---|---|
| 47.6% | −45.557 |
| 47.6% | −62.257 |

TABLE 8

Caliper Gain Comparison

| Roll Number Count | Vac Level | Long Fabric Strands to Sheet | Molding Box Slot Width. Inches | Fabric Crepe Ratio | Caliper mils/ 8 sht | Basis Weight Lb/3000 ft^2 | Tensile GM g/3 in. | Cal/Bwt cc/gram | Void Volume grams/ gram |
|---|---|---|---|---|---|---|---|---|---|
| Representative Examples 35-56 | | | | | | | | | |
| 7306 | 0 | MD | 0.25 | 1.30 | 65.18 | 13.82 | 718 | 9.2 | 7.4 |
| 7307 | 10 | MD | 0.25 | 1.30 | 77.05 | 13.21 | 624 | 11.4 | 7.6 |
| 7308 | 5 | MD | 1.50 | 1.30 | 68.60 | 13.51 | 690 | 9.9 | 7.2 |
| 7309 | 10 | MD | 1.50 | 1.30 | 77.70 | 13.25 | 575 | 11.4 | 6.7 |
| 7310 | 20 | MD | 0.25 | 1.30 | 88.75 | 13.19 | 535 | 13.1 | 8.2 |
| 7311 | 20 | MD | 0.25 | 1.30 | 91.05 | 13.24 | 534 | 13.4 | 8.2 |
| 7312 | 20 | MD | 1.50 | 1.30 | 87.73 | 13.23 | 561 | 12.9 | 8.4 |
| 7313 | 0 | MD | 1.50 | 1.33 | 64.83 | 13.50 | 619 | 9.4 | |
| 7314 | 0 | MD | 1.50 | 1.30 | 64.18 | 13.47 | 611 | 9.3 | |
| 7315 | 5 | MD | 0.25 | 1.30 | 70.55 | 13.38 | 653 | 10.3 | |
| 7316 | 0 | MD | 0.25 | 1.15 | 52.58 | 13.23 | 1063 | 7.7 | |
| 7317 | 0 | MD | 0.25 | 1.15 | 53.05 | 13.12 | 970 | 7.9 | 6.3 |
| 7318 | 5 | MD | 0.25 | 1.15 | 57.40 | 13.20 | 1032 | 8.5 | 6.5 |
| 7319 | 10 | MD | 0.25 | 1.15 | 62.45 | 13.01 | 969 | 9.4 | 6.7 |
| 7320 | 5 | MD | 1.50 | 1.15 | 54.65 | 12.98 | 1018 | 8.2 | 6.0 |
| 7321 | 10 | MD | 1.50 | 1.15 | 62.43 | 13.02 | 991 | 9.3 | 6.2 |
| 7322 | 20 | MD | 1.50 | 1.15 | 71.40 | 13.08 | 869 | 10.6 | 7.5 |
| 7323 | 24 | MD | 0.25 | 1.15 | 77.68 | 13.21 | 797 | 11.5 | |
| 7324 | 0 | MD | 0.25 | 1.15 | 75.75 | 23.53 | 1518 | 6.3 | |
| 7325 | 0 | MD | 0.25 | 1.15 | 78.90 | 24.13 | 1488 | 6.4 | |
| 7326 | 0 | MD | 0.25 | 1.15 | 78.40 | 24.53 | 1412 | 6.2 | 5.8 |
| 7327 | 15 | MD | 0.25 | 1.15 | 83.93 | 24.09 | 1314 | 6.8 | 6.1 |
| Representative Examples 57-78 | | | | | | | | | |
| 7328 | 10 | MD | 1.50 | 1.15 | 83.18 | 24.15 | 1280 | 6.7 | 6.2 |
| 7329 | 20 | MD | 0.25 | 1.15 | 88.35 | 24.33 | 1316 | 7.1 | 6.2 |
| 7330 | 15 | MD | 1.50 | 1.15 | 86.55 | 24.40 | 1364 | 6.9 | 6.3 |
| 7331 | 24 | MD | 1.50 | 1.15 | 93.03 | 24.43 | 1333 | 7.4 | 6.4 |
| 7332 | 24 | MD | 0.25 | 1.15 | 93.13 | 24.62 | 1264 | 7.4 | 6.5 |
| 7333 | 5 | MD | 0.25 | 1.15 | 79.10 | 24.68 | 1537 | 6.2 | 5.9 |
| 7334 | 0 | MD | 0.25 | 1.30 | 92.00 | 25.16 | 779 | 7.1 | |
| 7335 | 0 | MD | 0.25 | 1.30 | 90.98 | 24.89 | 1055 | 7.1 | |
| 7336 | 0 | MD | 0.25 | 1.30 | 91.45 | 24.15 | 1016 | 7.4 | 6.3 |
| 7337 | 5 | MD | 0.25 | 1.30 | 90.13 | 23.98 | 1022 | 7.3 | 6.5 |
| 7338 | 10 | MD | 0.25 | 1.30 | 94.93 | 23.92 | 980 | 7.7 | 6.6 |
| 7339 | 5 | MD | 1.50 | 1.30 | 95.23 | 24.05 | 1081 | 7.7 | 6.6 |
| 7340 | 20 | MD | 0.25 | 1.30 | 103.20 | 23.43 | 961 | 8.6 | |
| 7341 | 15 | MD | 1.50 | 1.30 | 99.88 | 23.60 | 996 | 8.2 | 6.5 |
| 7342 | 20 | MD | 1.50 | 1.30 | 104.83 | 24.13 | 934 | 8.5 | 7.1 |
| 7343 | 24 | MD | 0.25 | 1.30 | 106.20 | 23.98 | 903 | 8.6 | 6.7 |
| 7344 | 24 | MD | 0.25 | 1.30 | 111.20 | 23.93 | 876 | 9.1 | |
| 7345 | 0 | MD | 0.25 | 1.30 | 92.08 | 24.44 | 967 | 7.3 | 6.7 |
| 7346 | 15 | MD | 0.25 | 1.30 | 102.90 | 23.89 | 788 | 8.4 | 7.2 |
| 7347 | 15 | MD | 0.25 | 1.15 | 91.68 | 24.15 | 1159 | 7.4 | 6.5 |
| 7348 | 0 | MD | 0.25 | 1.15 | 83.98 | 24.27 | 1343 | 6.7 | 6.5 |
| 7349 | 24 | MD | 0.25 | 1.15 | 96.43 | 23.91 | 1146 | 7.9 | 6.9 |
| Representative Examples 79-100 | | | | | | | | | |
| 7351 | 0 | CD | 0.25 | 1.15 | 86.65 | 24.33 | | 1709 | 6.9 |
| 7352 | 0 | CD | 0.25 | 1.15 | 87.60 | 24.62 | 1744 | 6.9 | 5.9 |
| 7353 | 5 | CD | 0.25 | 1.15 | 88.60 | 24.76 | 1681 | 7.0 | 5.6 |
| 7354 | 15 | CD | 0.25 | 1.15 | 100.58 | 24.50 | 1614 | 8.0 | 6.2 |
| 7355 | 24 | CD | 0.25 | 1.15 | 100.33 | 24.44 | 1638 | 8.0 | 6.3 |
| 7356 | 0 | CD | 1.50 | 1.15 | 88.40 | 24.18 | 1548 | 7.1 | |
| 7357 | 0 | CD | 1.50 | 1.15 | 87.05 | 24.12 | 1565 | 7.0 | |
| 7358 | 24 | CD | 1.50 | 1.15 | 99.30 | 24.17 | 1489 | 8.0 | |
| 7359 | 24 | CD | 0.25 | 1.15 | 104.08 | 24.21 | 1407 | 8.4 | |
| 7360 | 0 | CD | 0.25 | 1.15 | 91.18 | 24.13 | 1415 | 7.4 | 6.3 |
| 7361 | 5 | CD | 0.25 | 1.15 | 92.43 | 24.18 | 1509 | 7.4 | 6.3 |

TABLE 8-continued

| Caliper Gain Comparison | | | | | | | | | |
|---|---|---|---|---|---|---|---|---|---|
| Roll Number Count | Vac Level | Long Fabric Strands to Sheet | Molding Box Slot Width. Inches | Fabric Crepe Ratio | Caliper mils/ 8 sht | Basis Weight Lb/3000 ft^2 | Tensile GM g/3 in. | Cal/Bwt cc/gram | Void Volume grams/ gram |
| 7362 | 15 | CD | 0.25 | 1.15 | 102.15 | 24.21 | 1506 | 8.2 | 6.7 |
| 7363 | 24 | CD | 0.25 | 1.15 | 104.50 | 24.58 | 1476 | 8.3 | 6.7 |
| 7364 | 24 | CD | 0.25 | 1.30 | 119.45 | 24.72 | 1056 | 9.4 | |
| 7365 | 24 | CD | 0.25 | 1.30 | 123.25 | 24.46 | 952 | 9.8 | |
| 7366 | 24 | CD | 0.25 | 1.30 | 124.30 | 24.62 | 1041 | 9.8 | 7.0 |
| 7367 | 0 | CD | 0.25 | 1.30 | 100.18 | 24.52 | 1019 | 8.0 | 6.6 |
| 7368 | 15 | CD | 0.25 | 1.30 | 113.95 | 24.29 | 1023 | 9.1 | 6.8 |
| 7369 | 5 | CD | 0.25 | 1.30 | 106.55 | 24.56 | 1106 | 8.5 | 6.6 |
| 7370 | 0 | CD | 0.25 | 1.30 | 96.28 | 24.68 | 1238 | 7.6 | 6.1 |
| 7371 | 5 | CD | 0.25 | 1.30 | 98.80 | 24.65 | 1239 | 7.8 | 6.1 |
| 7372 | 15 | CD | 0.25 | 1.30 | 109.80 | 24.64 | 1110 | 8.7 | 6.4 |
| Representative Examples 101-122 | | | | | | | | | |
| 7373 | 24 | CD | 0.25 | 1.30 | 114.65 | 24.75 | 1182 | 9.0 | 6.6 |
| 7376 | 0 | CD | 0.25 | 1.30 | 70.88 | 13.32 | 723 | 10.4 | 6.5 |
| 7377 | 5 | CD | 0.25 | 1.30 | 80.48 | 13.38 | 629 | 11.7 | 7.5 |
| 7378 | 15 | CD | 0.25 | 1.30 | 100.90 | 13.71 | 503 | 14.3 | 8.9 |
| 7379 | 20 | CD | 0.25 | 1.30 | 112.55 | 13.87 | 468 | 15.8 | 9.2 |
| 7380 | 20 | CD | 0.25 | 1.30 | 112.60 | 12.80 | 345 | 17.1 | 9.8 |
| 7381 | 15 | CD | 0.25 | 1.30 | 103.93 | 12.96 | 488 | 15.6 | 9.1 |
| 7382 | 5 | CD | 0.25 | 1.30 | 91.35 | 13.06 | 499 | 13.6 | 7.8 |
| 7383 | 0 | CD | 0.25 | 1.30 | 73.03 | 13.17 | 613 | 10.8 | 8.1 |
| 7386 | 0 | CD | 0.25 | 1.15 | 59.35 | 13.21 | 1138 | 8.8 | 5.9 |
| 7387 | 5 | CD | 0.25 | 1.15 | 64.35 | 13.20 | 1153 | 9.5 | 6.1 |
| 7388 | 15 | CD | 0.25 | 1.15 | 77.43 | 13.22 | 1109 | 11.4 | 6.7 |
| 7389 | 24 | CD | 0.25 | 1.15 | 83.38 | 13.31 | 971 | 12.2 | 7.4 |
| 7390 | 24 | CD | 0.25 | 1.15 | 87.28 | 13.20 | 895 | 12.9 | 7.6 |
| 7391 | 15 | CD | 0.25 | 1.15 | 82.58 | 13.02 | 935 | 12.4 | 7.2 |
| 7392 | 5 | CD | 0.25 | 1.15 | 68.58 | 12.97 | 1000 | 10.3 | 6.2 |
| 7393 | 0 | CD | 0.25 | 1.15 | 61.40 | 12.92 | 952 | 9.3 | 6.3 |
| 7394 | 0 | CD | 0.25 | 1.15 | 57.35 | 12.67 | 878 | 8.8 | |
| 7395 | 0 | CD | 0.25 | 1.15 | 57.45 | 12.83 | 924 | 8.7 | |
| 7396 | 0 | CD | 0.25 | 1.15 | 58.50 | 13.50 | 1053 | 8.4 | 6.2 |
| 7397 | 5 | CD | 0.25 | 1.15 | 63.75 | 13.20 | 1094 | 9.4 | 6.5 |
| 7398 | 15 | CD | 0.25 | 1.15 | 79.08 | 13.95 | 878 | 11.0 | 6.9 |
| Representative Examples 123-144 | | | | | | | | | |
| 7399 | 24 | CD | 0.25 | 1.15 | 82.50 | 13.44 | 811 | 12.0 | 6.7 |
| 7400 | 24 | CD | 0.25 | 1.30 | 96.88 | 13.68 | 566 | 13.8 | |
| 7401 | 24 | CD | 0.25 | 1.30 | 96.78 | 13.70 | 556 | 13.8 | 7.9 |
| 7402 | 15 | CD | 0.25 | 1.30 | 91.00 | 13.75 | 585 | 12.9 | 8.1 |
| 7403 | 5 | CD | 0.25 | 1.30 | 76.03 | 13.50 | 633 | 11.0 | 6.9 |
| 7404 | 0 | CD | 0.25 | 1.30 | 69.98 | 13.19 | 605 | 10.3 | 7.2 |
| 7405 | 0 | CD | 0.25 | 1.30 | 96.58 | 24.55 | 1091 | 7.7 | |
| 7406 | 0 | CD | 0.25 | 1.30 | 94.05 | 24.17 | 1023 | 7.6 | 6.4 |
| 7407 | 5 | CD | 0.25 | 1.30 | 93.65 | 24.41 | 888 | 7.5 | 6.5 |
| 7408 | 15 | CD | 0.25 | 1.30 | 99.13 | 24.31 | 1051 | 7.9 | 7.0 |
| 7409 | 24 | CD | 0.25 | 1.30 | 104.48 | 24.47 | 988 | 8.3 | 7.0 |
| 7410 | 24 | CD | 0.25 | 1.15 | 100.38 | 24.40 | 1278 | 8.0 | |
| 7411 | 24 | CD | 0.25 | 1.15 | 97.33 | 24.33 | 1302 | 7.8 | |
| 7412 | 24 | CD | 0.25 | 1.15 | 96.83 | 24.73 | 1311 | 7.6 | |
| 7413 | 24 | CD | 0.25 | 1.15 | 96.00 | 24.58 | 1291 | 7.6 | 5.9 |
| 7414 | 15 | CD | 0.25 | 1.15 | 91.88 | 24.41 | 1477 | 7.3 | 6.2 |
| 7415 | 5 | CD | 0.25 | 1.15 | 84.88 | 24.37 | 1521 | 6.8 | 6.0 |
| 7416 | 0 | CD | 0.25 | 1.15 | 83.60 | 23.89 | 1531 | 6.8 | 6.1 |
| 7417 | 0 | CD | 0.25 | 1.15 | 85.33 | 23.72 | 1310 | 7.0 | 6.2 |
| 7418 | 24 | CD | 0.25 | 1.15 | 103.48 | 24.05 | 1252 | 8.4 | 6.1 |
| 7419 | 24 | CD | 0.25 | 1.30 | 108.75 | 24.37 | 979 | 8.7 | |
| 7420 | 24 | CD | 0.25 | 1.30 | 113.00 | 24.23 | 967 | 9.1 | 7.4 |
| Representative Examples 145-166 | | | | | | | | | |
| 7421 | 0 | CD | 0.25 | 1.30 | 94.43 | 24.27 | 954 | 7.6 | 6.6 |
| 7423 | 0 | MD | 0.25 | 1.30 | 94.00 | 24.75 | 1164 | 7.4 | |
| 7424 | 0 | MD | 0.25 | 1.30 | 93.83 | 24.41 | 969 | 7.5 | 6.5 |
| 7425 | 5 | MD | 0.25 | 1.30 | 94.55 | 23.96 | 1018 | 7.7 | 6.8 |
| 7426 | 15 | MD | 0.25 | 1.30 | 110.53 | 24.17 | 1018 | 8.9 | 6.7 |
| 7427 | 24 | MD | 0.25 | 1.30 | 115.93 | 24.39 | 997 | 9.3 | 6.9 |
| 7428 | 24 | MD | 0.25 | 1.30 | 122.83 | 23.86 | 834 | 10.0 | |
| 7429 | 0 | MD | 0.25 | 1.30 | 95.40 | 23.88 | 915 | 7.8 | |
| 7430 | 0 | MD | 0.25 | 1.15 | 78.25 | 24.15 | 1424 | 6.3 | |
| 7431 | 0 | MD | 0.25 | 1.15 | 80.30 | 23.60 | 1365 | 6.6 | |
| 7432 | 0 | MD | 0.25 | 1.15 | 80.53 | 23.91 | 1418 | 6.6 | 6.0 |
| 7433 | 5 | MD | 0.25 | 1.15 | 81.50 | 24.37 | 1432 | 6.5 | 5.9 |

TABLE 8-continued

| Caliper Gain Comparison | | | | | | | | | |
|---|---|---|---|---|---|---|---|---|---|
| Roll Number Count | Vac Level | Long Fabric Strands to Sheet | Molding Box Slot Width. Inches | Fabric Crepe Ratio | Caliper mils/ 8 sht | Basis Weight Lb/3000 ft^2 | Tensile GM g/3 in. | Cal/Bwt cc/gram | Void Volume grams/ gram |
| 7434 | 15 | MD | 0.25 | 1.15 | 94.43 | 23.84 | 1349 | 7.7 | 6.2 |
| 7435 | 24 | MD | 0.25 | 1.15 | 101.90 | 24.22 | 1273 | 8.2 | 6.6 |
| 7438 | 0 | MD | 0.25 | 1.30 | 72.53 | 13.82 | 475 | 10.2 | |
| 7439 | 0 | MD | 0.25 | 1.30 | 71.63 | 13.47 | 478 | 10.4 | 7.9 |
| 7440 | 5 | MD | 0.25 | 1.30 | 82.75 | 13.70 | 541 | 11.8 | 7.7 |
| 7441 | 15 | MD | 0.25 | 1.30 | 102.48 | 13.77 | 529 | 14.5 | 7.8 |
| 7442 | 24 | MD | 0.25 | 1.30 | 104.23 | 13.80 | 502 | 14.7 | 8.3 |
| 7446 | 0 | MD | 0.25 | 1.30 | 87.08 | 24.39 | 1155 | 7.0 | |
| 7447 | 0 | MD | 0.25 | 1.30 | 88.53 | 24.41 | 1111 | 7.1 | |
| 7448 | 5 | MD | 0.25 | 1.30 | 90.60 | 24.50 | 1105 | 7.2 | 6.5 |
| Representative Examples 167-187 | | | | | | | | | |
| 7449 | 5 | MD | 0.25 | 1.30 | 89.15 | 24.59 | 1085 | 7.1 | 6.3 |
| 7450 | 15 | MD | 0.25 | 1.30 | 99.03 | 24.26 | 1014 | 8.0 | 6.8 |
| 7451 | 24 | MD | 0.25 | 1.30 | 106.90 | 24.54 | 960 | 8.5 | 7.4 |
| 7452 | 24 | MD | 0.25 | 1.15 | 87.23 | 23.90 | 1346 | 7.1 | |
| 7453 | 24 | MD | 0.25 | 1.15 | 94.05 | 23.54 | 1207 | 7.8 | 7.2 |
| 7454 | 15 | MD | 0.25 | 1.15 | 87.38 | 24.15 | 1363 | 7.1 | 6.2 |
| 7455 | 5 | MD | 0.25 | 1.15 | 79.40 | 24.27 | 1476 | 6.4 | 5.9 |
| 7456 | 0 | MD | 0.25 | 1.15 | 79.45 | 23.89 | 1464 | 6.5 | 6.1 |
| 7457 | 0 | CD | 0.25 | 1.15 | 88.00 | 24.48 | 1667 | 7.0 | |
| 7458 | 0 | CD | 0.25 | 1.15 | 88.43 | 24.15 | 1705 | 7.1 | |
| 7459 | 0 | CD | 0.25 | 1.15 | 87.88 | 24.32 | 1663 | 7.0 | 6.0 |
| 7460 | 5 | CD | 0.25 | 1.15 | 87.13 | 24.01 | 1639 | 7.1 | 6.2 |
| 7461 | 15 | CD | 0.25 | 1.15 | 99.50 | 24.18 | 1580 | 8.0 | 6.7 |
| 7462 | 24 | CD | 0.25 | 1.15 | 107.68 | 24.58 | 1422 | 8.5 | 7.3 |
| 7463 | 24 | CD | 0.25 | 1.30 | 118.33 | 25.38 | 1008 | 9.1 | |
| 7464 | 24 | CD | 0.25 | 1.30 | 123.75 | 24.57 | 1056 | 9.8 | |
| 7465 | 24 | CD | 0.25 | 1.30 | 120.00 | 24.86 | 1035 | 9.4 | |
| 7466 | 15 | CD | 0.25 | 1.30 | 113.10 | 24.28 | 1072 | 9.1 | 6.4 |
| 7467 | 15 | CD | 0.25 | 1.30 | 110.25 | 24.49 | 1092 | 8.8 | 7.2 |
| 7468 | 0 | CD | 0.25 | 1.30 | 97.70 | 24.38 | 1095 | 7.8 | 6.5 |
| 7469 | 0 | CD | 0.25 | 1.30 | 96.83 | 23.09 | 1042 | 8.2 | 5.6 |

TABLE 9

| Caliper Change With Vacuum | | | | | | | |
|---|---|---|---|---|---|---|---|
| Fabric Ct | Fabric Type | Fabric Orient-ation | Basis Weight | Fabric Crepe Ratio | Slope | Inter-cept | Caliper @ 25 in Hg |
| 44 | M | MD | 13 | 1.15 | 1.0369 | 51.7 | 77.6 |
| 44 | G | CD | 13 | 1.15 | 1.1449 | 57.9 | 86.6 |
| 44 | M | CD | 13 | 1.15 | 1.1464 | 59.8 | 88.4 |
| 44 | M | MD | 13 | 1.30 | 1.3260 | 64.0 | 97.1 |
| 44 | G | CD | 13 | 1.30 | 1.1682 | 70.5 | 99.7 |
| 44 | G | MD | 13 | 1.30 | 1.5370 | 73.2 | 111.6 |
| 44 | M | CD | 13 | 1.30 | 1.9913 | 72.6 | 122.4 |
| 36 | M | MD | 24 | 1.15 | 0.5189 | 78.4 | 91.4 |
| 44 | M | MD | 24 | 1.15 | 0.6246 | 78.2 | 93.8 |
| 44 | G | CD | 24 | 1.15 | 0.6324 | 83.3 | 99.2 |
| 44 | G | MD | 24 | 1.15 | 0.9689 | 78.9 | 103.1 |
| 44 | M | CD | 24 | 1.15 | 0.6295 | 88.1 | 103.8 |
| 36 | M | CD | 24 | 1.15 | 0.8385 | 86.7 | 107.7 |
| 44 | M | MD | 24 | 1.30 | 0.6771 | 90.2 | 107.1 |
| 36 | M | MD | 24 | 1.30 | 0.8260 | 86.6 | 107.2 |
| 44 | G | CD | 24 | 1.30 | 0.5974 | 93.5 | 108.4 |
| 44 | G | MD | 24 | 1.30 | 1.1069 | 92.7 | 120.4 |
| 44 | M | CD | 24 | 1.30 | 0.9261 | 97.6 | 120.7 |
| 36 | M | CD | 24 | 1.30 | 0.9942 | 96.7 | 121.6 |

TABLE 10

| Void Volume Change With Vacuum | | | | | | | |
|---|---|---|---|---|---|---|---|
| Fabric Ct | Fabric Type | Fabric Orient-ation | Basis Weight | Fabric Crepe Ratio | Slope | Inter-cept | VV @ 25 in Hg |
| 44 | G | CD | 13 | 1.15 | 0.0237 | 6.3 | 6.9 |
| 44 | M | CD | 13 | 1.15 | 0.0617 | 6.0 | 7.5 |
| 44 | M | MD | 13 | 1.15 | 0.0653 | 6.0 | 7.6 |
| 44 | G | MD | 13 | 1.30 | 0.0431 | 7.0 | 8.1 |
| 44 | G | CD | 13 | 1.30 | 0.0194 | 7.7 | 8.2 |
| 44 | M | MD | 13 | 1.30 | 0.0589 | 7.0 | 8.4 |
| 44 | M | CD | 13 | 1.30 | 0.1191 | 7.1 | 10.1 |
| 44 | G | CD | 24 | 1.15 | −0.0040 | 6.1 | 6.0 |
| 44 | M | MD | 24 | 1.15 | 0.0204 | 6.0 | 6.5 |
| 44 | G | MD | 24 | 1.15 | 0.0212 | 6.0 | 6.5 |
| 44 | G | CD | 24 | 1.15 | 0.0269 | 5.9 | 6.6 |
| 36 | M | MD | 24 | 1.15 | 0.0456 | 5.8 | 7.0 |
| 36 | M | CD | 24 | 1.15 | 0.0539 | 5.9 | 7.3 |
| 44 | M | CD | 24 | 1.30 | 0.0187 | 6.3 | 6.8 |
| 44 | G | MD | 24 | 1.30 | 0.0140 | 6.6 | 6.9 |
| 44 | M | MD | 24 | 1.30 | 0.0177 | 6.5 | 6.9 |
| 36 | M | CD | 24 | 1.30 | 0.0465 | 6.1 | 7.2 |
| 44 | G | CD | 24 | 1.30 | 0.0309 | 6.5 | 7.3 |
| 36 | M | MD | 24 | 1.30 | 0.0516 | 6.1 | 7.4 |

TABLE 11

CD Stretch Change With Vacuum

| Fabric Ct | Fabric Type | Fabric Orient-ation | Basis Weight | Fabric Crepe Ratio | Slope | Inter-cept | Stretch @ 25 in Hg |
|---|---|---|---|---|---|---|---|
| 44 | M | MD | 13 | 1.15 | 0.0582 | 4.147 | 5.6 |
| 44 | G | CD | 13 | 1.15 | 0.0836 | 4.278 | 6.4 |
| 44 | G | CD | 13 | 1.30 | 0.0689 | 6.747 | 8.5 |
| 44 | M | MD | 13 | 1.30 | 0.1289 | 6.729 | 10.0 |
| 44 | G | MD | 13 | 1.30 | 0.0769 | 8.583 | 10.5 |
| 36 | M | MD | 24 | 1.15 | 0.0279 | 4.179 | 4.9 |
| 44 | M | MD | 24 | 1.15 | 0.0387 | 4.526 | 5.5 |
| 44 | G | MD | 24 | 1.15 | 0.0534 | 4.265 | 5.6 |
| 36 | M | MD | 24 | 1.30 | 0.0634 | 5.589 | 7.2 |
| 44 | G | MD | 24 | 1.30 | 0.0498 | 6.602 | 7.8 |
| 44 | M | MD | 24 | 1.30 | 0.0596 | 6.893 | 8.4 |

TABLE 12

TMI Friction Data

| Fabric | Stretch (%) | TMI Friction Top (Unitless) | TMI Friction Bottom (Unitless) |
|---|---|---|---|
| Yankee Dried | 0 | 0.885 | 1.715 |
| | 0 | 1.022 | 1.261 |
| | 15 | 0.879 | 1.444 |
| | 15 | 0.840 | 1.235 |
| | 25 | 1.237 | 1.358 |
| | 25 | 0.845 | 1.063 |
| | 30 | 1.216 | 1.306 |
| | 30 | 0.800 | 0.844 |
| | 35 | 1.221 | 1.444 |
| | 35 | 0.871 | 1.107 |
| | 40 | 0.811 | 0.937 |
| | 40 | 1.086 | 1.100 |
| Can Dried | 0 | 0.615 | 3.651 |
| | 0 | 0.689 | 1.774 |
| | 20 | 0.859 | 2.100 |
| | 20 | 0.715 | 2.144 |
| | 40 | 0.607 | 2.587 |
| | 40 | 0.748 | 2.439 |
| | 45 | 0.757 | 3.566 |
| | 45 | 0.887 | 2.490 |
| | 50 | 0.724 | 2.034 |
| | 50 | 0.929 | 2.188 |
| | 55 | 0.947 | 1.961 |
| | 55 | 1.213 | 1.631 |
| | 60 | 0.514 | 2.685 |
| | 60 | 0.655 | 2.102 |

Figure 34:
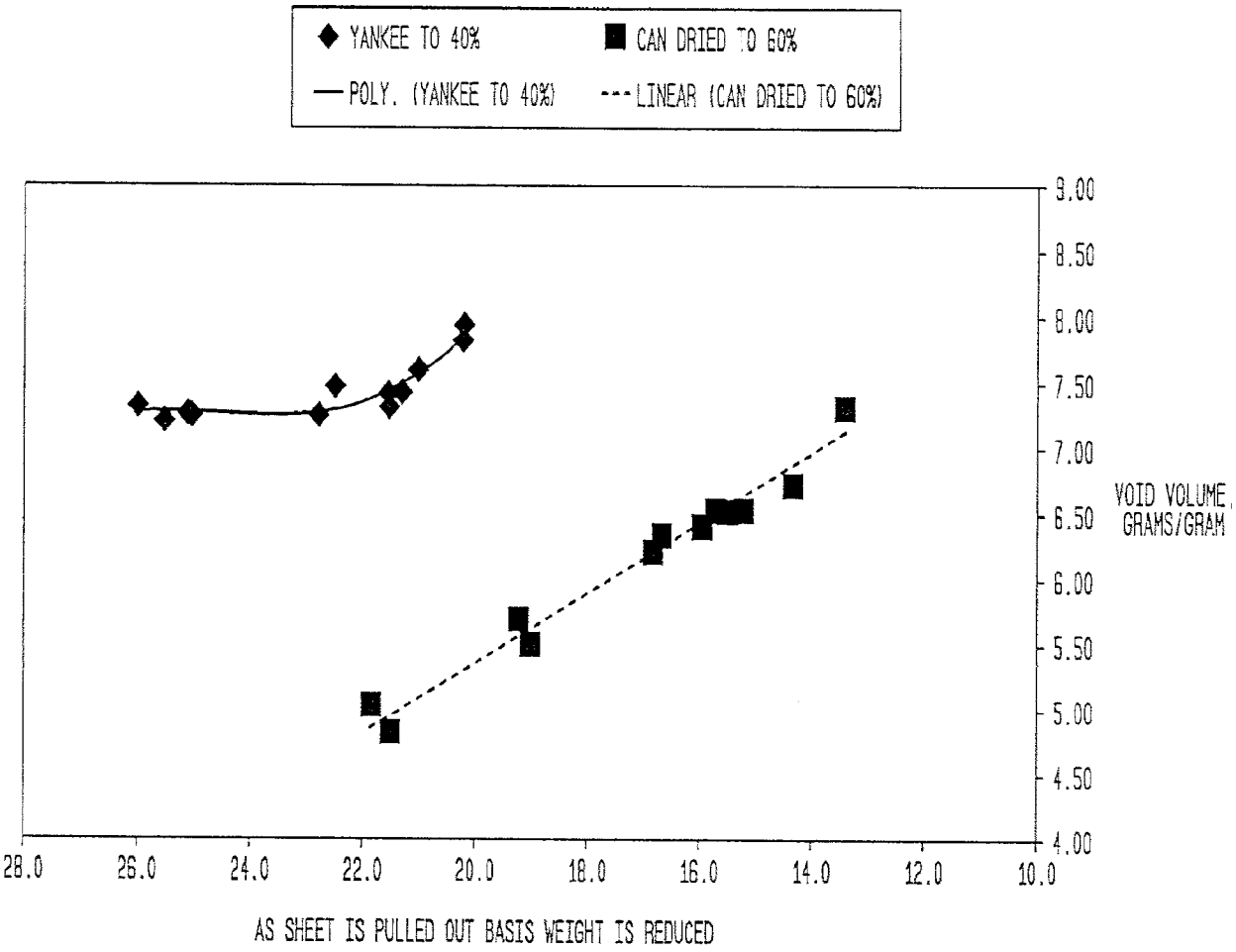
FIG. 34 is a plot of void volume versus basis weight as webs are drawn.

It is seen in FIG. 34 that the can-dried materials exhibit more void volume gain as the basis weight is reduced as the sheet is drawn. Moreover, the Yankee-dried and blade-creped material did not exhibit any void volume gain until relatively large elongation.

Figure 35:
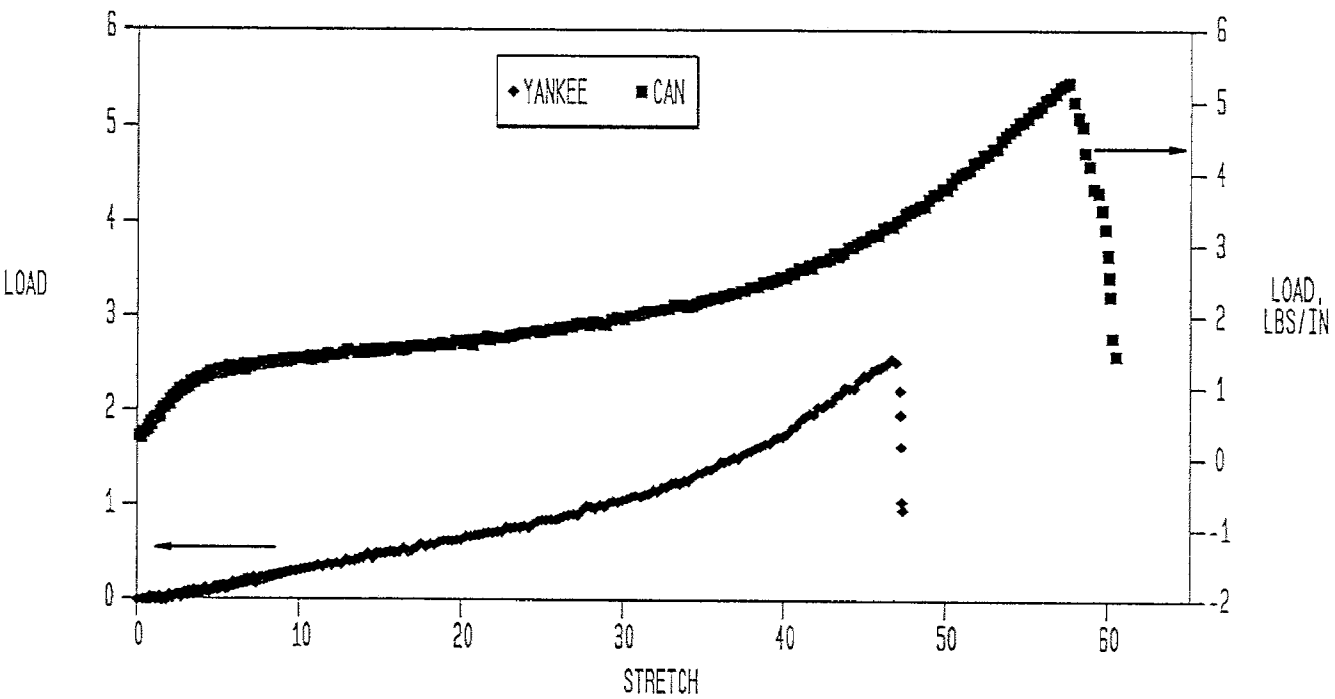
FIG. 35 is a diagram showing the machine direction modulus of webs of the invention wherein the respective abscissas have been shifted for the purposes of clarity.
Figure 36:
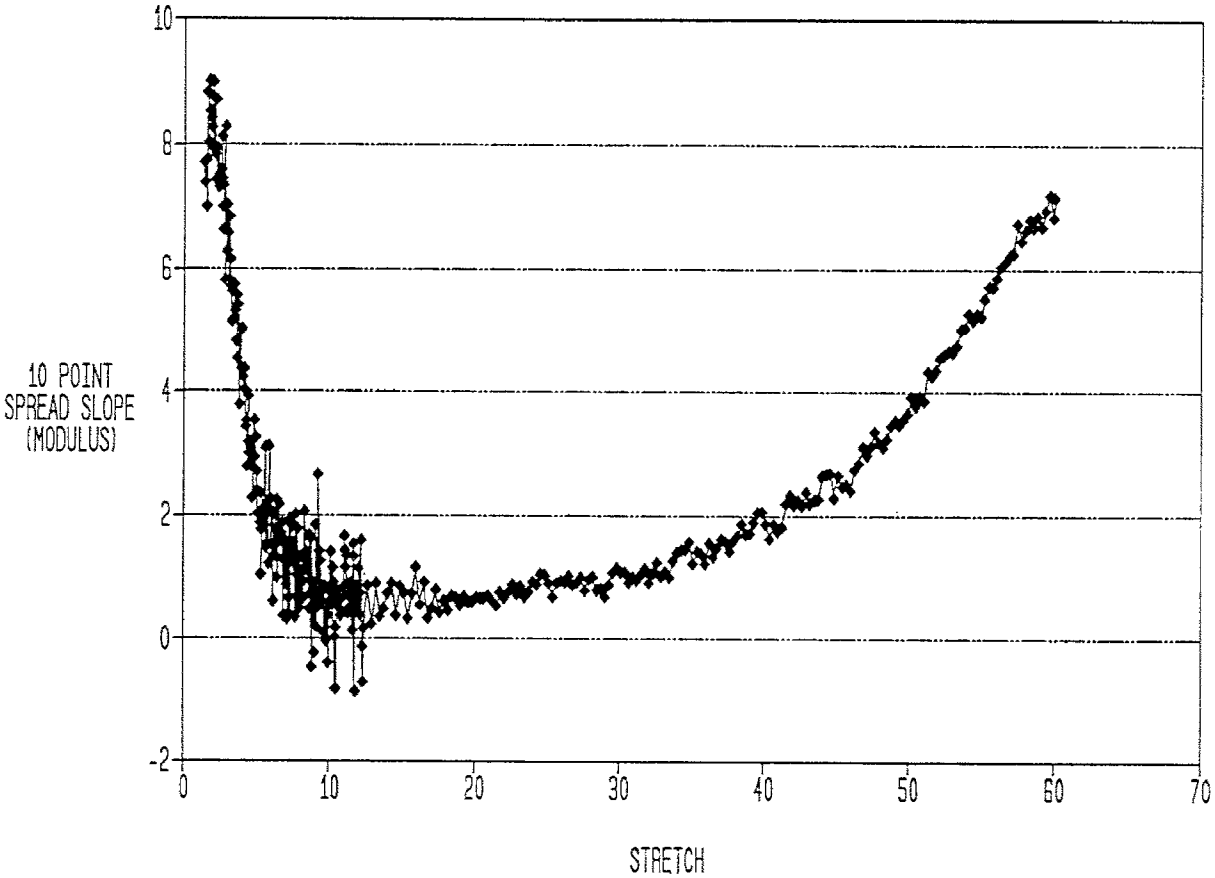
FIG. 36 is a plot of machine direction modulus versus percent stretch for can dried products of the present invention.

In Table 6 and Table 7, as well as FIGS. 35 and 36, it is seen that can-dried material and Yankee-dried material exhibit similar stress/strain behavior; however, the can-dried material has a higher initial modulus that may be beneficial to runnability. Modulus is calculated by dividing the incremental stress (per inch of sample width) in lbs by the additional elongation observed. Nominally, the quantity has units of $lbs/in^2$.

Figure 37:
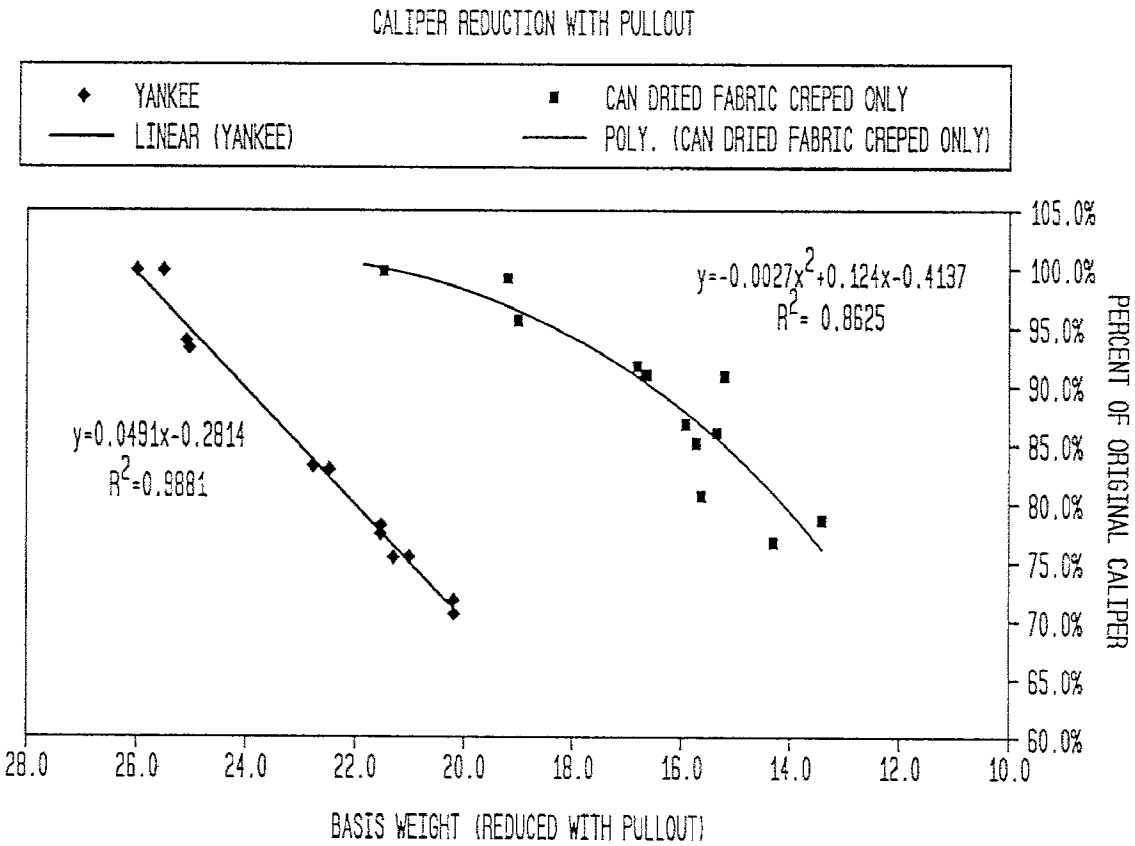
FIG. 37 is a plot of caliper change versus basis weight for various products of the invention.

FIG. 37 is a plot of caliper change versus basis weight upon drawing. The Yankee-dried web exhibited approximately 1:1 loss of caliper with basis weight (i.e., approximately constant bulk), whereas the can-dried web lost much more basis weight than caliper. This result is consistent with the data set of Examples 1-8 and with the void volume data. The ratio of percent decrease in basis weight may be calculated and compared for the different processes. The Yankee-dried material has an undrawn basis weight of about 26 lbs and a caliper loss of about 28% when drawn to a basis weight of about 20.5; that is, the material has only about 72% of its original caliper. The basis weight loss is about 5.5/26 or 21%; thus, the ratio of percent decrease in caliper/percent decrease in basis weight is approximately 28/21 or 1.3. FIG. 37 shows that the can-dried material loses caliper much more slowly with basis weight reduction as the material is drawn. As the can-dried sheet is drawn from a basis weight of about 22 lbs to about 14 lbs, only about 20% of the caliper is lost and the ratio of % decrease in caliper/percent decrease in basis weight is about 20/36 or 0.55.

Figure 38:
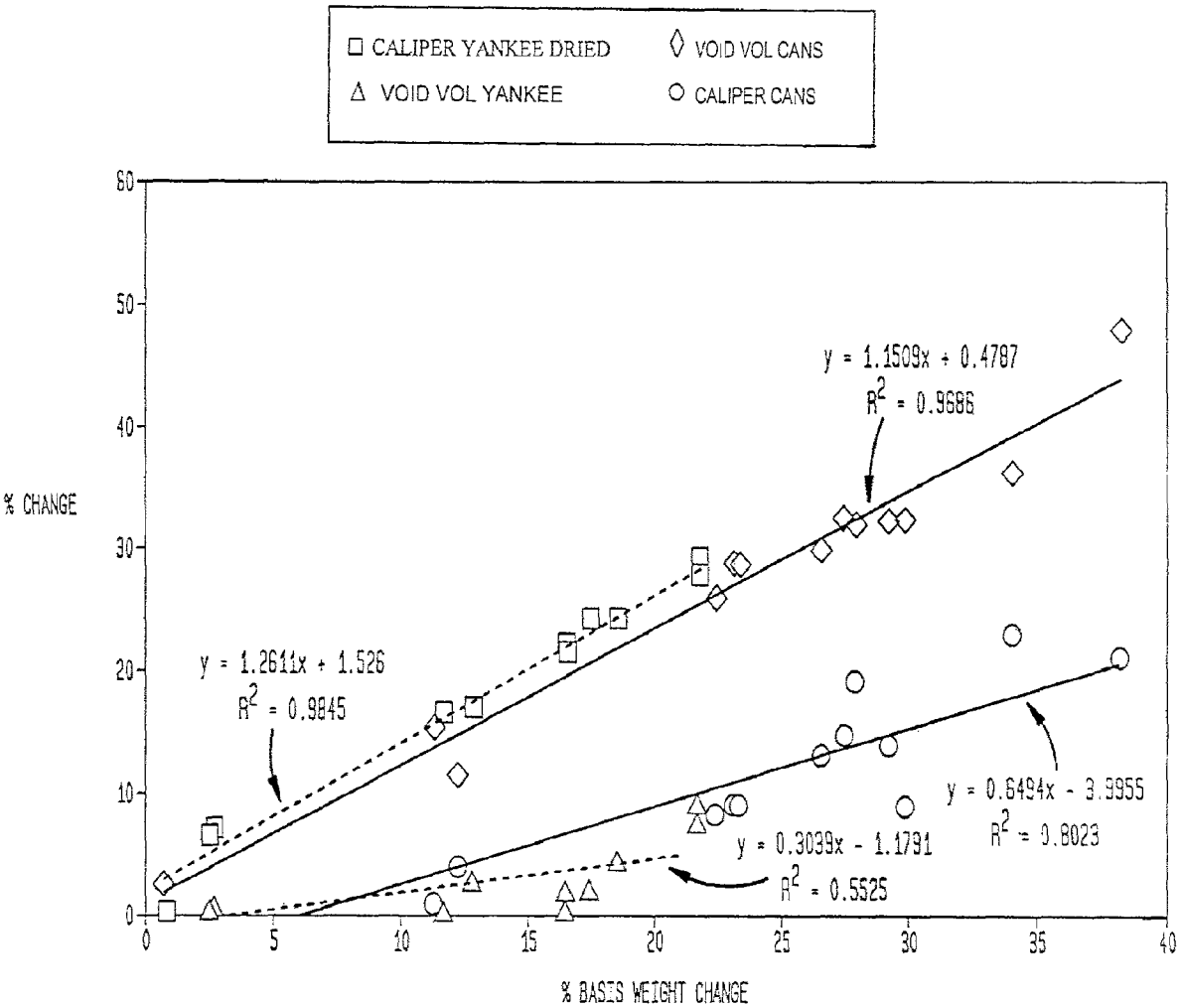
FIG. 38 is a plot of caliper change and void volume change versus bias weight change for various fabric-creped webs.

FIG. 38 shows that the void volume of the Yankee-dried material did not change as the basis weight was reduced by drawing until the web was drawn 15-20%. This is consistent with the fact that caliper and basis weight changed at nearly equal rates as the Yankee dried material was drawn. On the other hand, the can dried material showed increases in void volume of much more than the caliper change, consistent with the bulk increase observed upon drawing.

Figure 39:
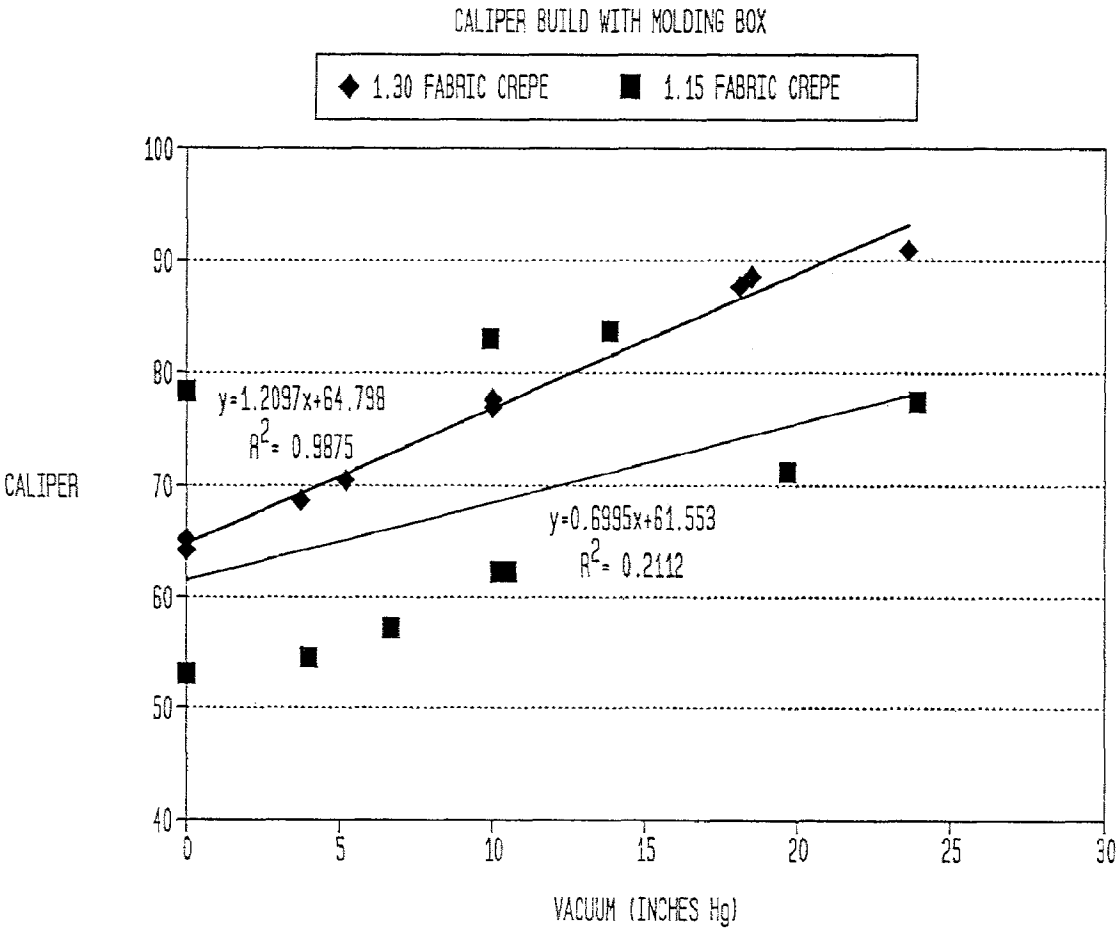
FIG. 39 is a plot of caliper versus applied vacuum for fabric-creped webs.
Figure 40:
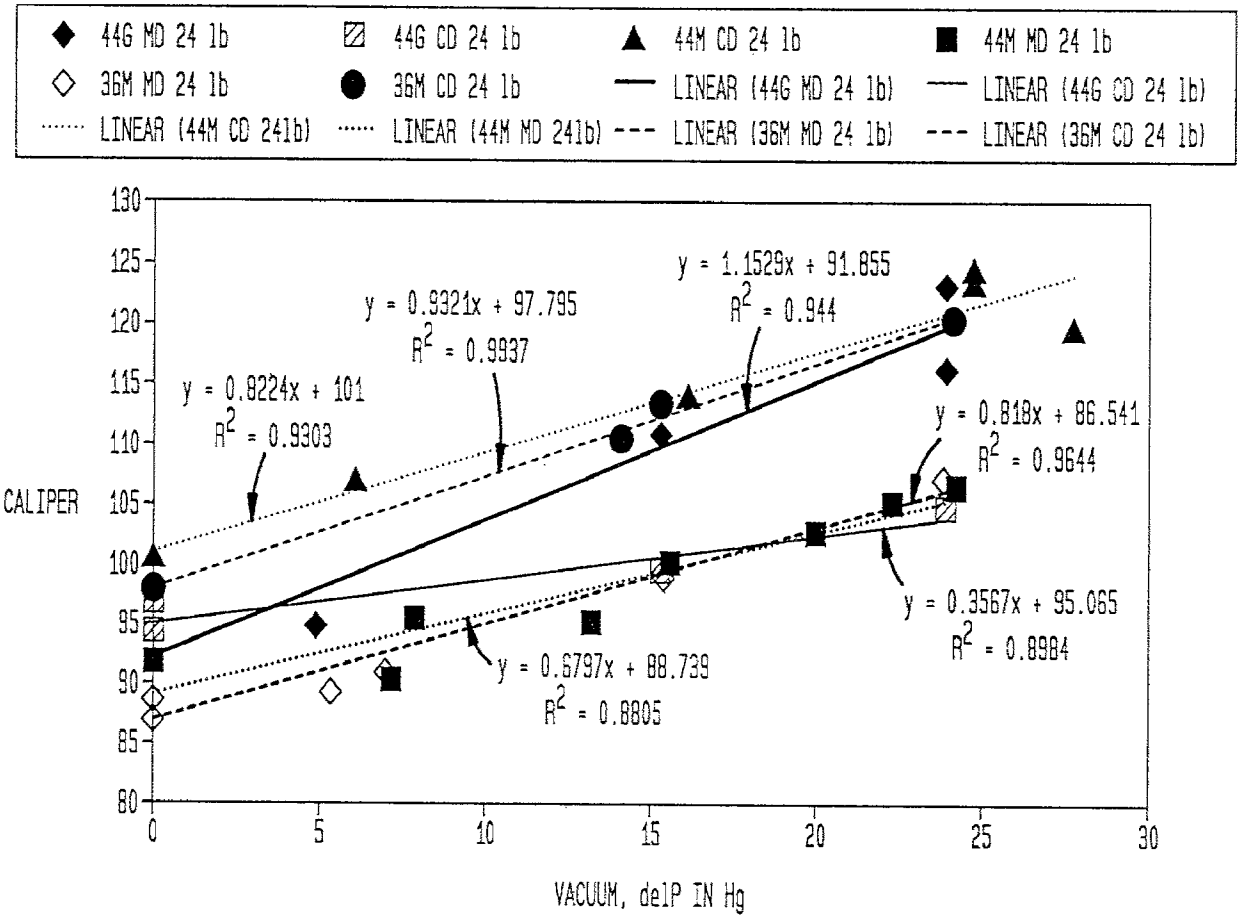
FIG. 40 is a plot of caliper versus applied vacuum for fabric-creped webs and various creping fabrics.
Figure 41:
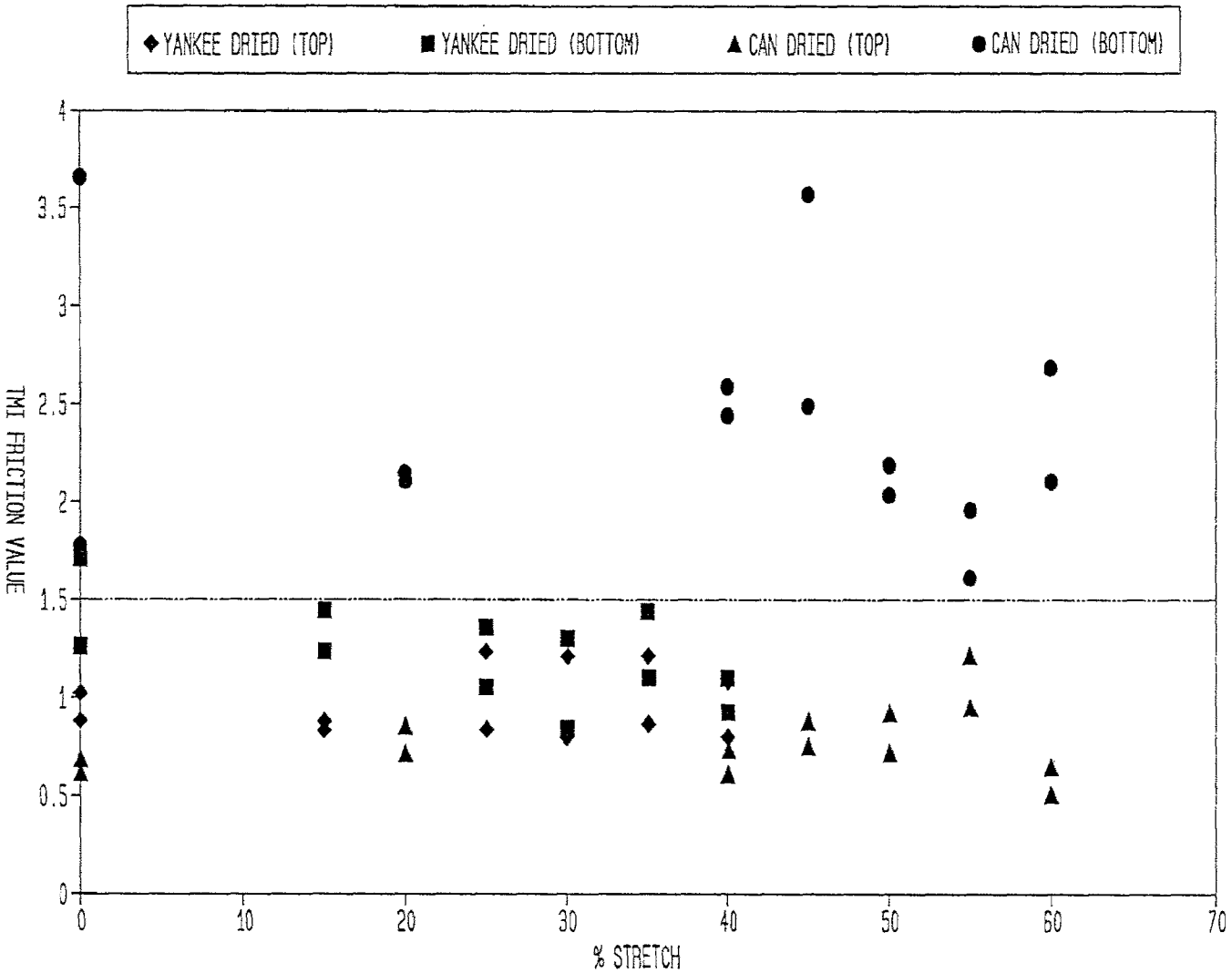
FIG. 41 is a plot of TMI Friction values versus draw for various webs of the invention.

In FIGS. 39 and 40, it is seen that caliper is influenced by selection of vacuum and creping fabric; while Table 12 and FIG. 41 show that the in-fabric can-dried material exhibited much higher TMI Friction values. In general, friction values decrease as the material is drawn. It will be appreciated from the data in Table 12 and FIG. 41 that, even though samples were run only in the MD, as the samples were drawn, the friction values on either side of the sheet converge; for example, the can dried samples had average values of 2.7/0.65 fabric side/can side prior to drawing and average values of 1.8/1.1 at 55% draw.

Figure 42:
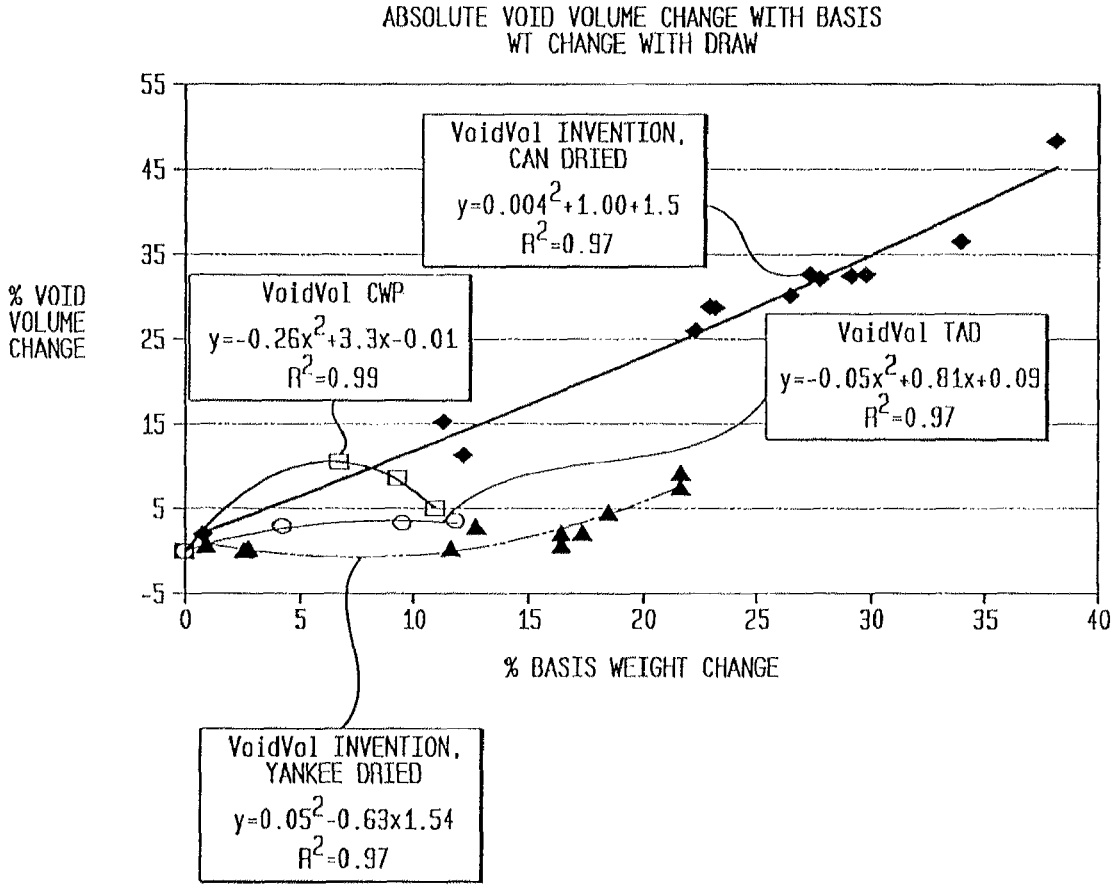
FIG. 42 is a plot of void volume change versus basis weight change for various products.

Differences between products of the invention and conventional products are particularly appreciated by reference to Table 4 and FIG. 42. It is seen that conventional through-air dried (TAD) products do not exhibit substantial increases in void volume (<5%) upon drawing and that the increase in void volume is not progressive beyond 10% draw; that is, the void volume does not increase significantly (less than 1%) as the web is drawn beyond 10%. The conventional wet press (CWP) towel tested exhibited a modest increase in void volume when drawn to 10% elongation; however, the void volume decreased at more elongation, again, not progressively increasing. The products of the present invention exhibited large, progressive increases in void volume as they are drawn. Void volume increases of 20%, 30%, 40% and more are readily achieved.

Figure 43:
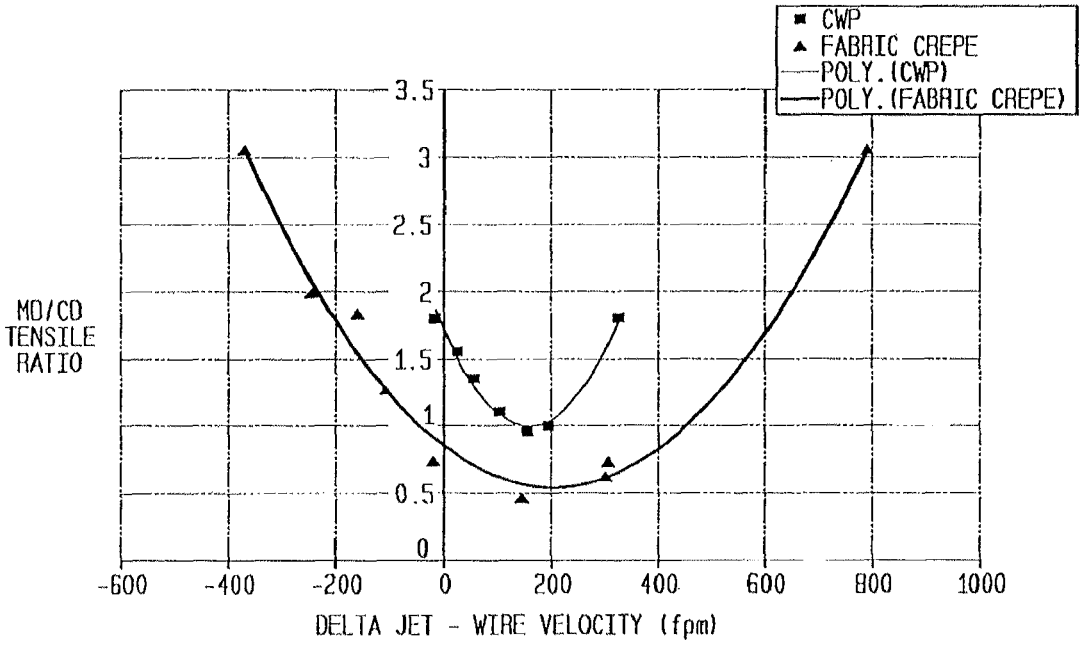
FIG. 43 is a diagram showing representative curves of the MD/CD tensile ratio versus jet to wire velocity delta for the products of the invention and conventional wet press (CWP) absorbent sheet.

Further differences between the inventive process and product, and conventional products and processes are seen in FIG. 43. FIG. 43 is a plot of MD/CD tensile ratio (strength at break) versus the difference between headbox jet velocity and forming wire speed (fpm). The upper U-shaped curve is typical of conventional wet-press absorbent sheet. The lower, broader, curve is typical of fabric-creped product of the invention. It is readily appreciated from FIG. 43 that MD/CD tensile ratios of below 1.5 or so are achieved in accordance with the invention over a wide range of jet to wire velocity deltas, a range that is more than twice that of the CWP curve shown. Thus, control of the headbox jet/forming wire velocity delta may be used to achieve desired sheet properties.

It is also seen from FIG. 43 that MD/CD ratios below square (i.e., below 1) are difficult, if not impossible, to obtain with conventional processing. Furthermore, square or below sheets are formed by way of the invention without excessive fiber aggregates or "flocs," which is not the case with the CWP products having low MD/CD tensile ratios. This difference is due, in part, to the relatively low velocity deltas required to achieve low tensile ratios in CWP products and may be due in part to the fact that fiber is redistributed on the creping fabric when the web is creped from the transfer surface in accordance with the invention. Surprisingly, square products of the invention resist propagation of tears in the CD and exhibit a tendency to self-healing. This is a major processing advantage since the web, even though square, exhibits reduced tendency to break easily when being wound.

In many products, the cross machine properties are more important than the MD properties, particularly, in commercial toweling where CD wet strength is critical. A major source of product failure is "tabbing" or tearing off of only a piece of towel rather than the entirety of the intended sheet. In accordance with the invention, CD tensiles may be selectively elevated by control of the headbox to forming wire velocity delta and fabric creping.

Alternative Embodiments

The present invention also generally includes processes wherein a web is compactively dewatered, creped into a creping fabric and dried in situ in that fabric. The process thus avoids the operating problem of transferring a partially dried web to a Yankee and makes it possible to use existing papermachines or existing assets with a modest amount of investment to make premium sheet. Preferably, fabric creping variables are selected so that the web is reoriented in the fabric from an apparently random fiber orientation upon web formation to provide a reordered microstructure dictated in part by the fabric design. The fabric is selected for the desired product texture and physical properties, while the furnish may likewise be adapted for the end use.

One aspect of the present invention provides a method of making an absorbent cellulosic web suitable for paper towel or paper tissue manufacture that includes forming a nascent web from a papermaking furnish, transferring the web to a translating transfer surface that is moving at a first speed, drying the web to a consistency of from about 30 to about 60 percent prior to or concurrently with transfer to the transfer surface, and fabric-creping the web from the transfer surface at the consistency of from about 30 to about 60 percent in a creping nip defined between the transfer surface and a creping fabric traveling at a second speed that is slower than the transfer surface, wherein the web is creped from the surface, and drying the web while it is held in the fabric to a consistency of at least 90 percent. The web has an absorbency of at least about 5 g/g. In a preferred embodiment, drying of the web after fabric-creping consists of contacting the web with a plurality of can dryers. Drying to a consistency from about 92 to 95 percent while the web is in the fabric is preferred. The step of forming the nascent web may include (i) forming the web in a Fourdrinier former and (ii) transferring the web to a papermaking felt.

The process is suitably operated at a Fabric Crepe (defined above) of from about 10 to about 100 percent, such as a Fabric Crepe of at least about 40, 60 or 80 percent.

The web may have a CD stretch of from about 5 percent to about 20 percent. Some preferred embodiments are those where: (a) the web has a CD stretch of at least 5 percent and an MD/CD tensile ratio of less than about 1.75, (b) the web has a CD stretch of at least 5 percent and an MD/CD tensile ratio of less than about 1.5, (c) the web has a CD stretch of at least 10 percent and an MD/CD tensile ratio of less than about 2.5, (d) the web has a CD stretch of at least 15 percent and a MD/CD tensile ratio of less than about 3.0, and (e) the web has a CD stretch of at least 20 percent and a MD/CD tensile ratio of less than about 3.5. So also, the web, in some cases, has an MD/CD tensile ratio of less than about 1.1, such as an MD/CD tensile ratio of from about 0.5 to about 0.9; and sometimes, the web exhibits an MD/CD tensile ratio of from about 0.6 to about 0.8. In other cases, the web has an MD/CD tensile ratio of 2 or 3, optionally, up to 4.

Typically, the web is fabric-creped at a consistency of from about 45 percent to about 60 percent, suitably, in most cases, the web is fabric-creped at a consistency of from about 40 percent to about 50 percent. Absorbencies of at least about 7 g/g are preferred, 9 g/g yet more preferred and 11 g/g or 13 g/g are still more preferred.

Another aspect of the invention provides a method of making a cellulosic web having elevated absorbency comprising forming a nascent web from a papermaking furnish, transferring the web to a translating transfer surface that is moving at a first speed, drying the web to a consistency of from about 30 to about 60 percent prior to or concurrently with transfer to the transfer surface, fabric-creping the web from the transfer surface at a consistency of from about 30 to about 60 percent utilizing a patterned creping fabric, the creping step occurring under pressure in a fabric creping nip defined between the transfer surface and the creping fabric, wherein the fabric is traveling at a second speed that is slower than the speed of the transfer surface, the fabric pattern, nip parameters, velocity delta and web consistency being selected such that the web is creped from the transfer surface and redistributed on the creping fabric, and drying the web in the fabric to a consistency of at least 90 percent, wherein the web has an absorbency of at least about 5 g/g.

A still further aspect of the invention is a method of making a fabric-creped absorbent cellulosic sheet that includes the steps of compactively dewatering a papermaking furnish to form a nascent web having a generally random distribution of papermaking fiber, applying the dewatered web having a generally random fiber distribution to a translating transfer surface that is moving at a first speed, fabric-creping the web from the transfer surface at a consistency of from about 30 to about 60 percent utilizing a patterned creping fabric, the creping step occurring under pressure in a fabric creping nip defined between the transfer surface and the creping fabric, wherein the fabric is traveling at a second speed that is slower than the speed of the transfer surface, the fabric pattern, nip parameters, velocity delta and web consistency being selected such that the web is creped from the surface and redistributed on the creping fabric to form a web with a reticulum having a plurality of interconnected regions of different fiber orientation including at least (i) a plurality of fiber-enriched regions having an orientation bias in a direction transverse to the machine direction, interconnected by way of (ii) a plurality of colligating regions whose fiber orientation bias is offset from the fiber orientation of the fiber-enriched regions, and drying the web in the fabric to a consistency of at least 90 percent. The plurality of fiber-enriched regions and colligating regions typically recur in a regular pattern of interconnected fibrous regions throughout the web where the orientation bias of the fibers of the fiber-enriched regions and colligating regions are transverse to one another. In one preferred embodiment, the fibers of the fiber-enriched regions are substantially oriented in the CD, while in another, the plurality of fiber-enriched regions has a higher local basis weight than that of the colligating regions. Generally, at least a portion of the colligating regions consists of fibers that are substantially oriented in the MD, and there is preferably a repeating pattern including a plurality of fiber-enriched regions, a first plurality of colligating regions whose fiber orientation is biased toward the machine direction, and a second plurality of colligating regions whose fiber orientation is biased toward the machine direction, but offset from the fiber orientation bias of the first plurality of colligating regions. In such cases, the fibers of at least one of the plurality of colligating regions is substantially oriented in the MD and the fiber-enriched regions may exhibit a plurality of U-shaped folds, as are seen in FIG. 13, for example. These attributes are present, for example, when the creping fabric is a creping fabric provided with CD knuckles defining creping surfaces transverse to the machine direction and the distribution of the fiber-enriched regions corresponds to the arrangement of CD knuckles on the creping fabric.

In a still yet further aspect of the invention, a method of making a fabric-creped absorbent cellulosic web includes forming a nascent web from a papermaking furnish, the nascent web having an apparently random distribution of papermaking fiber, further dewatering the nascent web having the apparently random fiber distribution by wet-pressing the web to a translating transfer surface that is moving at a first speed, fabric-creping the web from the transfer surface at a consistency of from about 30 to about 60 percent utilizing a patterned creping fabric, the creping step occurring under pressure in a fabric-creping nip defined between the transfer surface and the creping fabric, wherein the fabric is traveling at a second speed that is slower than the speed of the transfer surface, the fabric pattern, nip parameters, velocity delta and web consistency being selected such that the web is creped from the transfer surface and redistributed on the creping fabric to form a web with a reticulum having a plurality of interconnected regions of different local basis weights including at least (i) a plurality of fiber-enriched pileated regions of a high local basis weight, interconnected by way of (ii) a plurality of lower local basis weight linking regions whose fiber orientation is biased toward the direction between pileated regions; and subsequent to fabric-creping the web, drying the web to a consistency of greater than 90 percent by way of contacting the web with a plurality of can dryers, for example. Preferably, the step of wet-pressing the nascent web to the transfer surface is carried out with a shoe press.

Still yet another method of making a fabric-creped absorbent cellulosic sheet in accordance with the invention includes forming a nascent web from a papermaking furnish, the nascent web having an apparently random distribution of papermaking fiber, further dewatering the nascent web having the apparently random fiber distribution by wet-pressing the web to a rotating transfer cylinder that is moving at a first speed, fabric-creping the web from the transfer cylinder at a consistency of from about 30 to about 60 percent in a fabric creping nip defined between the transfer cylinder and a creping fabric that is traveling at a second speed that is slower than the speed of the transfer cylinder, wherein the web is creped from the cylinder and rearranged on the creping fabric, and drying the web utilizing a plurality of can dryers, wherein the web has an absorbency of at least about 5 g/g and a CD stretch of at least about 4 percent, as well as an MD/CD tensile ratio of less than about 1.75.

While the invention has been described in connection with several examples, modifications to those examples within the spirit and scope of the invention will be readily apparent to those of skill in the art. In view of the foregoing discussion, relevant knowledge in the art and references including co-pending applications discussed above in connection with the Background and Detailed Description, the disclosures of which are all incorporated herein by reference, further description is deemed unnecessary.

We claim:

1. A method of making a fabric-creped absorbentcellulosic sheet, the method comprising:

(a) compactively dewatering a papermaking furnish to form a nascent web having a random distribution of papermaking fiber;

(b) applying the nascent web having the random fiber distribution to a translating transfer surface that is moving at a transfer surface speed;

(c) fabric-creping the nascent web from the transfer surface at a consistency of from about 30 percent to about 60 utilizing a creping fabric; that is traveling at a fabric speed, the fabric speed being lower than the transfer surface speed, the fabric-creping step occurring under pressure in a fabric creping nip defined between the transfer surface and the creping fabric, such that the nascent web is creped from the transfer surface and redistributed on the creping fabric to form a creped web with a drawable reticulum having a plurality of interconnected regions of different local basis weights including at least:

(i)a plurality a fiber- enriched regions having a high local basis weight, the fiber-enriched regions comprising a plurality of microfolds with fold lines extending in a direction transverse to a machine direction (MD) of the sheet and having a fiber bias in a cross-machine direction (CD) of the sheet, and (ii) a plurality of lower local basis weight linking regions interconnecting the fiber-enriched regions;

(d) drying the crepe web to form a dried web; and (e) drawing the dried web, wherein the drawing step comprises drawing the dried web between a first draw roll and a second draw roll.

2. The method of making a fabric-creped absorbent cellulosic sheet according to claim 1 further comprising operating the first draw roll at a first draw roll speed that is greater than the fabric speed.

3. The method of making a fabric-creped absorbent cellulosic sheet according to claim 2, further comprising operating the second draw roll at a second draw roll speed that is greater than the first draw roll speed.

4. The method of making a fabric-creped absorbent cellulosic sheet according to claim 1, further comprising selecting the fabric pattern, the nip parameters, the velocity delta, and the web consistency, such that the web is creped from the transfer surface and redistributed on the creping fabric to form the creped web with the drawable reticulum.

5. The method of making a fabric-creped absorbent cellulosic sheet according to claim 1, wherein the drawing step includes drawing the web on-line.

6. The method of making a fabric-creped absorbent cellulosic sheet according to claim 1, wherein the drying step includes drying the creped web with a plurality of can dryers while the web is held in the creping fabric.

7. The method of making a fabric-creped absorbent cellulosic sheet according to claim 1, wherein the drying step includes drying the creped web with an impingement-air dryer while the web is held in the groping fabric.

8. The method of making a fabric-creped absorbent cellulosic sheet according to claim 1, further comprising calendering the dried web on-line.

9. The method of making a fabric-creped absorbent cellulosic sheet according to claim 1, wherein the drawing step includes drawing the dried web at least about 10%.

10. The method of making a fabric-creped absorbent cellulosic sheet according to claim 1, wherein the drawing step includes drawing the dried web at least about 15%.

11. The method of making a fabric-creped absorbent cellulosic sheet according to claim 1, wherein the drawing step includes drawing the dried web at least about 30%.

12. The method of making a fabric-creped absorbent cellulosic sheet according to claim 1, wherein the drawing step includes drawing the dried web it least about 45%.

13. The method of making a fabric-creped absorbent cellulosic sheet according to claim 1, wherein the drawing step includes drawing the dried web at least about 75%.

14. The method of making a fabric-creped absorbent cellulosic sheet according to claim 1, which is operated at a fabric crepe of from about 10% to about 300% and a crepe recovery of about 10% to about 100%.

15. The method of making a fabric-creped absorbent cellulosic sheet according to claim 1, which is operated at a crepe recovery of least about 20%.

16. The method of making a fabric-creped absorbent cellulosic sheet according to claim 1, which is operated at a crepe recovery of at least about 30%.

17. The method of making a fabric-creped absorbent cellulosic sheet according to claim 1, which is operated at a crepe recovery of at least about 40%.

18. The method of making a fabric-creped absorbent cellulosic sheet according to claim 1, which is operated at a crepe recovery of at least about 50%.

19. The method of making a fabric-creped absorbent cellulosic sheet according to claim 1, which is operated at a crepe recovery very of at least about 60%.

20. The method of making a fabric-creped absorbent cellulosic sheet according to claim 1, which is operated at a crepe recovery of at least about 80%.

21. The method of making a fabric-creped absorbent cellulosic sheet according claim 1, which is operated at a crepe recovery of a least about 100%.

22. The method of making a fabric-creped absorbent cellulosic sheet according to claim 1, which is operated at a fabric crepe of from about 10% to about 100%.

23. The method of making a fabric-creped absorbent cellulosic sheet according to claim 1, which is operated at a fabric crepe of at least about 40%.

24. The Method of making a fabric-creped absorbent cellulosic sheet according to claim 1, which is operated at a fabric crepe of at least about 60%.

25. The method of making fabric-creped absorbent cellulosic sheet according to claim 1, which is operated at a fabric crepe of at least about 80%.

26. The method of making a fabric-creped absorbent cellulosic sheet according to claim 1, wherein the drawing step includes drawing the dried web until the void volume of the web is at least about 1 gm/gm.

27. The method of making a fabric-creped absorbent cellulosic sheet according to claim 1, wherein the drawing step includes drawing the dried web until the void volume of the web is at least about 2 gm/gm.

28. The method of making a fabric-creped absorbent cellulosic sheet according claim 1, wherein the drawing step includes drawing the dried web with the void volume of the web is at least about 3 gm/gm.

29. The method of making a fabric-creped absorbent cellulosic sheet according to claim 1, wherein the drawing step includes drawing the dried web until the void volume of the web is at least about 4 gm/gm.

30. The method of making a fabric-creped absorbent cellulosic sheet according to claim 1, wherein the drawing step includes drawing the dried web until the void volume of the web is at least about 5 gm/gm.

31. The method of making a fabric-creped absorbent cellulosic sheet according to claim 1, wherein the drawing step includes drawing the dried web until the void volume of the web is at least about 6 gm/gm.

32. The method of making a fabric-creped absorbent cellulosic sheet according to claim 1, wherein the drawing step includes drawing the dried web until the void volume of the web is at least about 7 gm/gm.

33. The method of making a fabric-creped absorbent cellulosic sleet according to claim 1, wherein the drawing step includes drawing the dried web until the void volume of the web is at least about 8 gm/gm.

34. The method of making a fabric-creped absorbent cellulosic sleet according to claim 1, wherein the drawing step includes drawing the dried web until the void volume of the web is at least about 9 gm/gm.

35. The method of making a fabric-creped absorbent cellulosic sleet according to claim 1, wherein the drawing step includes drawing the dried web until the void volume of the web is at least about 10 gm/gm.

36. The method of making a fabric-creped absorbent cellulosic sheet according to claim 1, wherein the drawing step increases the void volume of the dried web.

37. The method of making a fabric-creped absorbent cellulosic sheet according to claim 36, wherein the drawing step increases the void volume of the dried web by at least about 5%.

38. The method of making a fabric-creped absorbent cellulosic sheet according to claim 36, wherein the drawing step increases the void volume of the dried web by least about 10%.

39. The method of making a fabric-creped absorbent cellulosic sheet according to claim 36, wherein the drawing step increases the void volume of the dried web by at least about 25%.

40. The method of making a fabric-creped absorbent cellulosic sheet according to claim 36, wherein the drawing step increases the void volume of the dried web by at least about 50%.

41. The method of making a fabric-creped absorbent cellulosic sheet according to claim 1, wherein the drawing step includes drawing the dried web in the machine direction.

42. The method of making a fabric-creped absorbent cellulosic sheet according to claim 41, wherein the drawing of the dried web in the machine direction expands the microfolds.

43. The method of making a fabric-creped absorbent cellulosic sheet according to claim 1, wherein the drawing step increases the bulk of the dried web.

44. The method of making a fabric-creped absorbent cellulosic sheet according to claim 43, wherein the drawing step increases the bulk of the dried web by at least 5%.

45. The method of making a fabric-creped absorbent cellulosic sheet according to claim 43, wherein the drawing step increases the bulk of the dried web by at least 10%.

46. The method of making a fabric-creped absorbent cellulosic sheet according to claim 1, wherein the drawing step the sidedness of the dried web.

47. The method of making a fabric-creped absorbent cellulosic sheet according to claim 46, wherein the drawing step the sidedness of the dried web by at least about 10%.

48. The method of making a fabric-creped absorbent cellulosic sheet according to claim 46, wherein the drawing step the sidedness of the dried web by at least about 20%.

49. The method of making a fabric-creped absorbent cellulosic sheet according to claim 46, wherein the drawing step the sidedness of the dried web by at least about 40%.

50. The method of making a fabric-creped absorbent cellulosic sheet according to claim 1, wherein drawing step reduces the TMI Friction value of the fabric side of the dried web.

51. The method of making a fabric-creped absorbent cellulosic sheet according to claim 1, wherein the drying step includes drying the web to as consistency of at least about 90% prior to drawing.

52. The method of making a fabric-creped absorbent cellulosic sheet according to claim 1, wherein the drying step includes drying the web to as consistency of at least about 92% prior to drawing.

53. The method of making a fabric-creped absorbent cellulosic sheet according to claim 1, wherein the papermaking furnish is aqueous and comprises secondary fiber.

54. The method of making a fabric-creped absorbent cellulosic sheet according to claim 1, wherein the drawing step decreases the caliper of the dried web less than the basis weight of the dried web.

55. The method of making a fabric-creped absorbent cellulosic sheet according to claim 54, wherein the drawing step results in a ratio of percent decrease in caliper/percent decrease in basis weight of the dried web of less than about 0.85.

56. The method of making a fabric-creped absorbent cellulosic sheet according to claim 54, wherein the drawing step results in a ratio of percent decrease in caliper/percent decrease in basis weight of the dried web of less than about 0.7.

57. method of making a fabric-creped absorbent cellulosic sheet according in claim 54, wherein die drawing step results in a ratio of percent decrease in caliper/percent decrease in basis weight of the dried web of less than about 0.6.

58. The method of making a fabric-creped absorbent cellulosic sheet according to claim 1, wherein the drying step includes providing the web to a single-tier can-drying section at a consistency of less than about 70% and drying the web to a consistency of greater than about 90% in the single-tier drying section.

59. The method of making a fabric-creped absorbent cellulosic sheet according to claim 1, wherein the drying step includes providing the web to a two-tier can drying section at a consistency of less than about 70% and drying the web to a consistency of greater than about 90% in the two-tier drying section.

60. The method of making a fabric-creped absorbent cellulosic sheet according to claim 1, wherein the drying step includes providing the web to a can drying section at a consistency of less than about 70% and drying the web to a consistency of greater than about 90% in the drying section.

61. The method of making a fabric-creped absorbent cellulosic sheet according to claim 1, wherein the web contains more than 6 percent residual moisture prior to the drawing step, such that the drawing step occurs before the web is air-dry.

62. The method of making a fabric-creped absorbent cellulosic sheet according to claim 1, wherein the web has a stretch at break of at least 20% prior to the drawing step.

63. The method of making a fabric-creped absorbent cellulosic sheet according to claim 1, wherein the web has a stretch at break of at least 30% prior to the drawing step.

64. The method of making a fabric-creped absorbent cellulosic sheet according to claim 1, wherein the web has a stretch at break of at least 45% prior to the drawing step.

65. The method of making a fabric-creped absorbent cellulosic sheet according in claim 1, wherein the web has a stretch at break of at least 60% prior to the drawing step.

66. The method of making a fabric-creped absorbent cellulosic sheet according to claim 1, wherein the drawing step preferentially attenuates the fiber-enriched regions of the dried web.

* * * * *